US010822209B1

(12) United States Patent
Horton

(10) Patent No.: US 10,822,209 B1
(45) **Date of Patent: *Nov. 3, 2020**

(54) LIFT ATTACHMENT APPARATUS

(71) Applicant: Jared D. Horton, Glenwood, IA (US)

(72) Inventor: Jared D. Horton, Glenwood, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/290,525

(22) Filed: Mar. 1, 2019

Related U.S. Application Data

(63) Continuation-in-part of application No. 15/143,279, filed on Apr. 29, 2016, now Pat. No. 10,221,049.

(60) Provisional application No. 62/154,541, filed on Apr. 29, 2015.

(51) Int. Cl.
*B66C 23/44* (2006.01)
*B66F 9/06* (2006.01)
*E02F 5/30* (2006.01)

(52) U.S. Cl.
CPC ..... *B66C 23/44* (2013.01); *B66F 9/06* (2013.01); *E02F 5/30* (2013.01)

(58) Field of Classification Search
CPC ..... B66F 9/06; B66C 23/44; E02F 5/30
See application file for complete search history.

(56) References Cited

U.S. PATENT DOCUMENTS 1,368,619 A 2/1921 Fleury
2,301,808 A 11/1942 Mosher
2,493,150 A 1/1950 Kroger
2,719,730 A 10/1955 Beck
2,788,906 A 4/1957 Davis et al.
2,899,093 A 8/1959 Morrell
3,042,236 A 7/1962 Pilch
3,123,222 A 3/1964 Livingston et al.
3,204,793 A 9/1965 Lane
3,812,979 A 5/1974 Leihgeber
4,200,423 A 4/1980 Somsin
4,436,477 A 3/1984 Lenertz et al.
4,960,359 A 10/1990 Lovitt, Jr.
5,054,989 A 10/1991 Fell
5,120,186 A * 6/1992 Jorgenson ..... B66C 23/44 212/181
5,169,278 A 12/1992 Hoechst et al.
5,171,124 A 12/1992 Foster
5,217,342 A * 6/1993 Grether ..... B66F 9/06 180/209
D374,752 S 10/1996 Lee et al.
(Continued)

*Primary Examiner* — Ronald P Jarrett
(74) *Attorney, Agent, or Firm* — Suiter Swantz pc llo

(57) ABSTRACT

The present disclosure is a lift attachment apparatus for construction and farm equipment, including a loader. In an embodiment of the disclosure, lift apparatus may include a frame including an attachment device configured to attach to a tilting plane of a loader having a forward facing loader arm, a pair of wheels connected to the frame, a first wheel of the pair of wheels located on a first side of the frame and a second wheel of the pair of wheels located on a second side of the frame. The lift attachment apparatus may further include a boom or forks connected directly or indirectly to the frame, wherein control of the boom or forks is provided by application of force to the attachment device by the forward facing loader arm in a downward direction to create lift and rotation of the tilting plane causing rotation of an end of the boom or forks about the first wheel and the second wheel.

10 Claims, 56 Drawing Sheets

(56) References Cited

U.S. PATENT DOCUMENTS

| | | | |
|---|---|---|---|
| 5,611,657 | A | 3/1997 | Peterson |
| 5,921,743 | A | 7/1999 | Slagter |
| 5,975,826 | A | 11/1999 | Scholder |
| 6,551,050 | B1 | 4/2003 | Kallevig et al. |
| 6,840,334 | B2 | 1/2005 | Marquardt |
| 6,851,486 | B2 | 2/2005 | Marshall |
| 7,273,342 | B2 | 9/2007 | DeSilvio |
| 7,314,342 | B2 | 1/2008 | Kerwin |
| 7,454,850 | B2 | 11/2008 | Smith |
| 7,926,583 | B2 | 4/2011 | Newnam |
| 8,167,053 | B2 | 5/2012 | Hendron et al. |

* cited by examiner

LIFT ATTACHMENT APPARATUS

CROSS REFERENCE TO RELATED APPLICATIONS

The present application claims the benefit under 35 U.S.C. § 120 of U.S. patent application Ser. No. 15/143,279 filed Apr. 29, 2016. The U.S. patent application Ser. No. 15/143,279 filed Apr. 29, 2016 claims the benefit under 35 U.S.C. § 119(e) of U.S. Provisional Application Ser. No. 62/154,541 filed Apr. 29, 2015. The U.S. patent application Ser. No. 15/143,279 filed Apr. 29, 2016 and the U.S. Provisional Application Ser. No. 62/154,541 are hereby incorporated by reference in their entirety.

TECHNICAL FIELD

The present disclosure generally relates to the field of construction; and more specifically to a lift attachment apparatus for farm and construction equipment.

BACKGROUND

Farm and construction equipment are regularly employed in a variety of applications to move material. Construction and farm equipment may include loader equipment with wheels, tracks or other system that makes them mobile for the use of moving or processing material with quick attachment capabilities. Loaders may include track skid loader, skid steer loader, all wheel steer loader, wheel loader, crawler loader or a front end loader.

It is common for a loader to include a bucket to contain material. Advantageously, material may be retrieved, stored, transported and deposited in another location. Material retrieved within the bucket may include snow, dirt, cement, rock and the like. It is also contemplated that other types of attachments may be attached to the loader in order to improve the functionality of the loader. These attachments may include blades, forks, brooms, and auger bits.

SUMMARY

The present disclosure is directed to a lift attachment apparatus for construction and farm equipment, including a loader. In an embodiment of the disclosure, lift apparatus may include a frame including an attachment device configured to attach to a tilting plane of a loader having a forward facing loader arm, a pair of wheels connected to the frame, a first wheel of the pair of wheels located on a first side of the frame and a second wheel of the pair of wheels located on a second side of the frame, the first wheel configured to be maintained parallel to the second wheel. The lift attachment apparatus may further include a boom connected to the frame, wherein control of the boom is provided by application of force to the attachment device by the forward facing loader arm in a downward direction to create lift and rotation of the tilting plane causing rotation of an end of the boom about the first wheel and the second wheel.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Figure 1A:
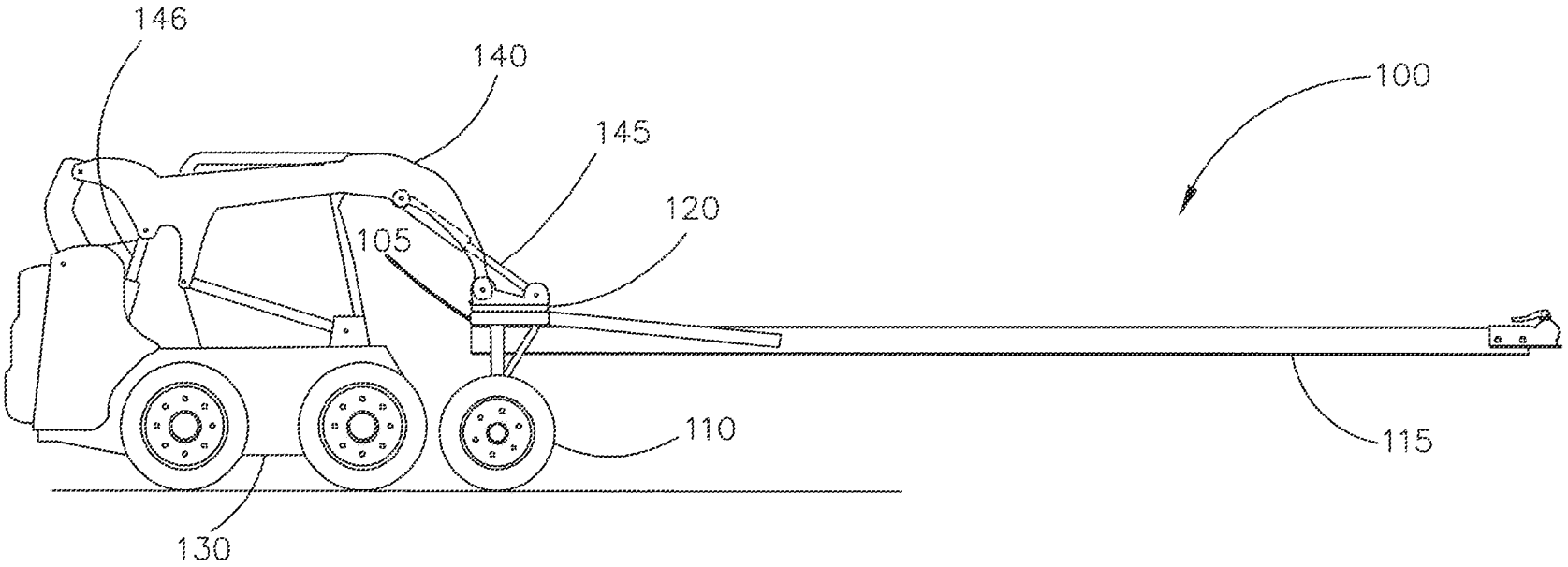
FIGS. 1A-1D depict side views of a lift attachment apparatus in accordance with an embodiment of the present disclosure.

Reference will now be made in detail to the subject matter disclosed, which is illustrated in the accompanying drawings.

The present disclosure is directed to a lift attachment apparatus for construction and farm equipment, including a loader. In an embodiment of the disclosure, lift apparatus may include a frame including an attachment device configured to attach to a tilting plane of a loader having a forward facing loader arm, a pair of wheels connected to the frame, a first wheel of the pair of wheels located on a first side of the frame and a second wheel of the pair of wheels located on a second side of the frame, the first wheel configured to be maintained parallel to the second wheel. The lift attachment apparatus may further include a boom connected to the frame, wherein control of the boom is provided by application of force to the attachment device in a downward direction by the forward facing loader arm to create lift and rotation of the tilting plane causing rotation of an end of the boom about the first wheel and the second wheel.

Before any embodiments of the disclosure are explained in detail, it is to be understood that the embodiments may not be limited in application per the details of the structure or the function as set forth in the following descriptions or illustrated in the figures. Different embodiments may be capable of being practiced or carried out in various ways. Also, it is to be understood that the phraseology and terminology used herein is for the purpose of description and should not be regarded as limiting. The use of terms such as "including," "comprising," or "having" and variations thereof herein are generally meant to encompass the item listed thereafter and equivalents thereof as well as additional items. Further, unless otherwise noted, technical terms may be used according to conventional usage. It is further contemplated that like reference numbers may describe similar components and the equivalents thereof.

Referring to FIGS. 1A-1D, side views of a lift attachment apparatus 100 in accordance with an embodiment of the present disclosure are shown. Lift attachment apparatus may include a frame, the frame including an attachment device 105. Attachment device 105 may be configured to attach to a tilting plane of a loader. It is contemplated that attachment device 105 may be a quick attachment device in use with various types of attachments to connect with loaders. It is contemplated that a quick attachment device may be a device which allows a user to attach and detach attachments with a connection without difficult assembly and disassembly. Additionally, a quick attachment device may not require specialized tools which may allow for attachment and detachment of attachments in the field. A pair of wheels 110 may be coupled to the frame. It is contemplated that a first wheel of the pair of wheels may be located on a first side of the frame and a second wheel of the pair of wheels may be located on a second side of the frame, the first wheel configured to be maintained parallel to the second wheel. In an embodiment, each wheel may include a tire. Apparatus 100 may further include a boom 115 connected to the frame.

Figure 1B:
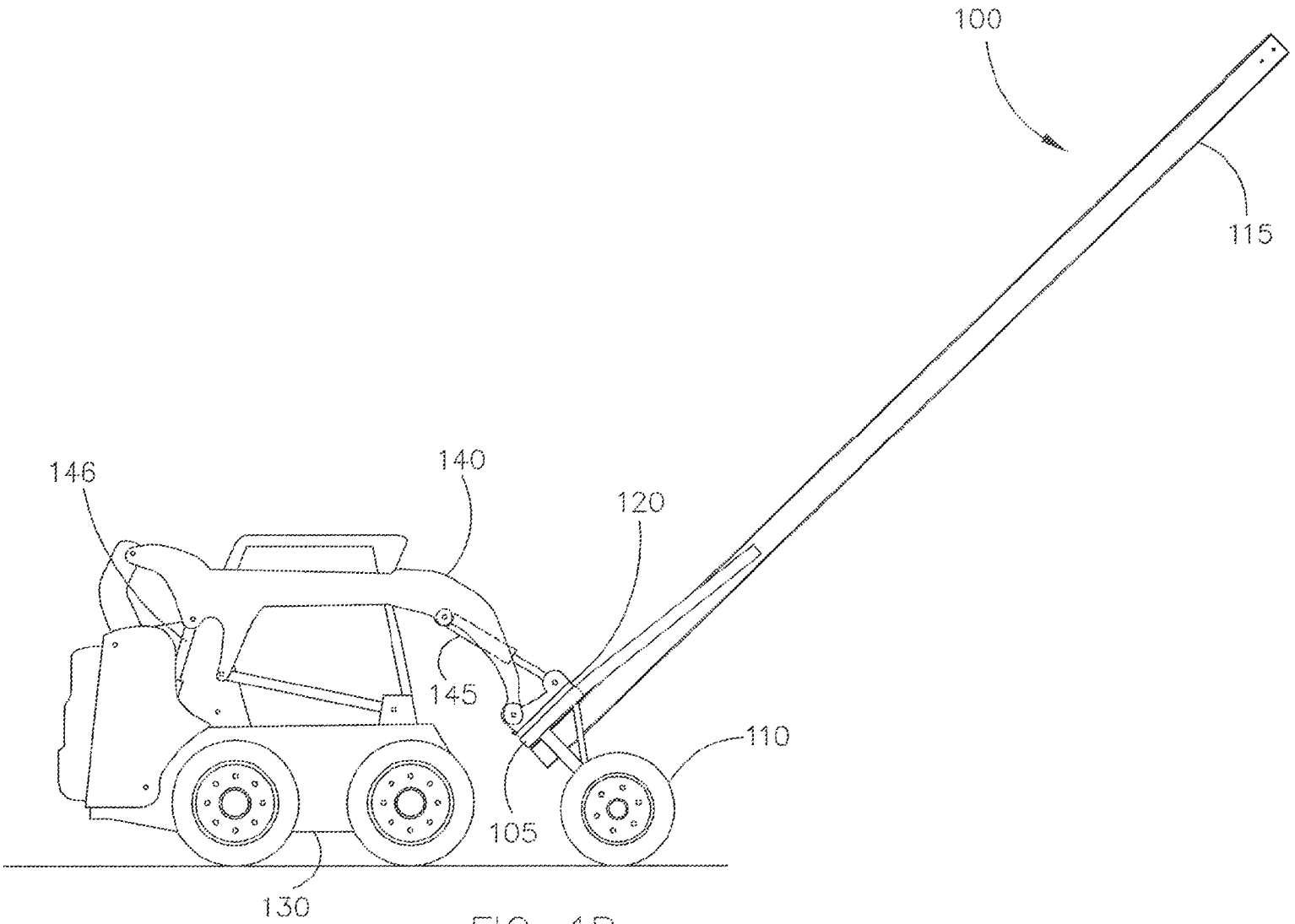
Figure 1C:
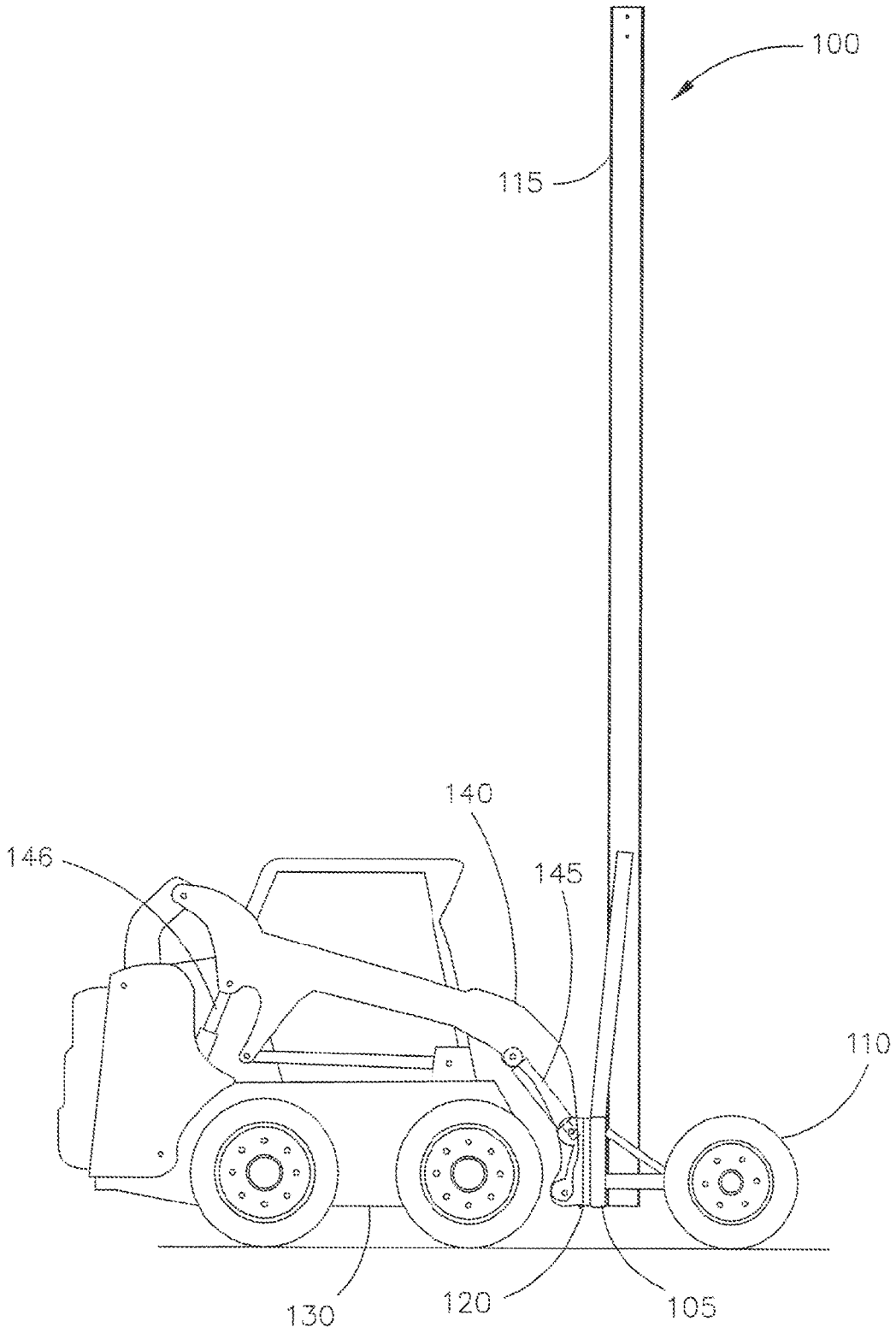

Advantageously, it is contemplated that various items (e.g. a load) may be removably coupled to an end of boom 115 and may be lifted to a desired location. Lift attachment apparatus 100 according to present disclosure may be configured to be safely rotated from a horizontal position as shown in FIG. 1A to a near vertical position (near 90 degrees to a surface) as shown in FIG. 1C without risking the load or tipping an attached loader. Attachment device 105 of frame may be configured to attach to a tilting plane 120 of a loader 130 having a forward facing loader arm 140. It is contemplated that attachment device 105 may be permanently fixed or incorporated with tilting plane 120 according to an alternative embodiment of the present disclosure. Boom 115 may be generally fixed with the attachment device 105 of the frame. It is contemplated that control of the boom 115 is provided by application of force to the attachment device 105 by the forward facing loader arm 140 in a downward direction to create lift and rotation of the tilting plane 120 causing rotation of an end of the boom about the first wheel and the second wheel of the pair of wheels 110. Tilting plane 120 may be controlled by a hydraulic cylinder 145 of loader. It is contemplated that boom 115 may be configured to be tipped up via application of force to the attachment device 105 in a downward direction and via reverse action of hydraulic cylinder 146 of the forward facing loader arm 140 of the loader 130. Through reverse action, the hydraulic capacity may be reduced, such as by about 44%. This reduction in hydraulic capacity may make it difficult to overload the apparatus 100 attachment if the load is being raised. Since the hydraulic capacities of hydraulic cylinders of many loaders are just over their tipping capacity, the reduction in hydraulic capacity may put the apparatus well below the tipping capacity and higher than the safe operating capacity.

Figure 1D:
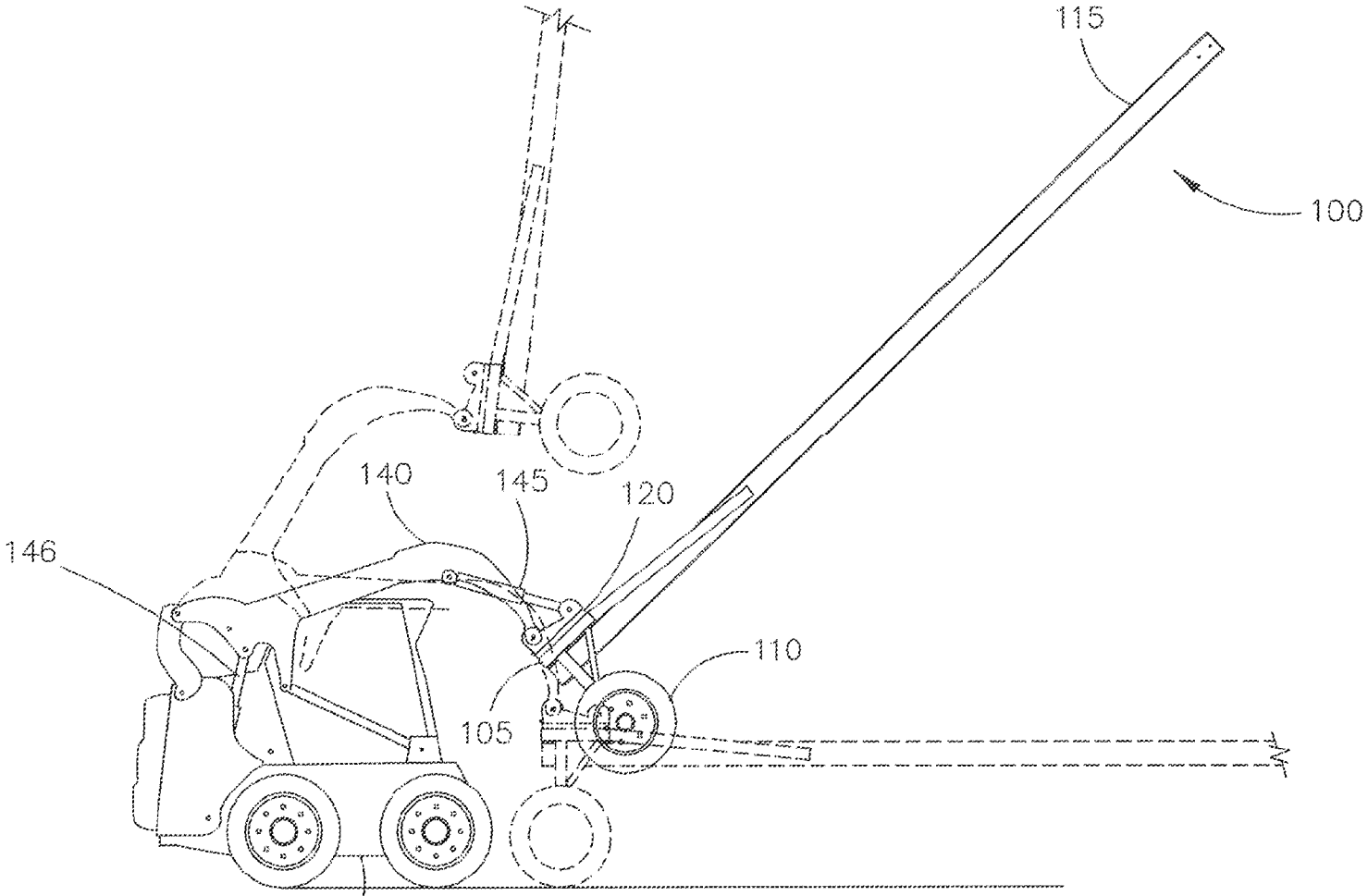

Referring to FIG. 1D, it is contemplated that lift attachment apparatus 100 may be raised by forward facing loader arm 140 whereby pair of wheels 110 may be supported by a raised surface or a vertical surface in accordance with embodiments of the disclosure to further increase the height to which an end of the boom may reach.

Referring again to FIGS. 1A-1D, boom 115 is configured as a long rod or pole. It is contemplated that boom 115 may include a trolley beam. Boom 115 may also include one or more of an aperture, hook, connectors and the like to allow coupling to material for transport. It is contemplated that boom 115 may be constructed of steel, and may be tubular in nature. However, boom 115 may be formed of various cross section shapes such as rectangular, round, triangle, roman arch, or gothic arch. Boom 115 may be constructed as a skeletal body. Boom 115 may be constructed of other materials instead of or in addition to steel, including aluminum, wood, plastic, carbon fiber, composites thereof and the like.

Loader 130 may include any type and size of loader. Loader 130 may be track skid loader, skid steer loader, all wheel steer loader, wheel loader, crawler loader or a front end loader. While loader 130 is described with a single forward facing loader arm 140, it is contemplated that two or more forward facing loader arms may be employed by a loader 130 without departing from the scope and intent of the present disclosure.

Figure 2:
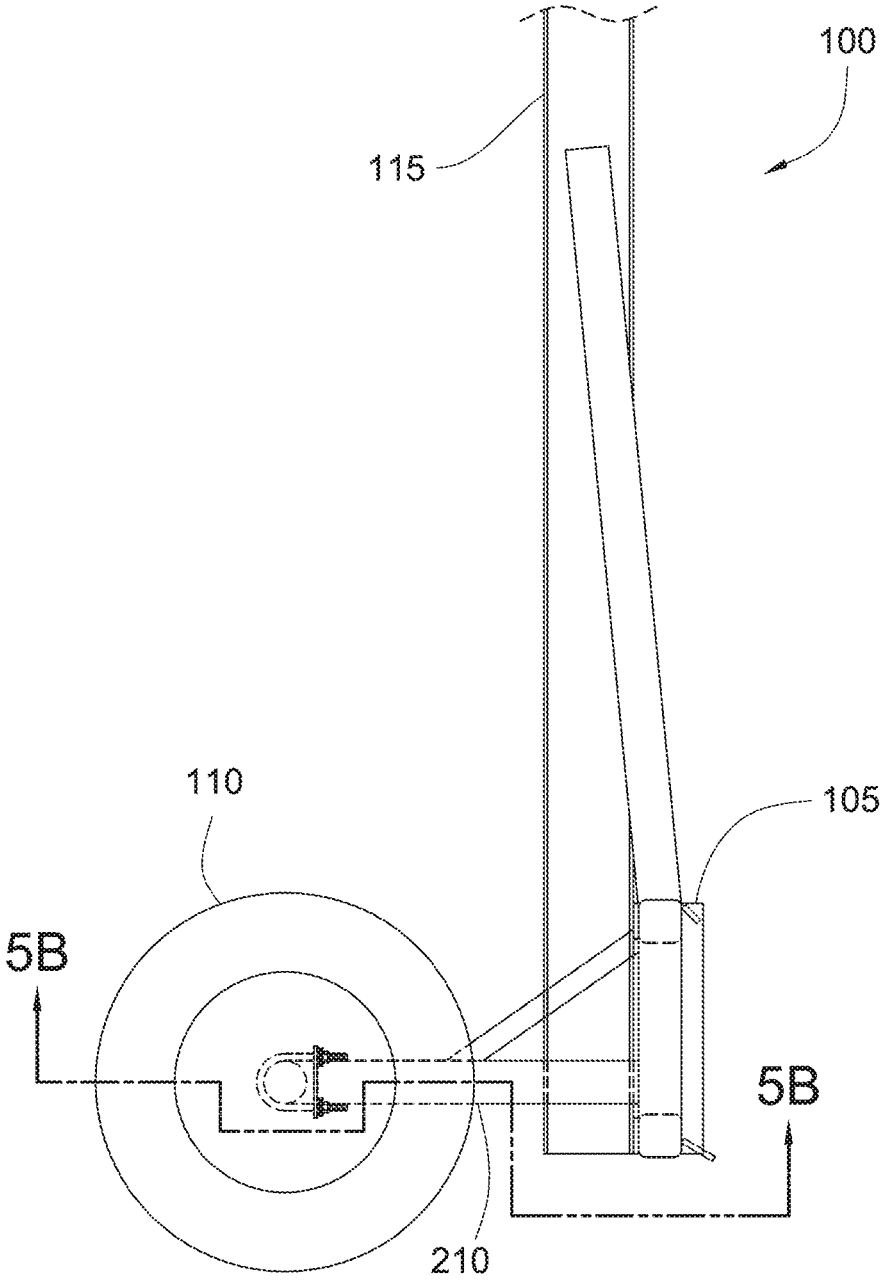
FIG. 2 depicts an exploded side view of a lift attachment apparatus in accordance with an embodiment of the present disclosure.
Figure 3A:
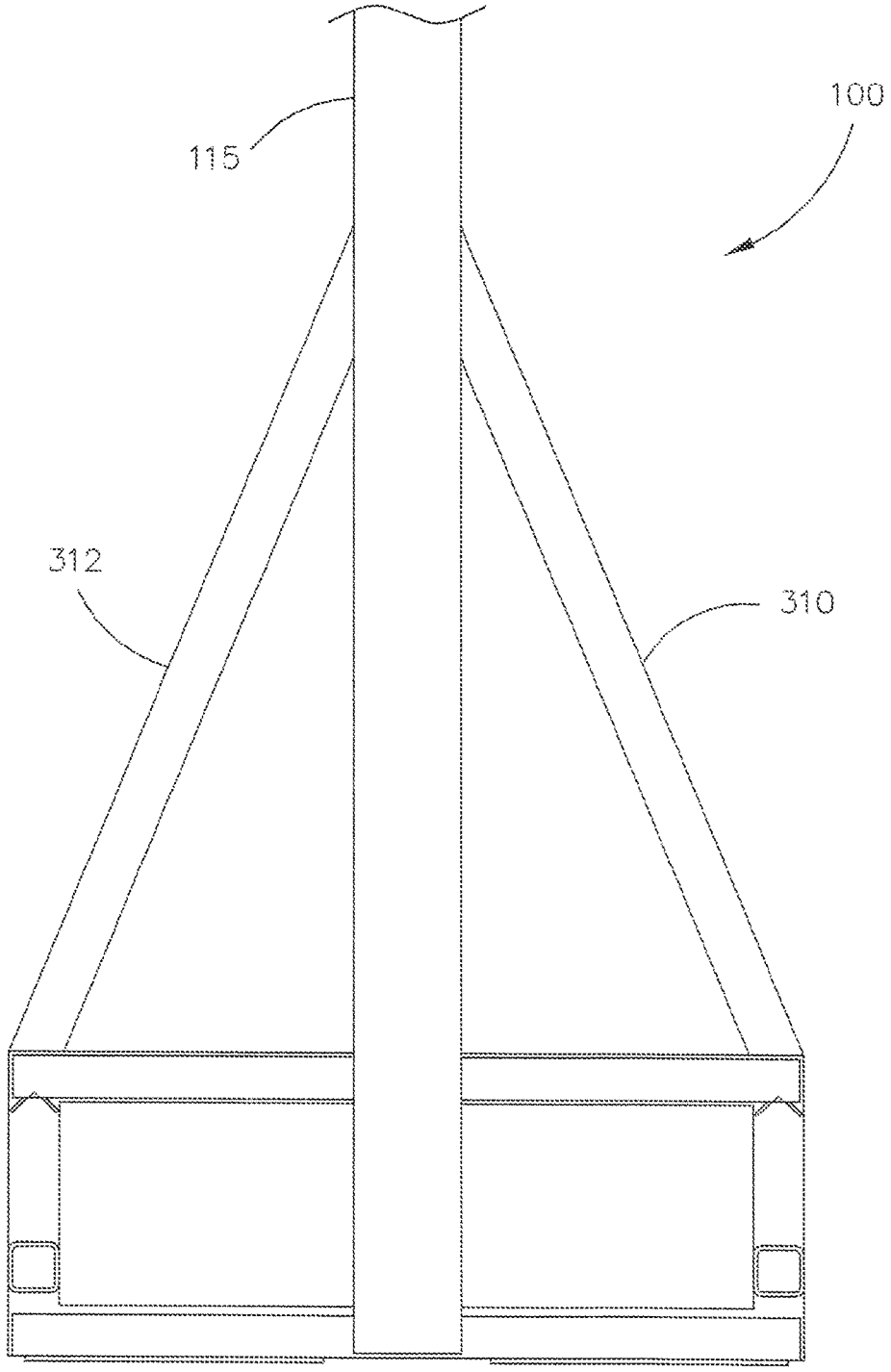
FIGS. 3A-3B depict bottom views of a lift attachment apparatus in accordance with an embodiment of the present disclosure.
Figure 3B:
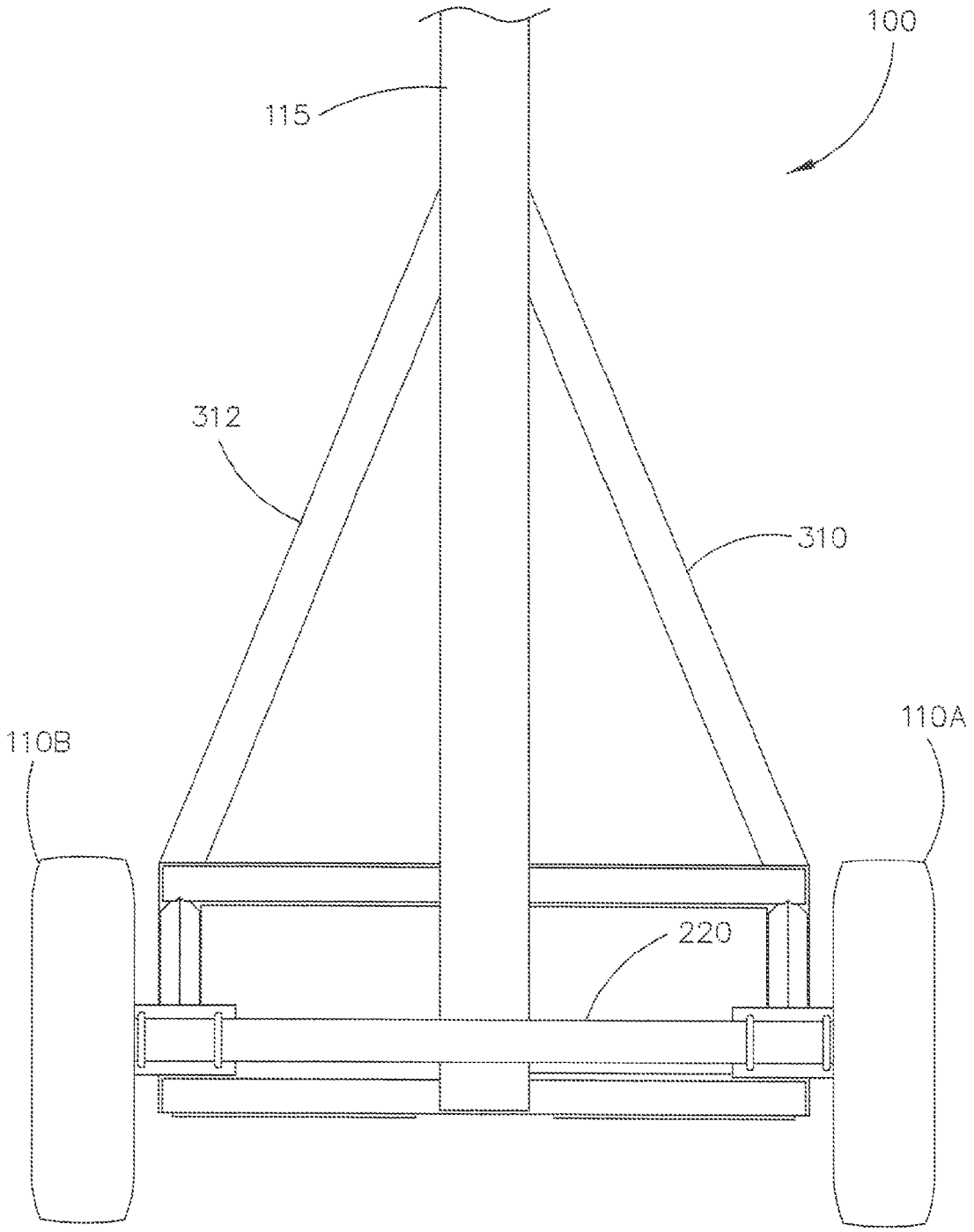

Referring to FIG. 2 and FIG. 3B, an exploded side view of a lift attachment apparatus 100 in accordance with an embodiment of the present disclosure is shown. It is contemplated that pair of wheels may be coupled to the frame via an axle 220. Frame may also include a coupler 210. Coupler 210 may refer to at least one arm that connects pair of wheels 110, via the axle 220, to the attachment device 105. In an embodiment of the disclosure, coupler 210 may be generally perpendicular to the attachment device 105. It is contemplated that coupler 210 may include a suspension device, solid cover (e.g. formed as a box), oriented at angles, and the like according to various embodiments of the present disclosure.

Figure 4:
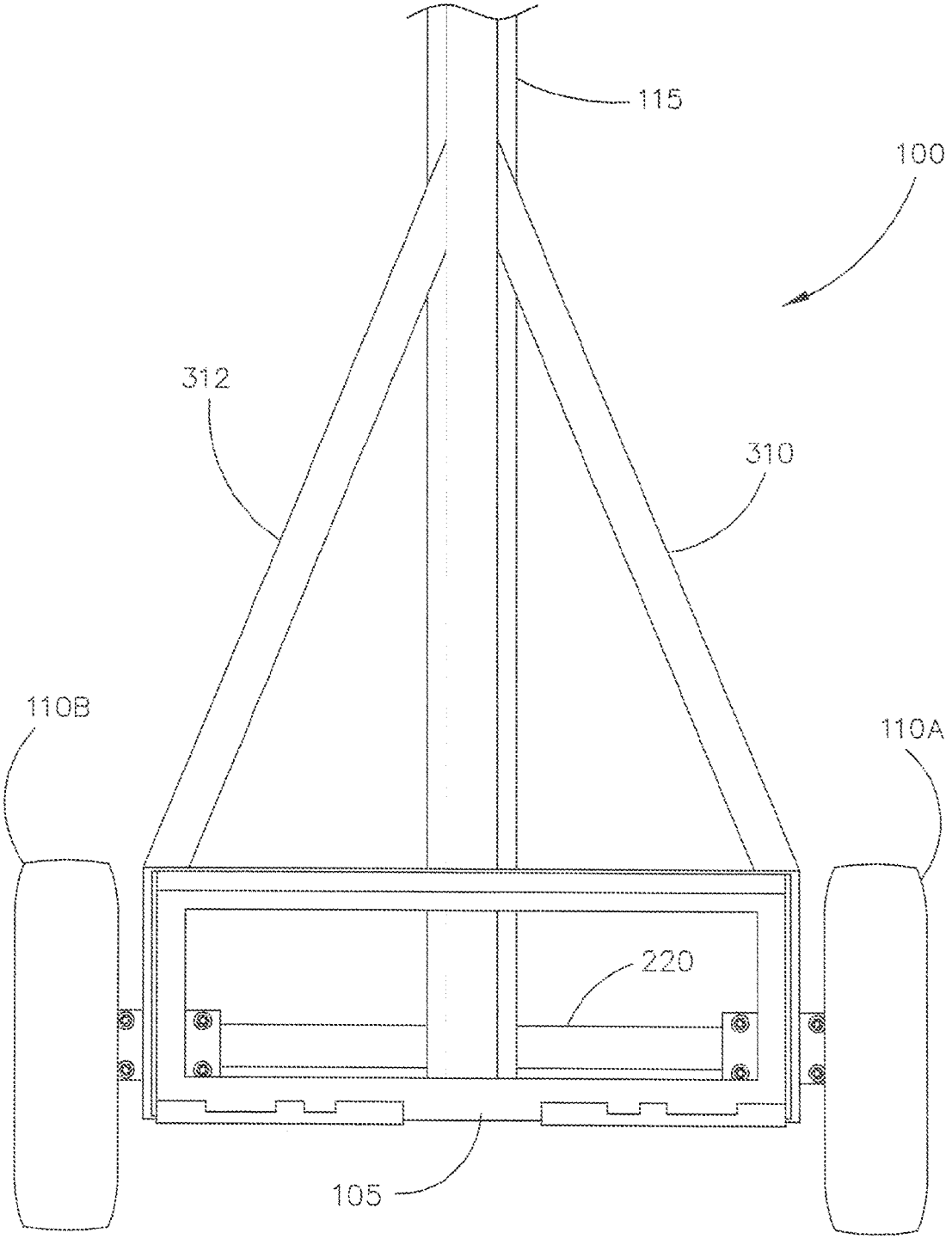
FIG. 4 depicts a top view of a lift attachment apparatus in accordance with an embodiment of the present disclosure.
Figure 5A:
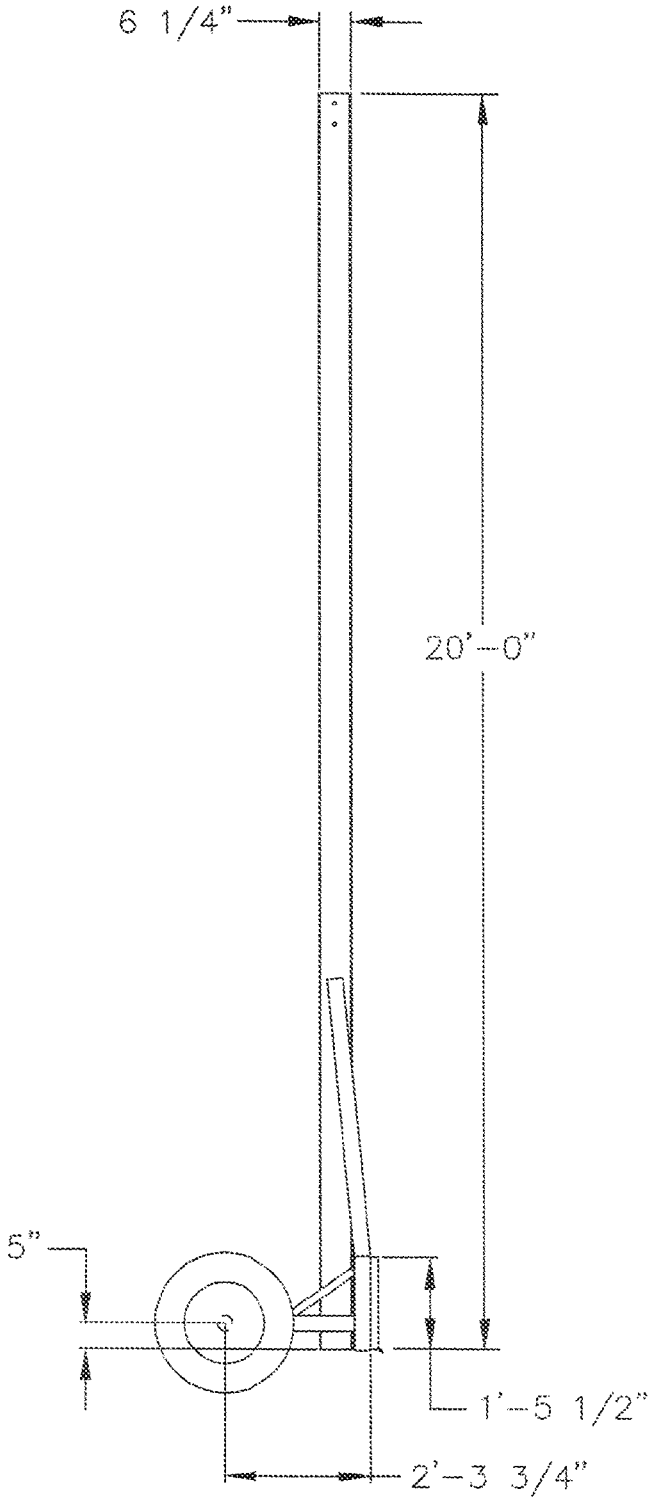
FIGS. 5A-5B depict exemplary dimensions of a lift attachment apparatus 100 in accordance with an embodiment of the present disclosure.
Figure 5B:
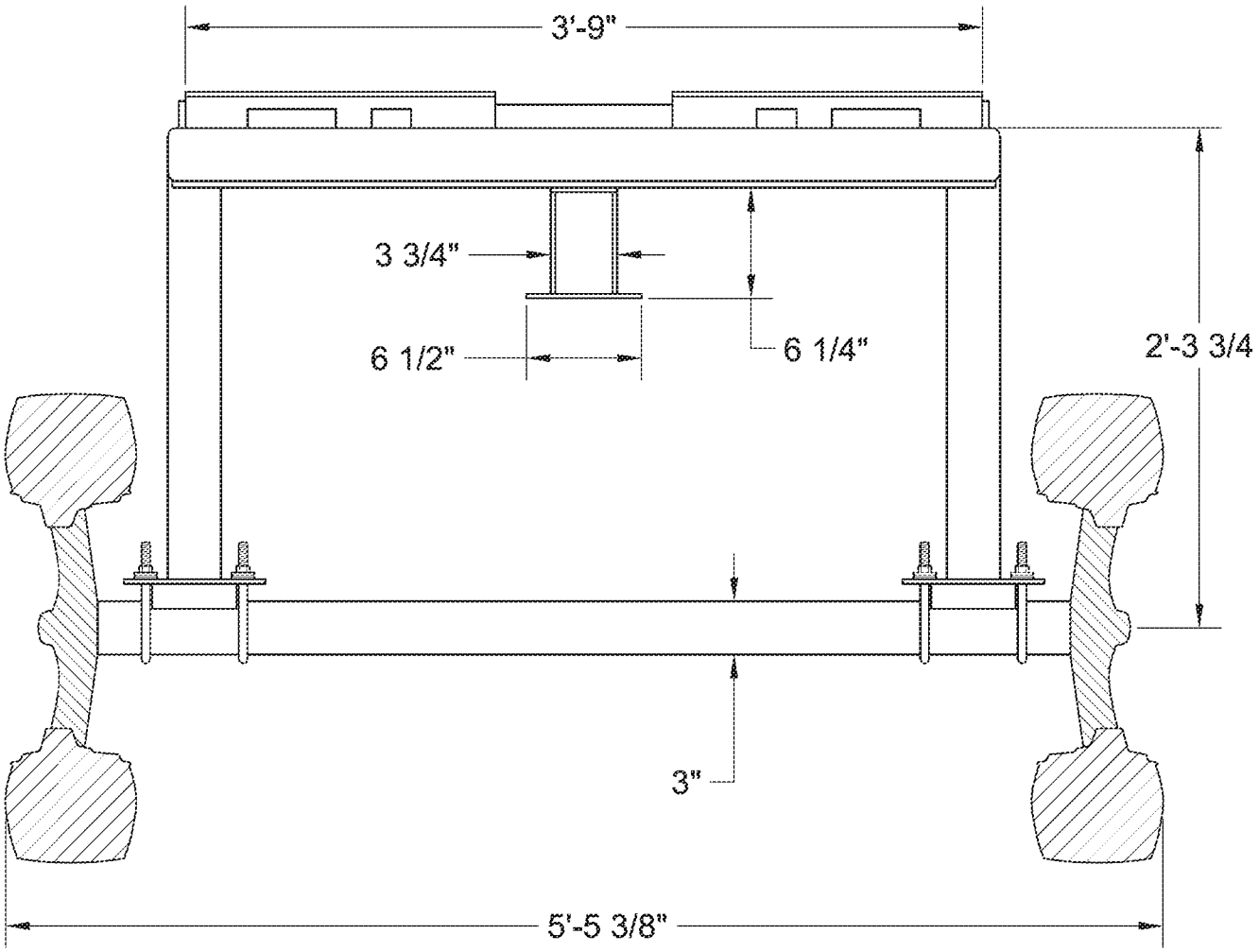

Referring to FIGS. 3A-3B, bottom views of a lift attachment apparatus in accordance with an embodiment of the present disclosure are shown. As shown, boom 115 may be implemented as a rod or pole. It is contemplated that frame of apparatus may include one or more supports 310, 312 to increase strength and lifting capacity of boom 115. As shown in FIG. 3B, pair of wheels 110A, 100B may be coupled to the frame via an axle. It is contemplated that a first wheel 110A of the pair of wheels may be located on a first side of the frame and a second wheel 110B of the pair of wheels may be located on a second side of the frame, the first wheel configured to be maintained parallel to the second wheel. In an embodiment, each wheel 110A, 110B may include a tire. Referring to FIG. 4, a top view of a lift attachment apparatus 100 in accordance with an embodiment of the present disclosure is shown. FIGS. 5A-5B depict exemplary dimensions of a lift attachment apparatus 100 in accordance with an embodiment of the present disclosure. While the dimensions shown in FIGS. 5A-5B may be employed, it is contemplated that the dimensions may be adjusted without departing from the scope and intent of the present disclosure.

Figure 6:
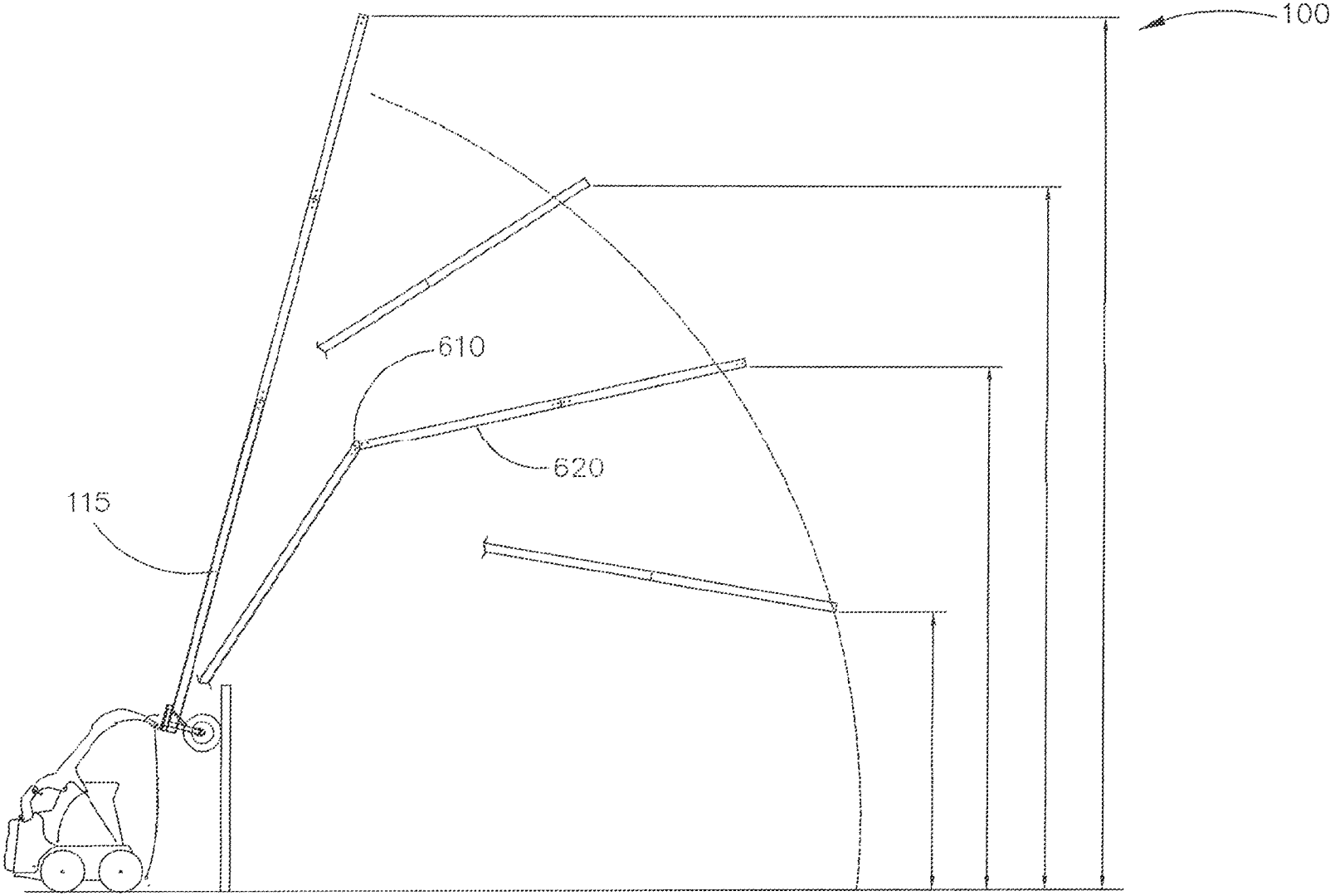
FIG. 6 depicts a lift attachment apparatus which further includes an additional extension rod in accordance with an embodiment of the present disclosure.

Referring to FIG. 6, a lift attachment apparatus 100 which further includes an additional extension rod in accordance with an embodiment of the present disclosure is shown. It is contemplated that boom 115 may further include a connector 610 coupled to an end of the boom. Connector 610 may connect boom 115 with an extension rod 620 to increase the height capacity and range of the lift apparatus 100 to exemplary heights. Connector 610 may be a straight connector, a 90 degree connector, or a 45 degree connector. Additionally, connector 610 may be an adjustable connector and also may range from 0 to 90 degrees. As shown in FIG. 6, lift attachment apparatus 100 may be supported against a vertical wall in order to increase the vertical range of the lift attachment apparatus 100. It is further contemplated that lift attachment apparatus 100 may be supported against a generally horizontal surface on a different horizontal elevation than the loader 130 to increase vertical range and horizontal range. It is further contemplated that boom 115 may further include a towing device configured to be coupled with an end of the boom 115 as shown in FIG. 1A. The towing device may include a receptacle to connect with a vehicle. For example, towing device may include a receptacle to connect with a ball hitch of a vehicle.

The lift attachment apparatus 100 as described and shown in FIGS. 1-6 provide a number of advantages. It is common that contractors may have access to a loader due to the reduced cost of a loader as compared to lifts and cranes. Additionally, through use of various attachments, loaders may be more likely to be owned due to their multiple functions, usability, and operability without specialized skill. However, previous implementations of booms with loaders are limited due to their low lift capacity, reach or mobility.

Lift attachment apparatus 100, by use of the pair of wheels 110, operating between the loader 130 and the load at the end of the boom 115, may operate as a lever. This configuration and capability to operate as a lever may dramatically improve the lift capacity of the boom 115 as compared to previous implementations. For example, the use of the pair of wheels 110 as the fulcrum, may allow an amplification of the input force provided by a loader 130 when applied to the attachment device 105 of the lift attachment apparatus 100 in order to provide a greater output force. It is contemplated that mechanical advantage of the lift attachment apparatus 100 may be greater when the pair of wheels 110 at the point to where the pair of wheels 110 come into contact with a surface is located between the attachment device 105 that is coupled to a tilting plane of a loader 130 and the load which is located at the end of the boom 115, as shown in FIG. 1B. Additionally, it is contemplated that a center point of the pair of wheels 110, (e.g. the point at which the wheels may contact the axle), may also be forward of the attachment device 105 whereby mechanical advantage of the lift attachment apparatus 100 may be greater. Use of the lift attachment apparatus 100 may allow transport of material while the loader is located more than thirty feet away or greater, which may be particularly valuable in muddy conditions or other conditions in which a surface is not solid.

Referring again to FIG. 2, attachment device 105, coupler, 210, and pair of wheels 110 may be in proximity to each other. It is contemplated, in an alternative embodiment, that pair of wheels 110 and coupler 210 may be shifted toward the end of the boom 115 while the attachment device 105 remains in the present position as shown in FIG. 2. For example, it is contemplated that such design according to an alternative embodiment may be desirable for larger loads.

Figure 7:
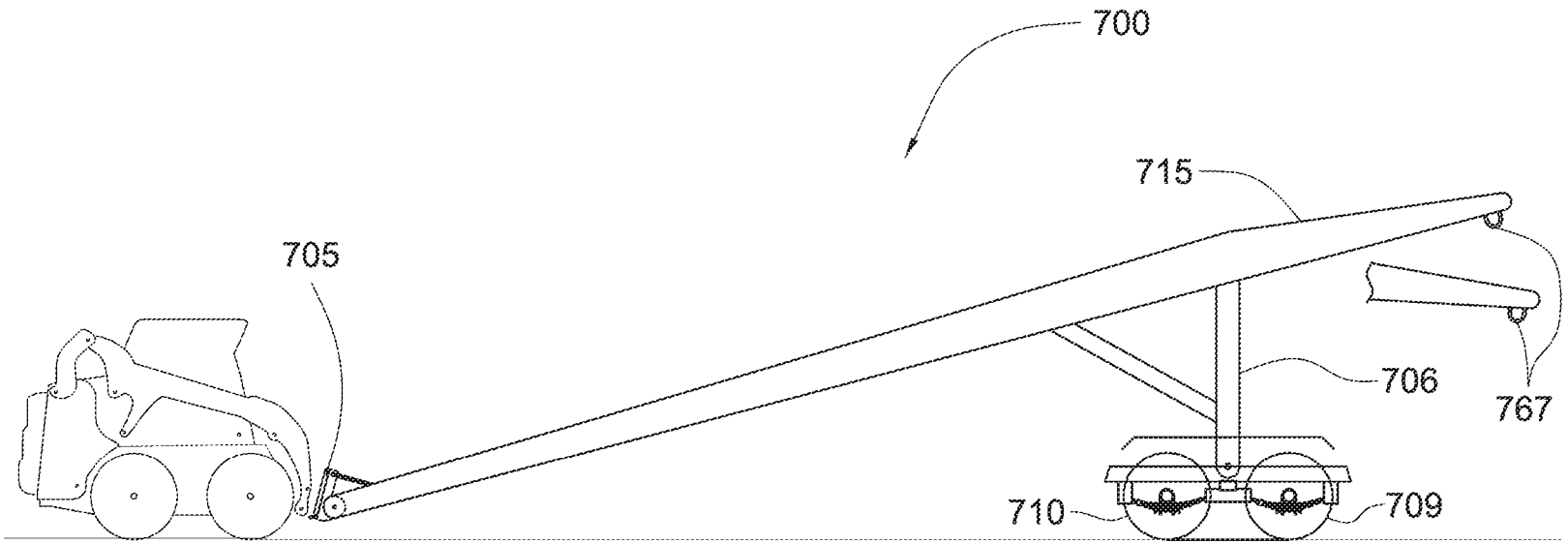
FIG. 7 depicts a lift attachment apparatus according to an alternative embodiment of the present disclosure.

Referring to FIG. 7, a lift attachment apparatus 700 according to an alternative embodiment of the present disclosure is shown. Lift attachment apparatus 700 may include an attachment device 705. Attachment device 705 may be configured to attach to a tilting plane of a loader. It is contemplated that attachment device 705 may be a quick attachment device in use with various types of attachments to connect with loaders. Lift attachment apparatus 700 may include a pair of wheels, or may include multiple pairs of wheels. It is contemplated that lift attachment apparatus 700 may be suitable for substantially heavy loads.

Figure 8A:
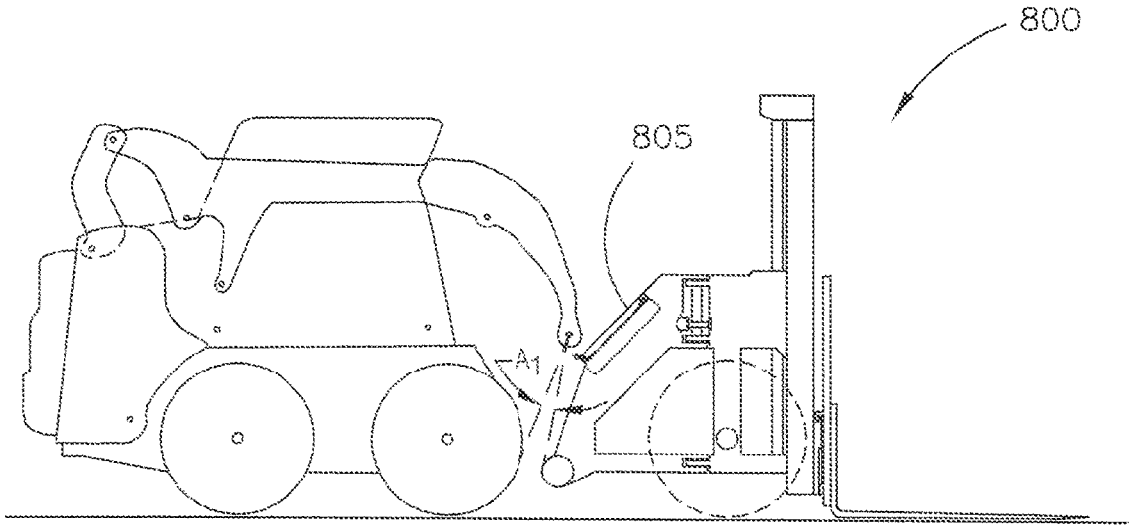
FIGS. 8A-8G depict a lift attachment apparatus according to an additional alternative embodiment of the present disclosure.
Figure 8B:
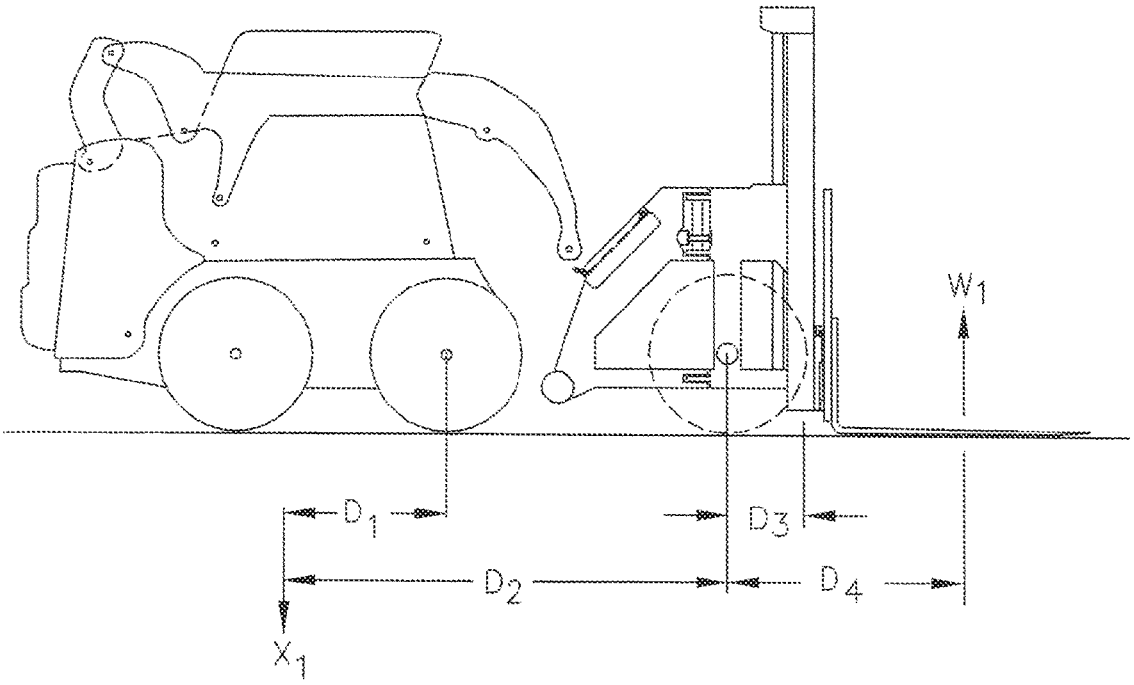
Figure 8C:
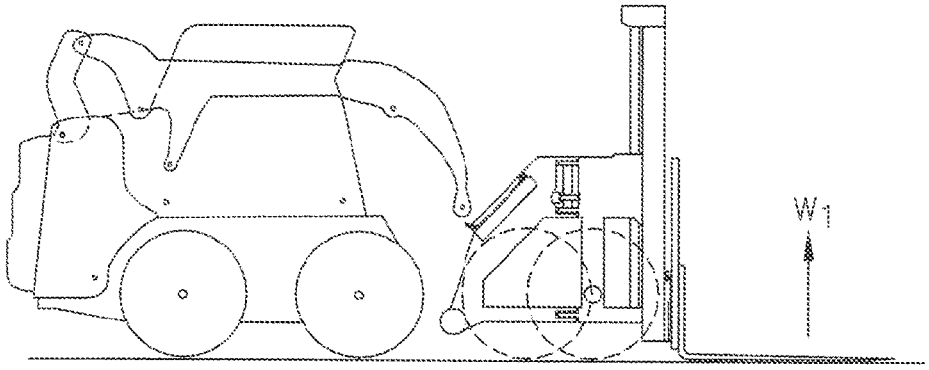
Figure 8D:
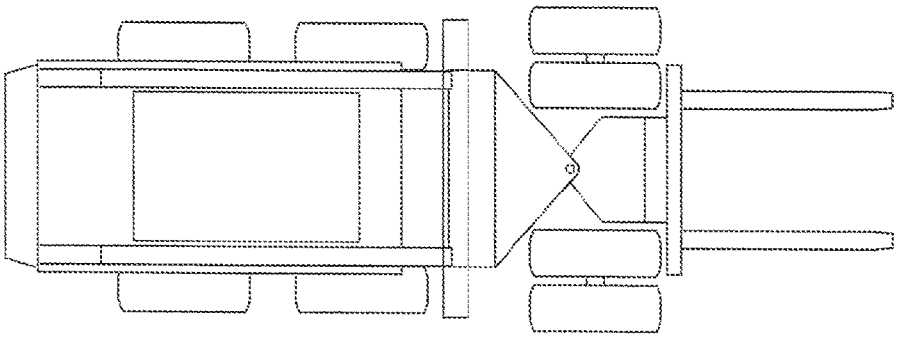
Figure 8E:
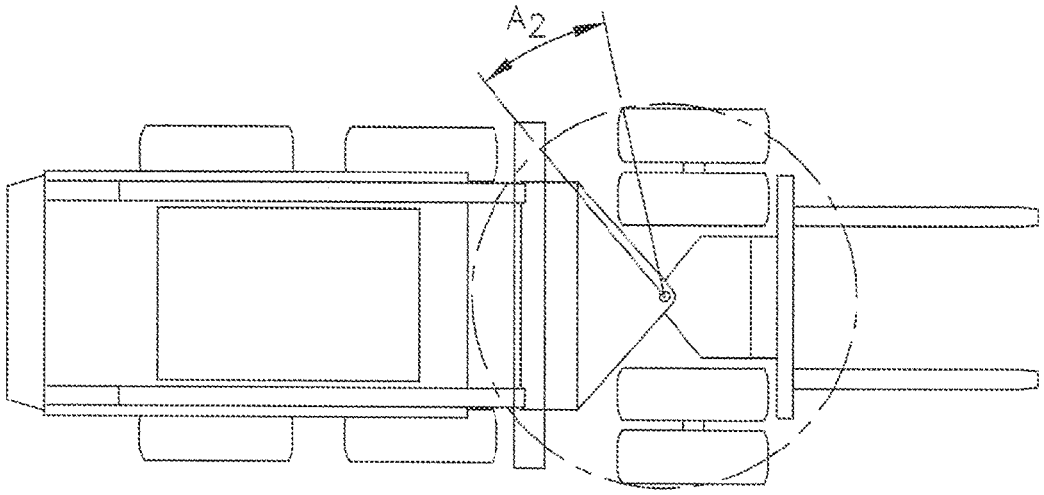
Figure 8F:
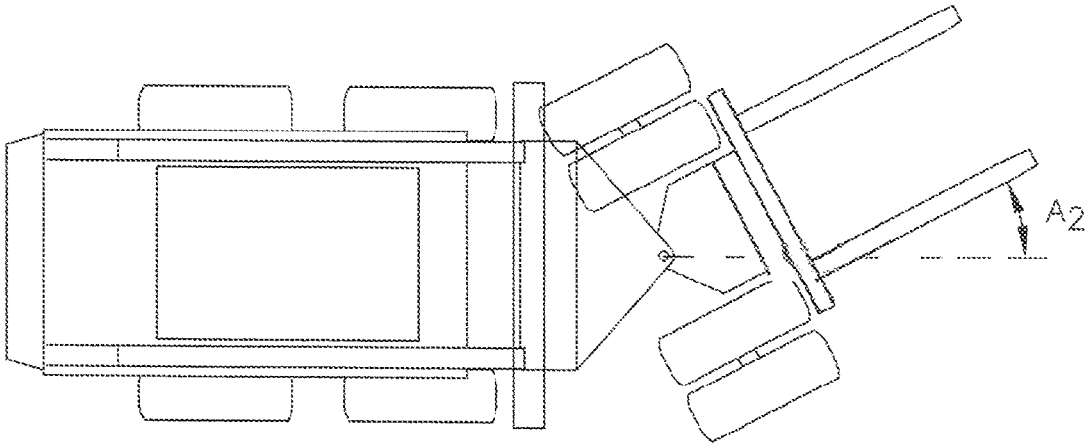
Figure 8G:
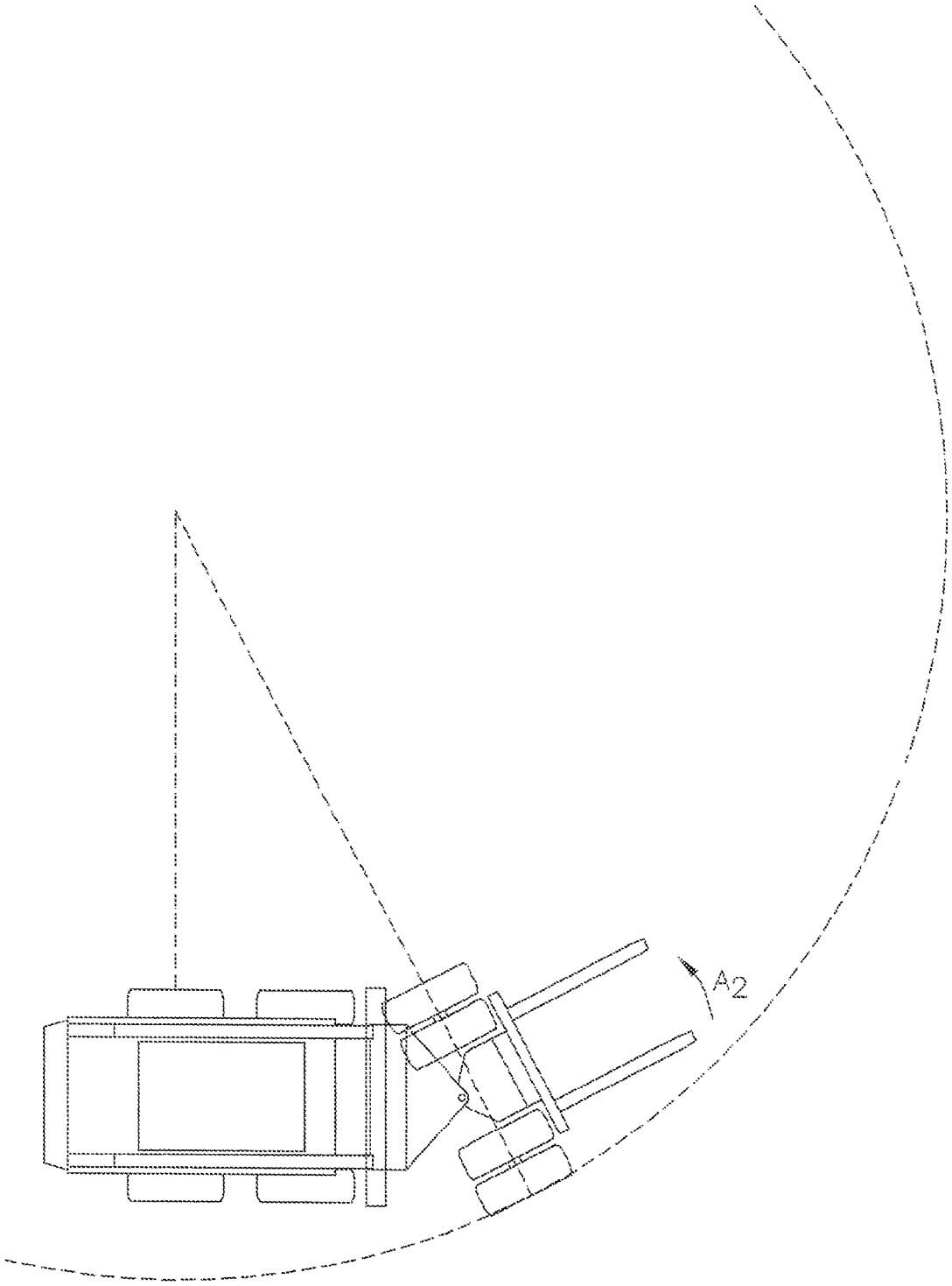

Referring to FIGS. 8A-8G, a lift attachment apparatus 800 according to an additional alternative embodiment of the present disclosure is shown. Lift attachment apparatus 800 may be configured as a forklift attachment for a loader. Lift attachment apparatus 800 may include an attachment device 805. Attachment device 805 may be configured to attach to a tilting plane of a loader. It is contemplated that attachment device 805 may be a quick attachment device in use with various types of attachments to connect with loaders. As shown in FIG. 8C, the dashed line closest to the loader may be exemplary wheel placement when turning while the other dashed line may refer wheel placement when moving in a generally straight direction.

Lift attachment apparatus 800 may include a forklift which may include at least one hydraulic cylinder to control the raising and lowering of the forklift. Additionally, lift attachment apparatus 800 may include a hydraulic cylinder to control steering of the lift attachment apparatus 800. It is contemplated that the lift attachment apparatus 800 may utilize at least one auxiliary hydraulic controller of the loader to control operation of the at least one hydraulic cylinder for the forklift operation and steering. It is contemplated that at least one hydraulic cylinder may be a single acting hydraulic cylinder, a double acting hydraulic cylinder, gears, chains or in combination, and further may be powered electrically. It is contemplated that force applied by at least one forward facing loader arm in a downward motion along with upward lift of a tipping mechanism of the loader may cause force that creates upward leverage with the wheels of the lift attachment apparatus 800. Lift attachment apparatus 800 may increase safe operating capacity far beyond a tipping capacity of a loader using the loader's arms and/or tipping function.

Lift attachment apparatus 800 may or may not include wheels centered on the load which may cause the load to bob back and forth while in motion at an amount determined by the play in the lifting components of the loader. Lift attachment apparatus 800 may include brakes. Brakes and a small battery to power the brakes may be set with a standard variable brake controller and may be activated by the parking brake on the loader with a kit a heavy equipment mechanic could install. With brakes, loader and lift attachment apparatus 800 may operate similar as a truck with a car trailer that has independent brakes. Lift attachment apparatus 800 may or may not employ powered wheels that are operated with loader controls or tapped into the loader's left and right wheel controls. It is contemplated that lift attachment apparatus 800 may include a hitch for transport. Hitch may be a two inch interior width square pipe below the attachment plate being integrated with safety chains. A two inch outside dimension square pipe with a coupler on the end may attach to a trailer ball on a vehicle. Forklift may further include additional forks to carry the weight, such as four forks. It is contemplated that the hydraulic capacity may be at least 7,200 lbs. with a Bobcat 2009 S205 skid-steer loader. The loader may not physically tip forward until the load exceeds 12,000 lbs., but the loader's hydraulic bypass may be activated prior to a load being lifted above its resting place, which may be much safer than a standalone loader with forks. Wheels of the attachment 800 may be located behind moving parts of the attachment and may allow access into limited access spaces.

Figure 8H:
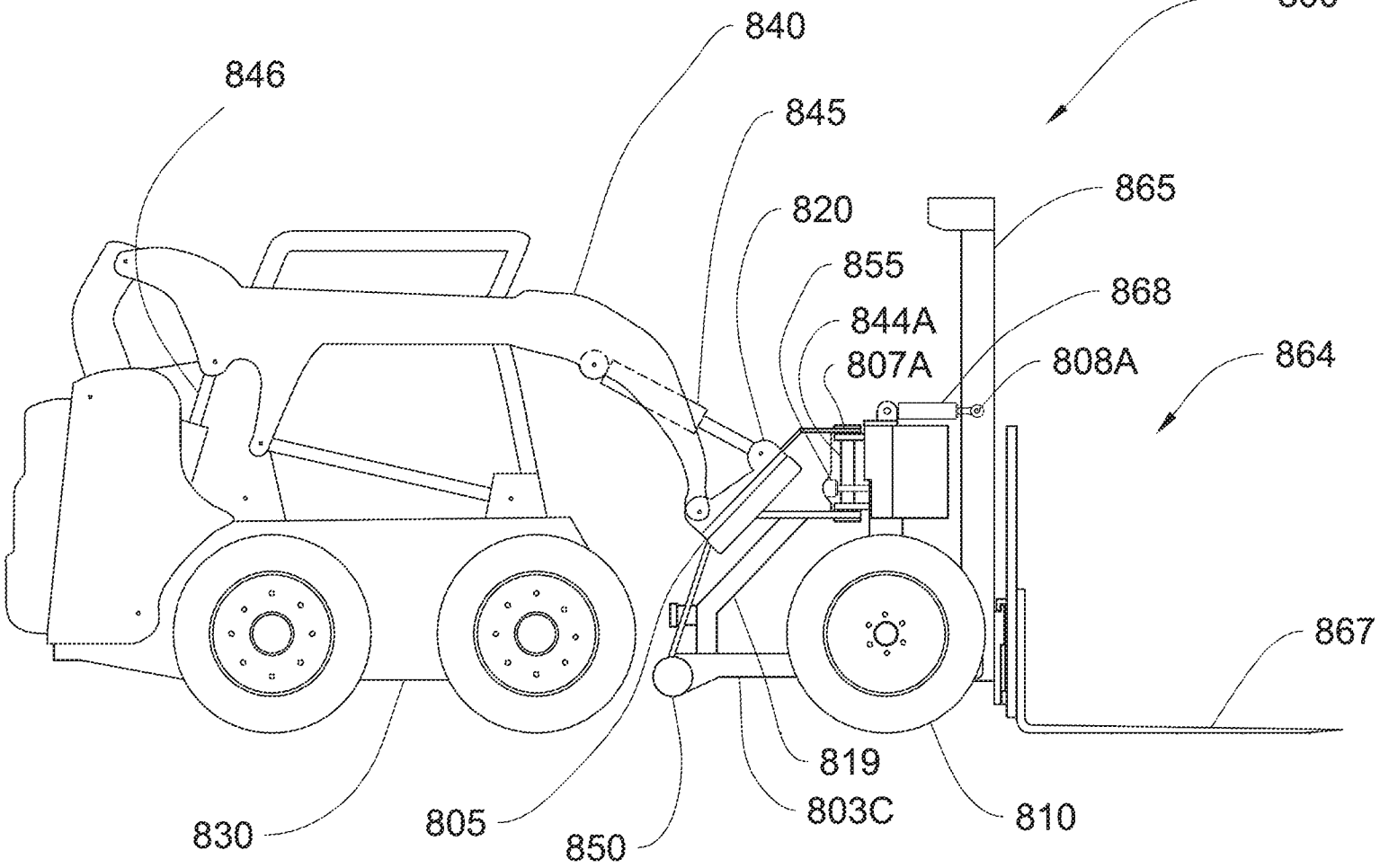
FIG. 8H depicts a side view of a lift attachment apparatus in accordance with an embodiment of the present disclosure.

Referring to FIG. 8H, it is contemplated that lift apparatus 800 may be configured as a forklift attachment for a loader. Lift apparatus 800 may include an attachment device 805. Attachment device 805 may be configured to attach to a tilting plane of a loader 820. It is contemplated that attachment device 805 may be a quick attachment device in use with various types of attachments to connect with loaders.

Figure 8I:
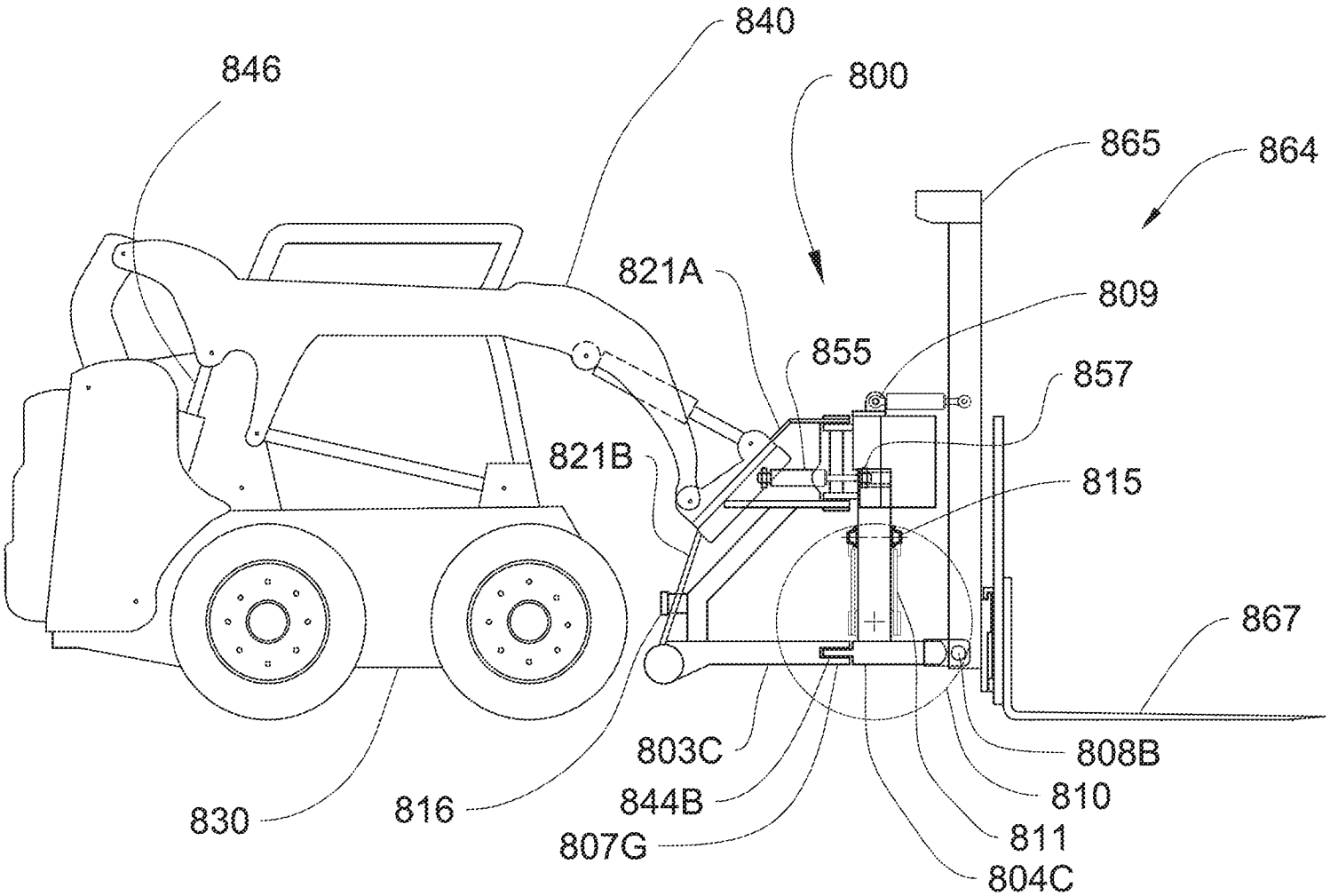
FIGS. 8I-8J depict exploded side views of a lift attachment apparatus in accordance with an embodiment of the present disclosure.
Figure 8J:
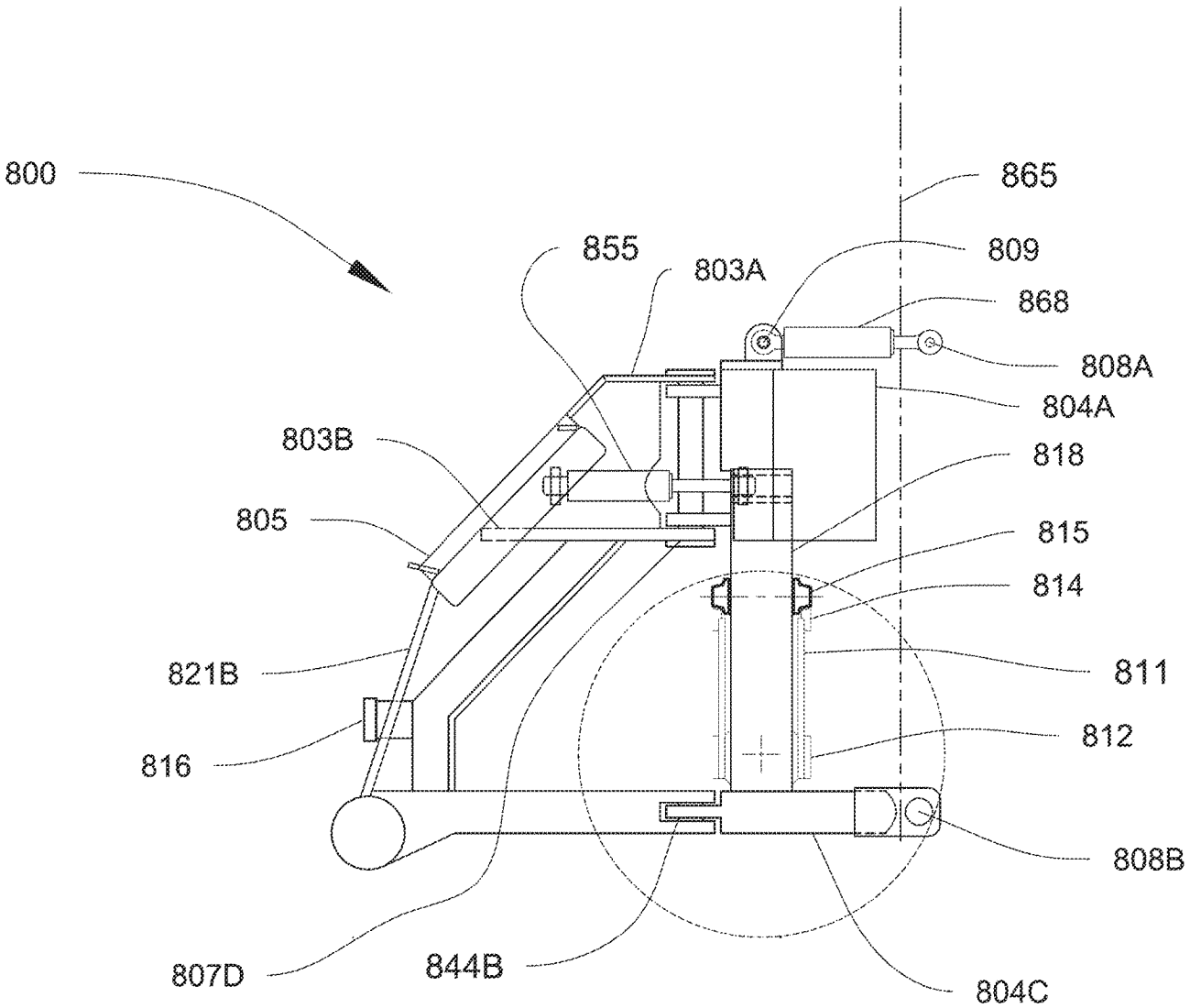
Figure 8K:
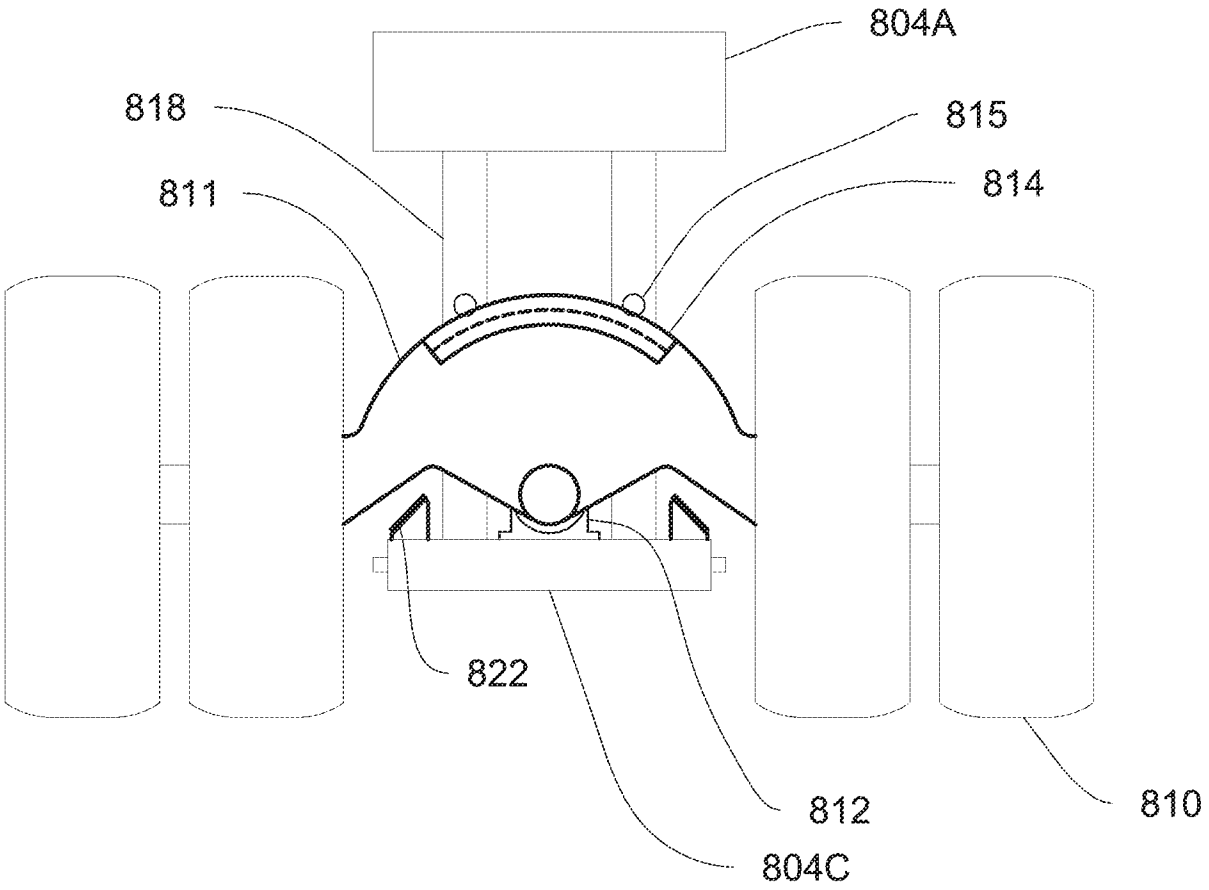
FIGS. 8K-8M depict exploded rear views of a lift attachment apparatus in accordance with an embodiment of the present disclosure.
Figure 8L:
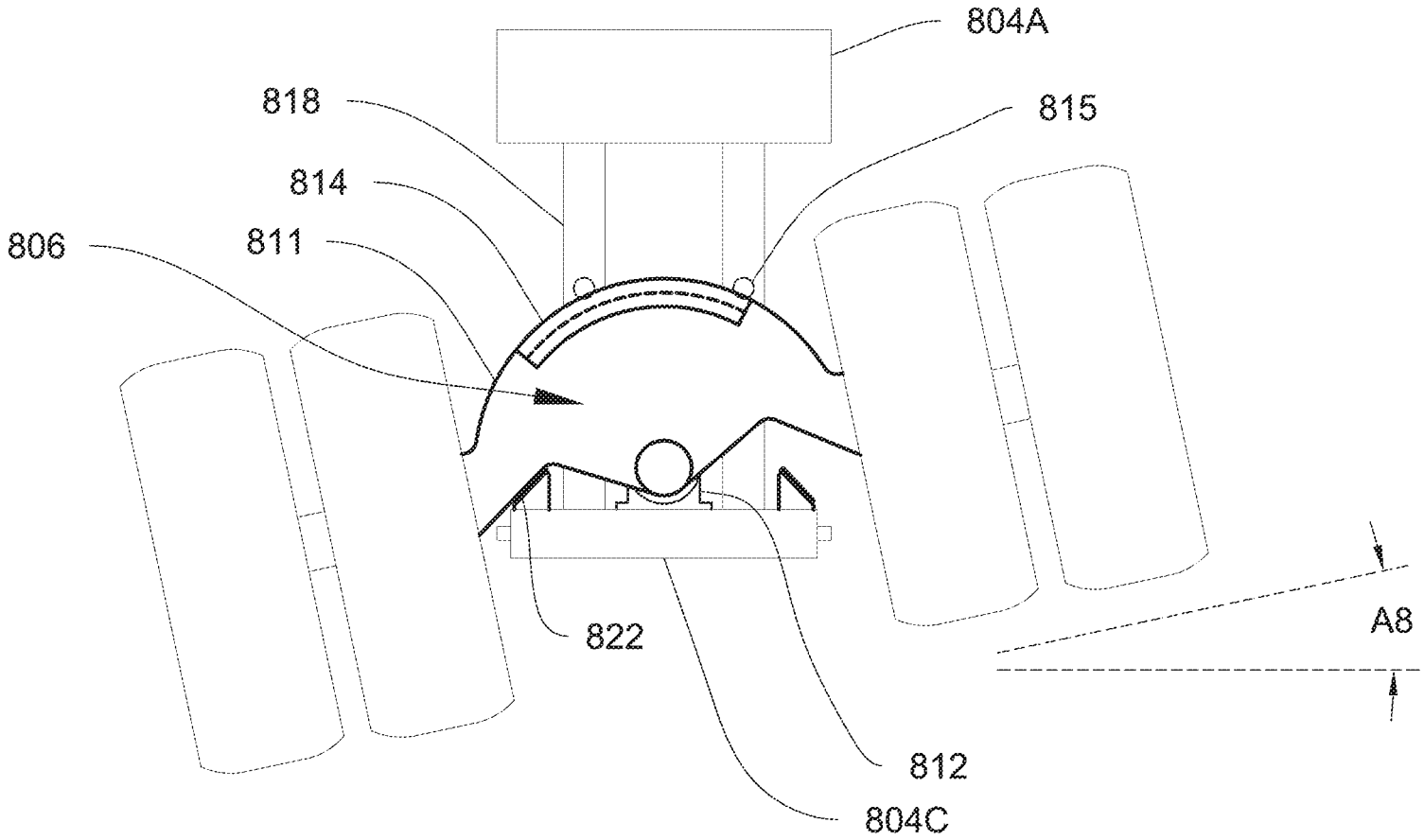
Figure 8M:
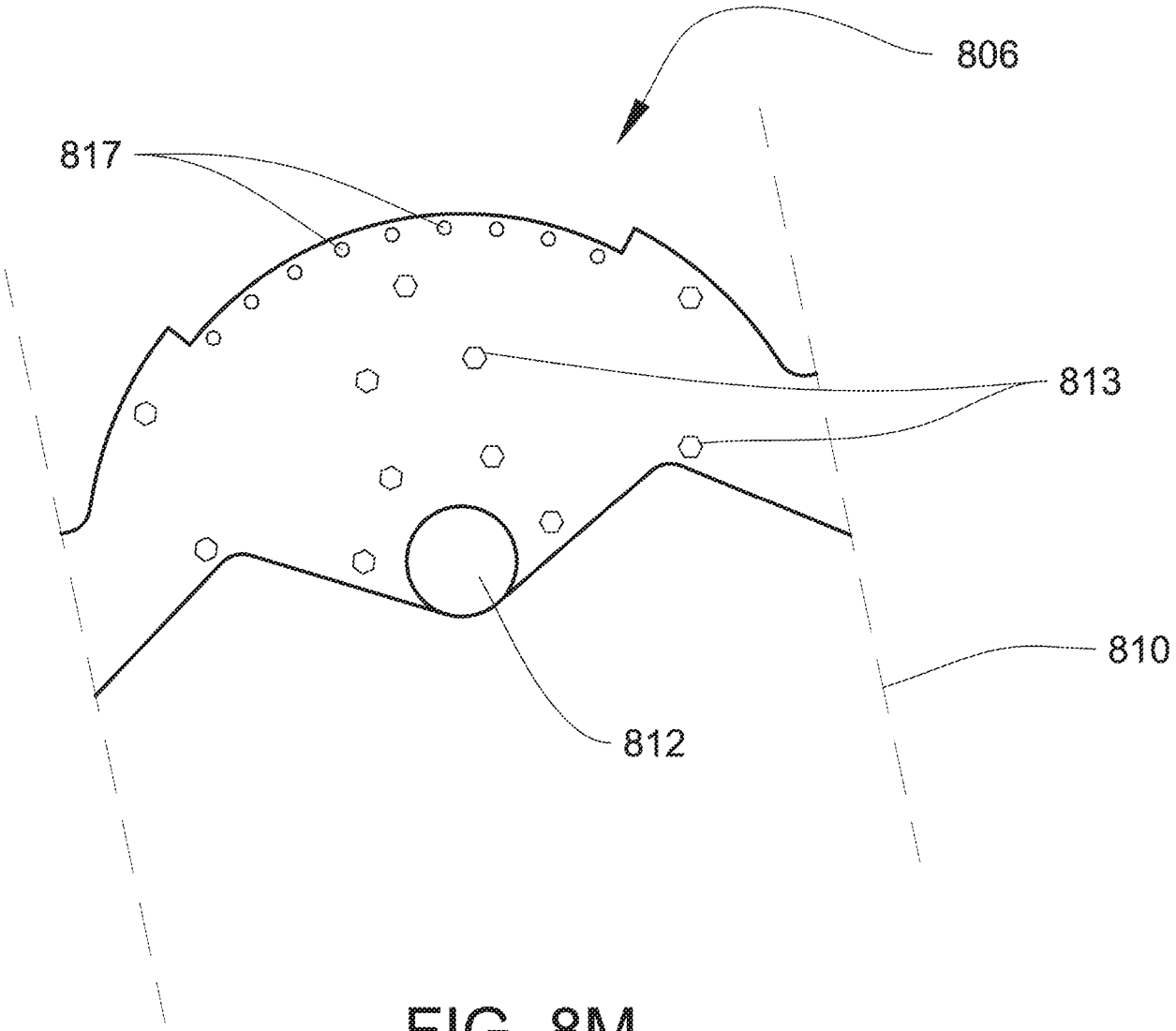
Figure 8N:
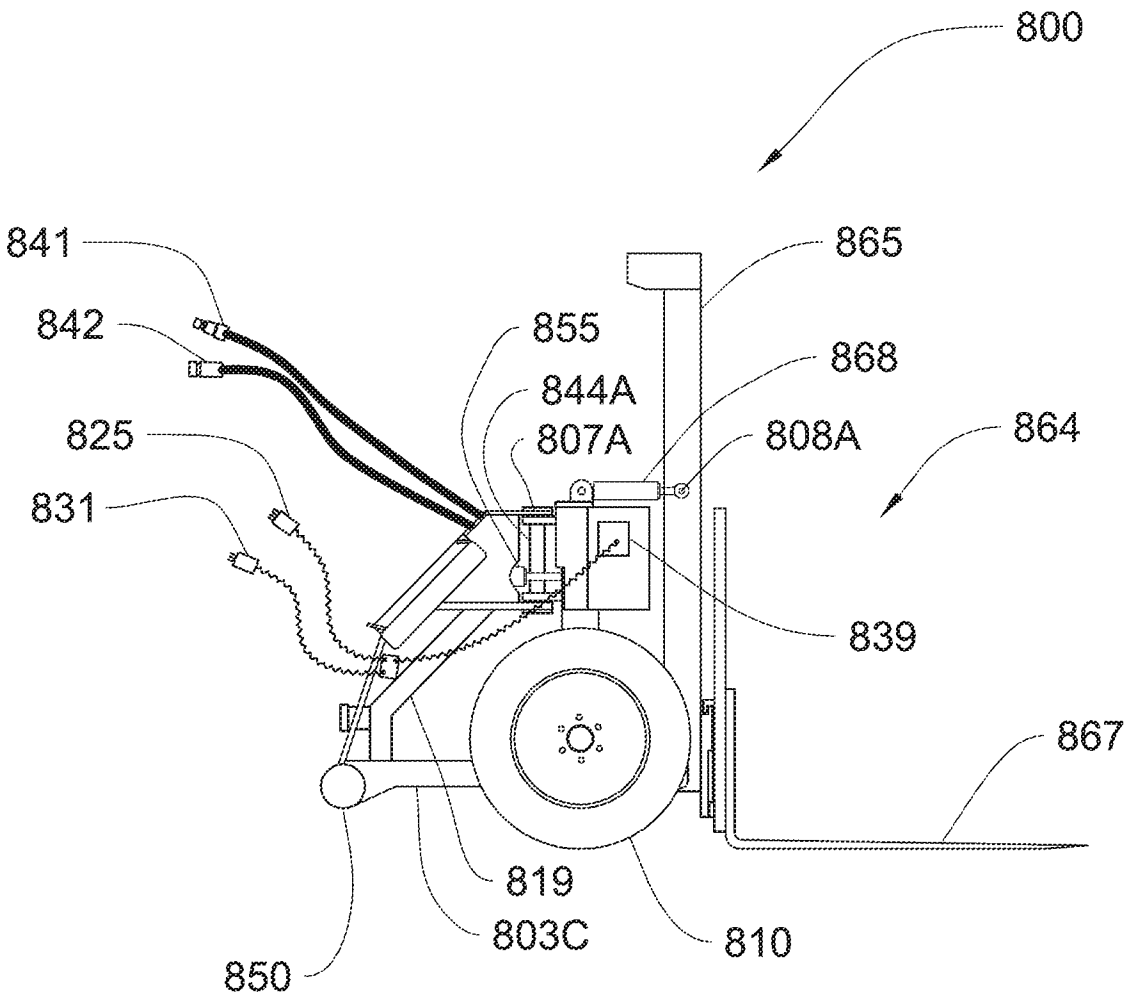
FIG. 8N depicts a side view of a lift attachment apparatus in accordance with an embodiment of the present disclosure.
Figure 8P:
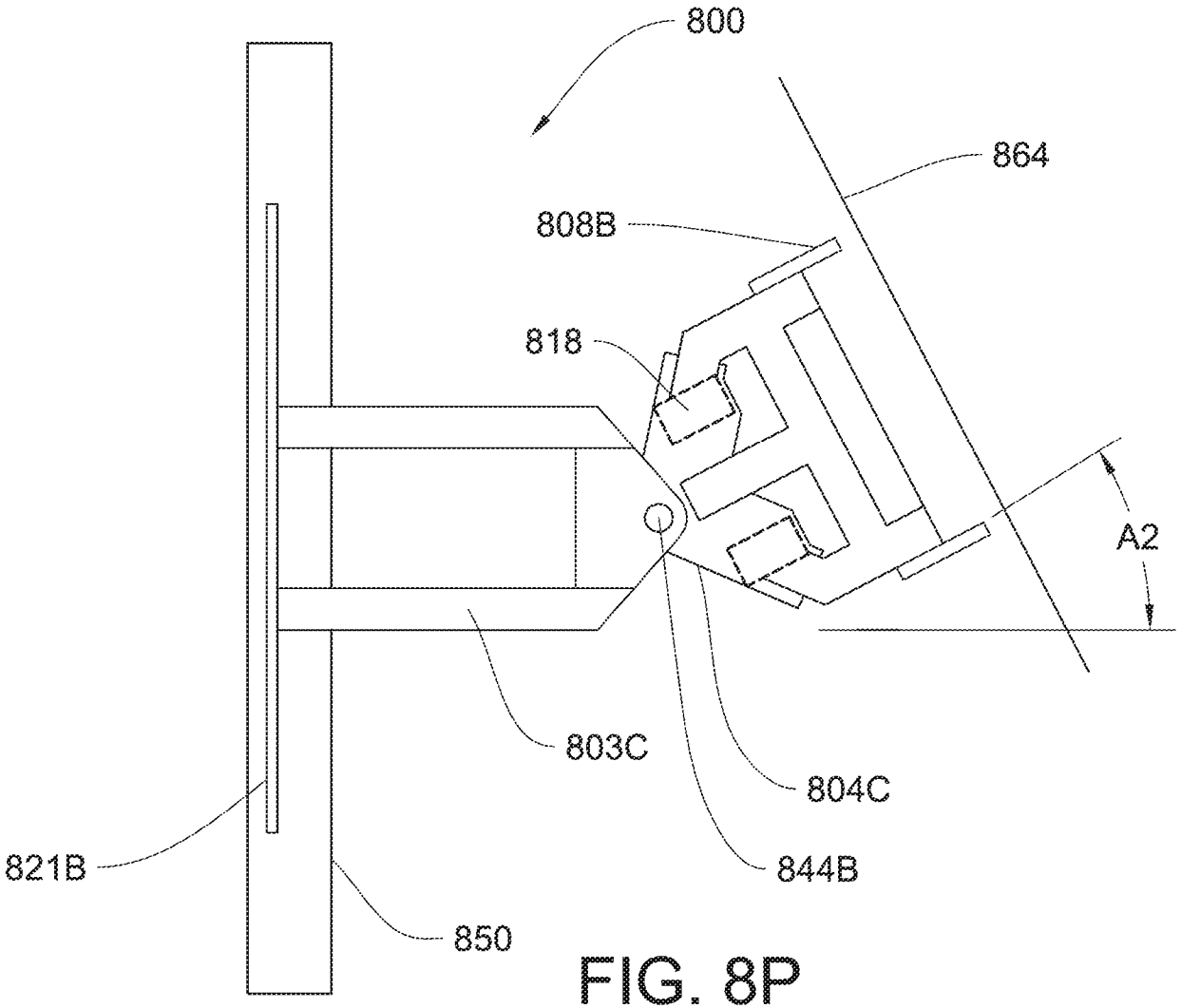
FIGS. 8P-8V depict exploded top views of a lift attachment apparatus in accordance with an embodiment of the present disclosure.
Figure 8Q:
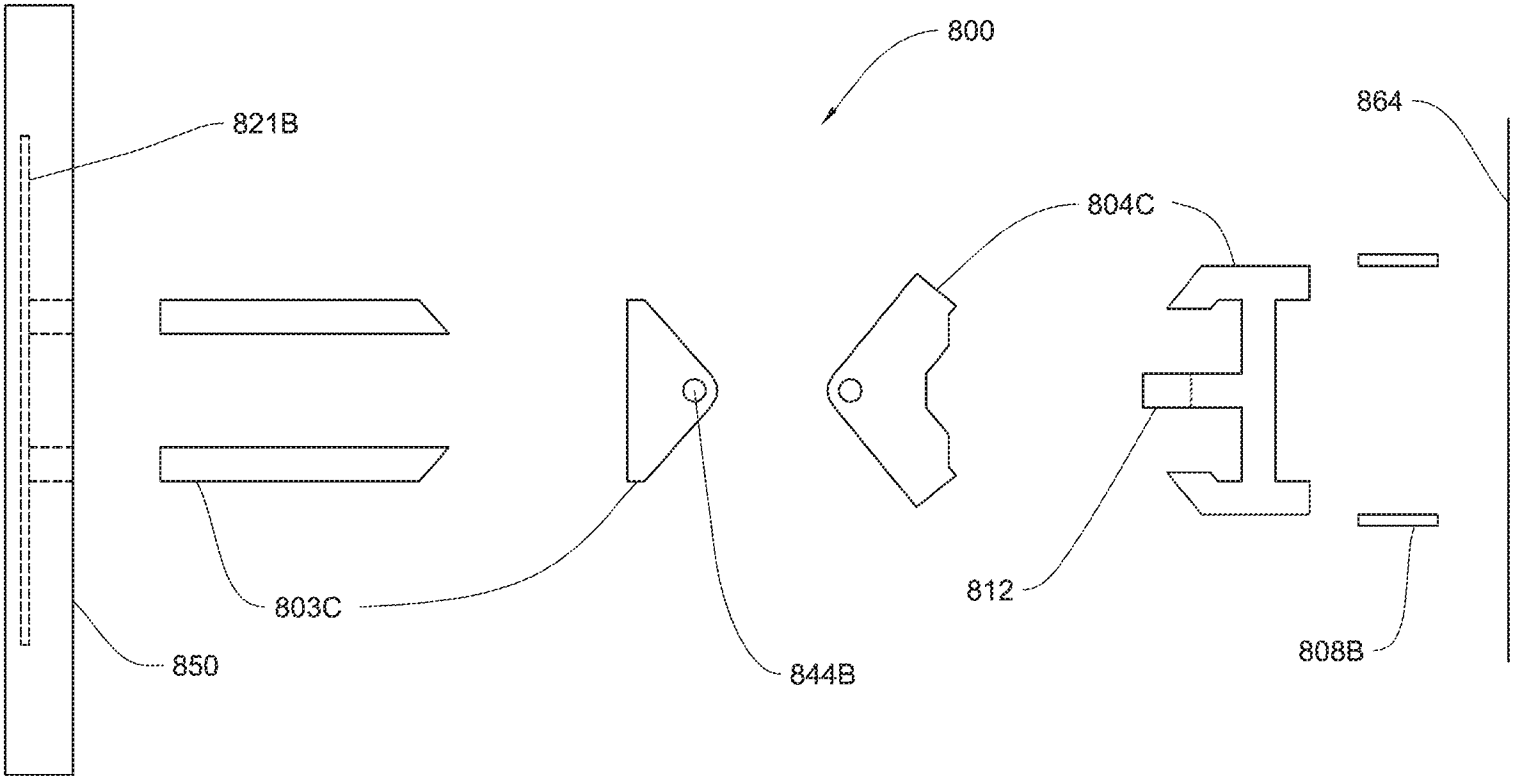
Figure 8R:
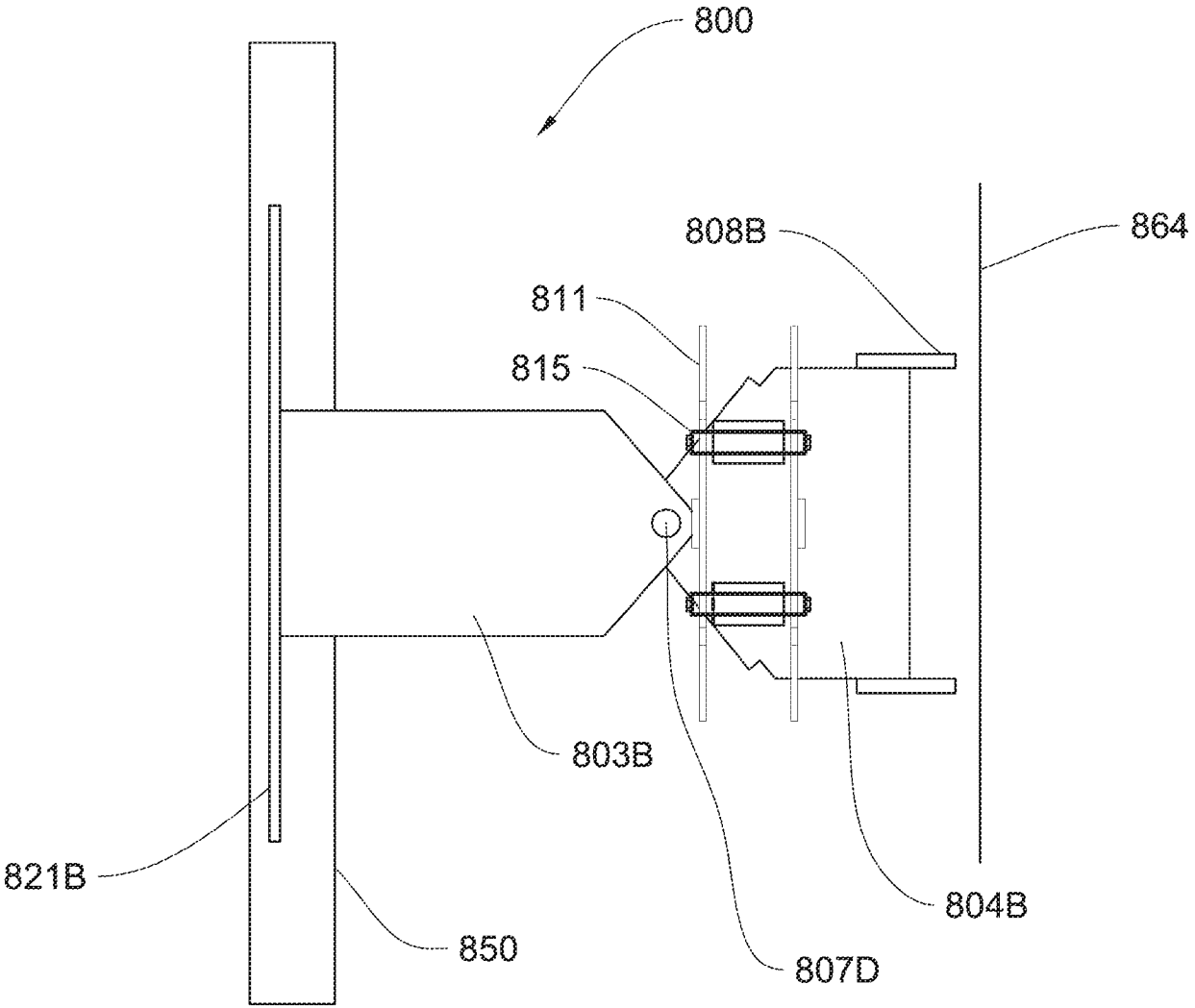
Figure 8S:
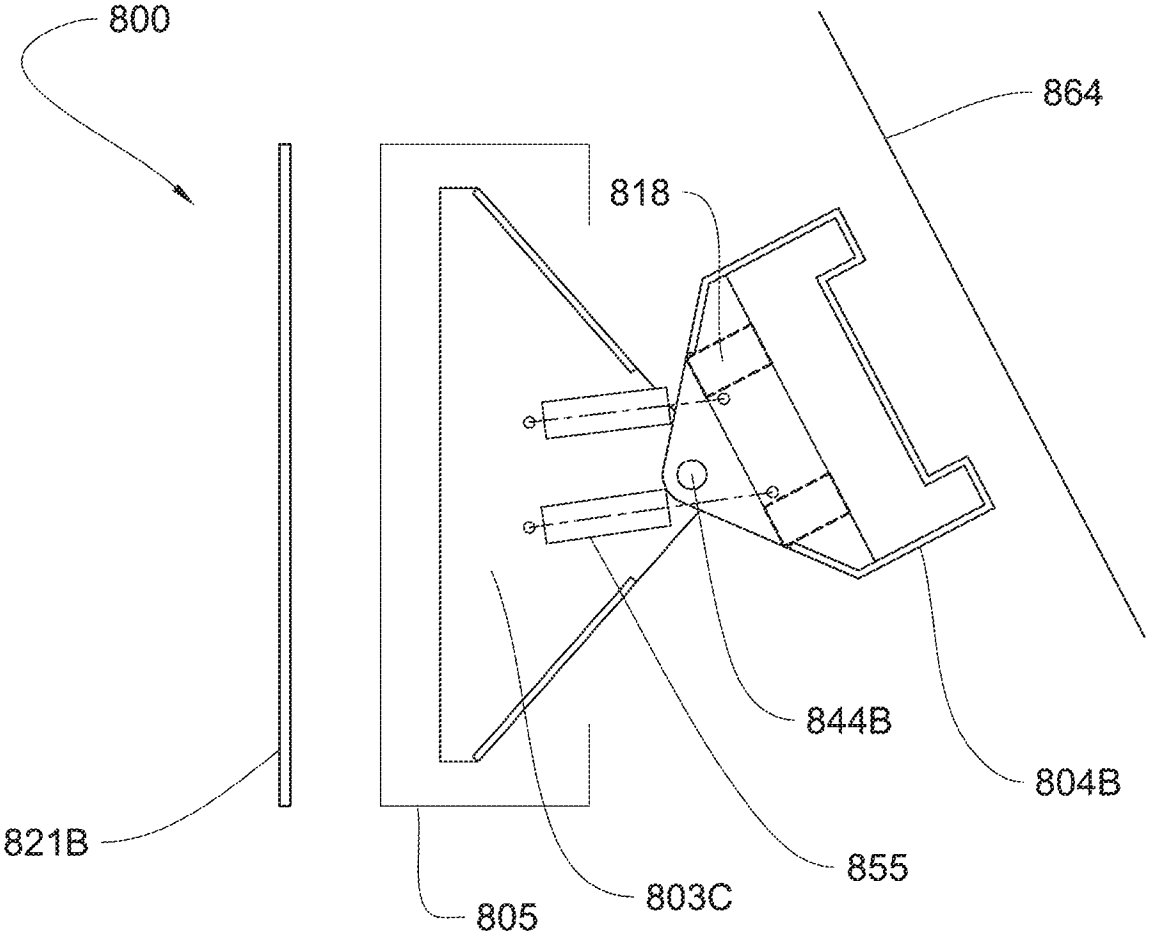
Figure 8T:
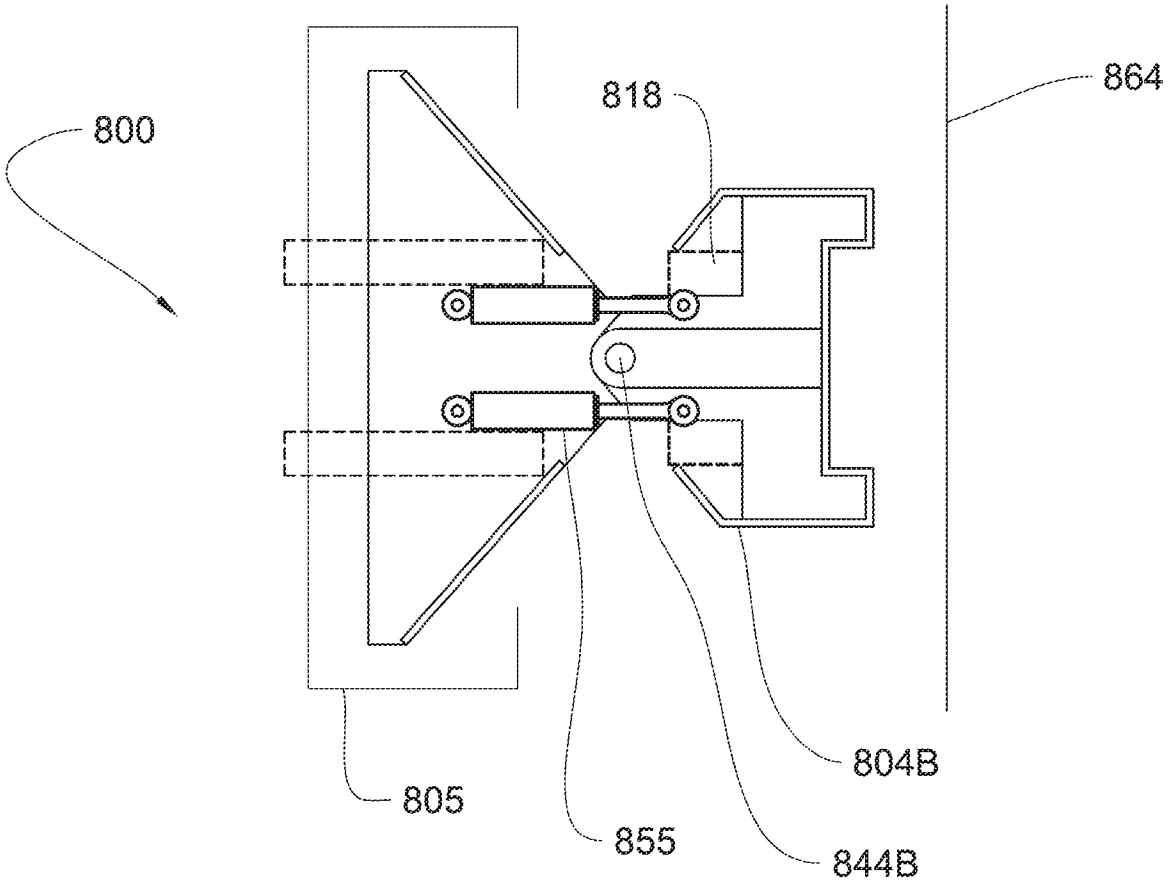
Figure 8U:
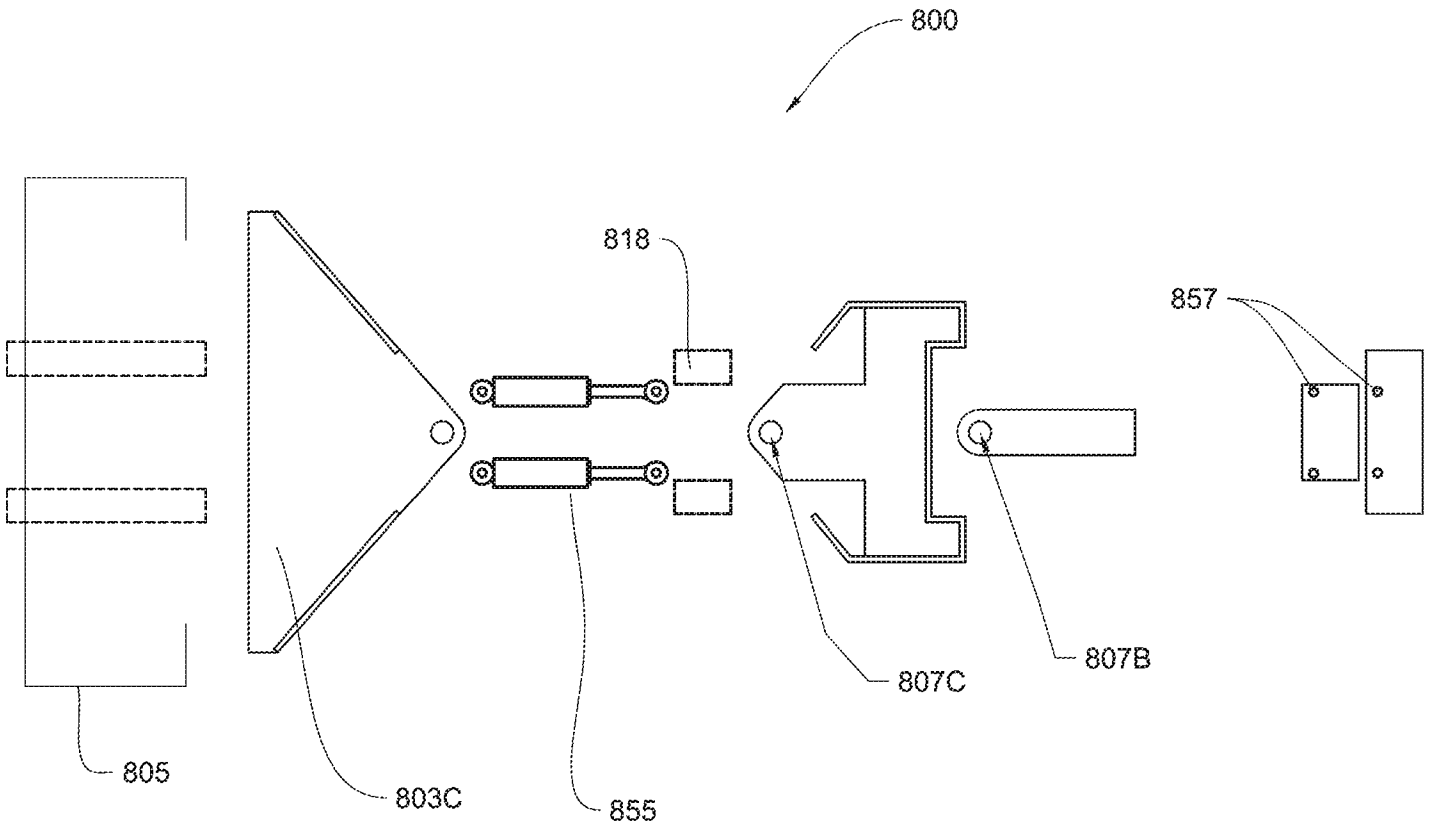
Figure 8V:
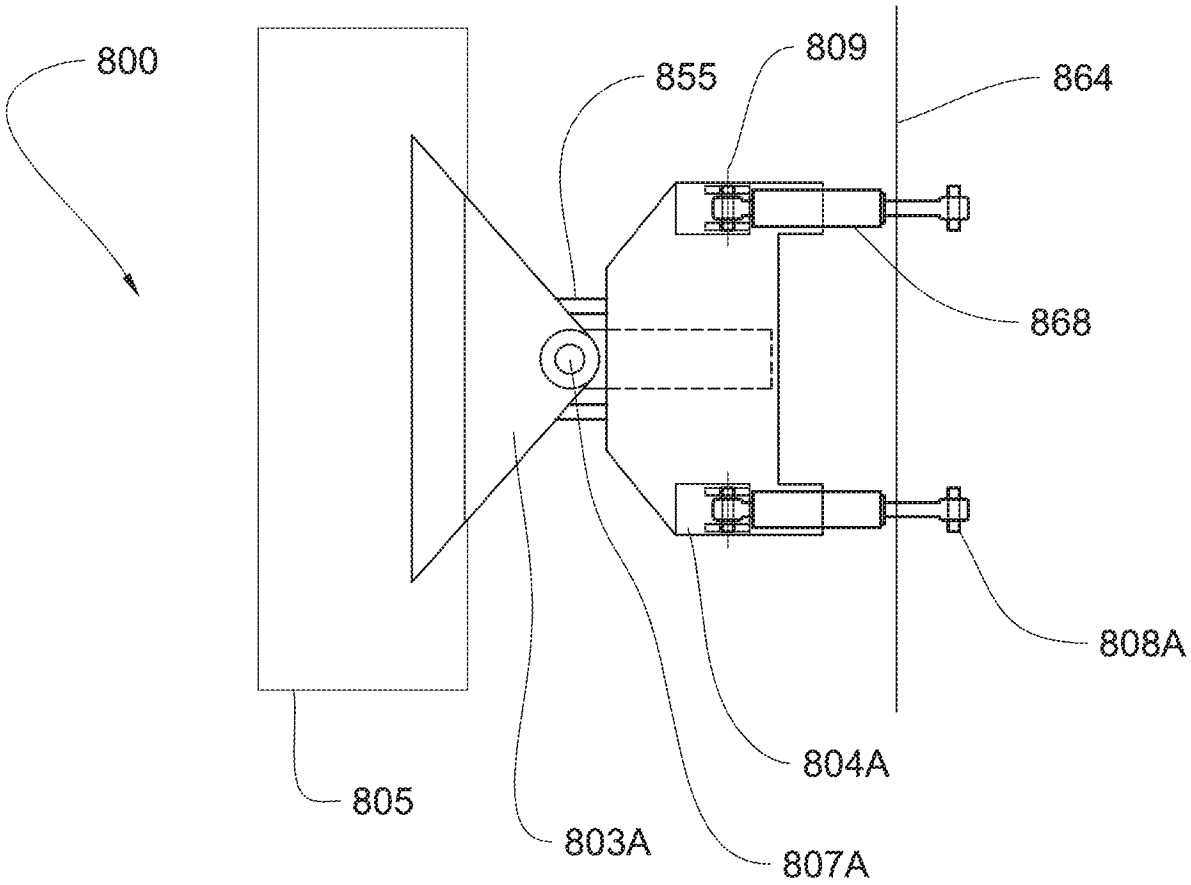
Figure 8W:
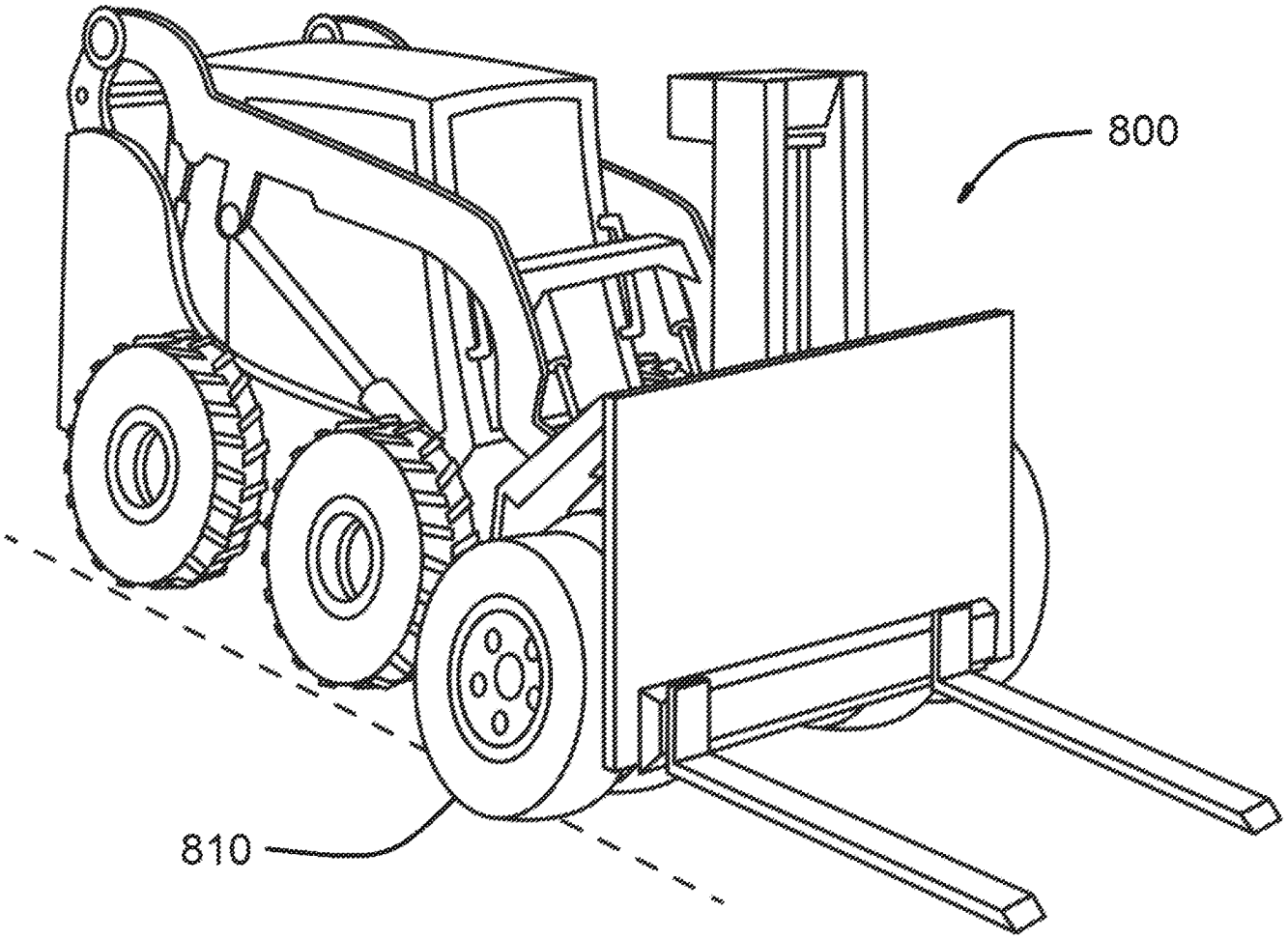
FIGS. 8W-8X depict an artist's rendering of a lift attachment apparatus in accordance with an embodiment of the present disclosure.
Figure 8X:
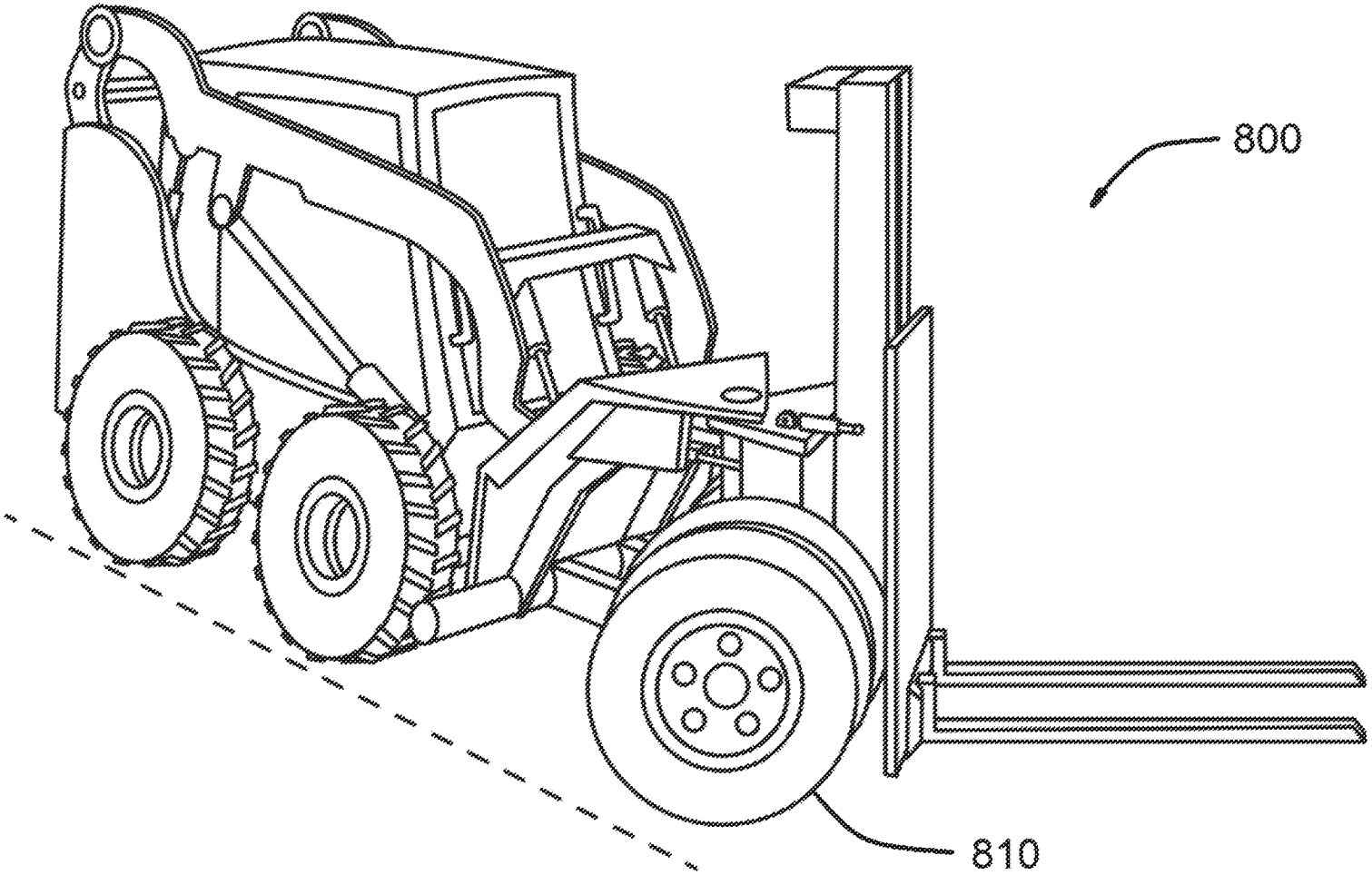

Referring to FIGS. 8H-8V, lift attachment apparatus 800 may include a forklift which may include at least one hydraulic cylinder of an aftermarket forklift assembly with forks 864 to control raising and lowering of the forklift. Additionally, lift attachment apparatus 800 may include a hydraulic cylinder 855 to control steering of the lift attachment apparatus 800. It is contemplated that the lift attachment apparatus 800 may utilize at least one auxiliary hydraulic controller of the loader 830 to control operation of the at least one hydraulic cylinder 855 for the forklift operation and steering. It is contemplated that at least one hydraulic cylinder may be a single acting hydraulic cylinder, a double acting hydraulic cylinder, gears, chains or in combination, and further may be powered electrically. It is contemplated that force applied by at least one forward facing loader arm 840 in a downward motion along with upward lift of a tipping mechanism of the loader 830 may cause force that creates upward leverage with the wheels 810 of the lift attachment apparatus 800. Lift attachment apparatus 800 may increase safe operating capacity far beyond a tipping capacity of a loader using the loader's arms and/or tipping function.

Lift attachment apparatus 800 may not include wheels centered on the load which may cause the load to bob back and forth while in motion at an amount determined by the play in the lifting components of the loader. Lift attachment apparatus 800 may include brakes. Brakes and a small battery to power the brakes may be set with a standard variable brake controller and may be activated by the parking brake on the loader. With brakes, loader 830 and lift attachment apparatus 800 may operate similar to a truck with a car trailer that has independent brakes. Lift attachment apparatus 800 may or may not include powered wheels that are operated with loader controls or tapped into the loader's left and right wheel controls. It is contemplated that lift attachment apparatus 800 may include a hitch 816 for transport. Hitch 816 may be a two inch interior width square pipe passing through the back plate for the loader side of the frame 821 and being connected to the loader side frame support post 819 below the attachment plate being integrated with safety chains. A two inch outside dimension square pipe with a coupler on the end may attach to a trailer ball on a vehicle. Forklift may further include additional forks 867 to carry the weight, such as four forks. It is contemplated that the hydraulic capacity may be at least 7,200 lbs. with a Bobcat 2009 S205 skid-steer loader. The loader may not physically tip forward until the load exceeds 12,000 lbs., but the loader's hydraulic bypass may be activated prior to a load being lifted above its resting place, which may be much safer than a standalone loader with forks. Wheels of the attachment 800 may be mounted behind mounting positions 808 of mast 865 of the attachment and may allow access into limited access spaces.

Referring to FIGS. 8H-8J, it is contemplated that the lifting side of the frame 804 can be articulated around the articulation hinge pins 844 within the holes of 807 causing the mast 865 and the forks 867 to be turned at the same angle as the created articulation of a degrees of 0 to an contemplated degree A2 being as much as 27.5 degrees in this configuration as shown in FIGS. 8E-8G and FIG. 8P, but may be of any angle up to 70 degrees.

Referring to FIGS. 8H-M, it is contemplated when attachment apparatus 800 articulates the frame 804 around frame 803 around the pins 844, the wheels 810 will stay in the same plane as the loader 830 even if hydraulic cylinder 868 moves pin attachment 809 toward or away from mounting position 808A of the mast 865 causing it to rotate around mounting position 808B of the mast 865. It is contemplated that if the mast 865 is tipped up or down from 0 degrees parallel from the loader's 830 wheels or from 0 degrees perpendicular to the ground the forks 867 may twist along with the wheels 810. The use of cylinder 845 of the loader rotating the tilting plane 820 or the use of cylinder 846 of the loader causing forward facing loader arm 840 may be used to straighten attachment apparatus 800 to make the wheels 810, the forks 867, or the mast 865 to be put in a desirable relationship to the ground for operational functionality. Hydraulic cylinder 868 may be used to change the angle of the aftermarket forklift assembly with forks 864 independently of the other moving parts of loader 830 or attachment apparatus 800. It is further contemplated that if the lifting side of the frame 804 is articulated around the operators side of the frame 803 at hinge pins 844 in an inward motion and if the forks 867 are tipped outside of a parallel plane of the base of the loader's wheels using the hydraulic cylinder 845 or hydraulic cylinder 846 to move forks 867 in a downward motion, that the wheel 810 furthest towards the inside of the turn will be raised to a higher elevation than that of the outermost wheel 810 of the turn. It is also contemplated that if the forks 867 are raised in an upward motion using the hydraulic cylinder 846 or hydraulic cylinder 845 so that frame 803 is not in a plane parallel with the wheels of the loader 830 while the attachment is articulated, the wheel 810 on the outermost outside of the turn will be raised above that of wheel 810 on the innermost inside of the turn. It is contemplated that the wheels 810 may be in the same plane as the surface they are rolling on or in the same plane as the wheels of the loader 830 for lift attachment apparatus 800 to be functional where the loader 830 can tip the forks 867 without using any of the hydraulic cylinders or motors on lift attachment apparatus 800. It is contemplated that the wheels 810 mounted to hub carrier leaves 811 could be rotated around the pillow block bearing with pin 812 as shown in FIGS. 8J-8L. A race roller bushing 815 mounted to lifting frame support post 818 and riding against race 814 mounted with bolts through holes 817 may provide additional support. It is further contemplated that shock pad devices 822 may limit this dual sided oscillating hub carrier assembly 806 for stability as shown in FIGS. 8K-8M to an angle of A8 being shown with a maximum allowable tilt of 12 degrees to the dual sided oscillating hub carrier assembly. Added support to keep the hub carrier leaves 811 in an advantageous arrangement may be provided by bolts 813 and it is further contemplated that the race roller bushings may be mounted in an adjustable configuration to be in a position against race 814 where race 814 may be made of two pieces of 0.5" steel welded half lap spliced with one being a tapered track butting and lapping the hub carrier leaf 811.

Referring to FIGS. 8H-8J, it is contemplated that lift attachment apparatus 800 may be damaged if not designed to go against the moving wheels of loader 830 and the forward tilt limiting bumper 850 may be employed. It may be also advantageous that the limiting bumper 850 may prevent lift attachment apparatus 800 from tipping too far forward or tipping too far back during operation of moving material or disconnecting tilting plane 820 of the loader from attachment device 805.

Referring to FIG. 8N, it is contemplated controls of different kinds may be employed to control lift attachment apparatus 800 with loader 830. A 7 pin plug 831 or other plug may be used to fit in the electric output receptacle of loader 830 and a power cord 825 may be employed if a higher amperage of power is desired for operation. Power cord 825 may be wired directly into the loader 830 or an aftermarket receptacle if an adequate one is not provided on loader 830. It is contemplated that hydraulic power may be provided to run the hydraulics of lift attachment apparatus 800 through the hydraulic quick connect couplers of loader 830. It is contemplated that male flat faced quick coupler with hydraulic hose 841 could be mounted into the female output of loader 830 and that female flat faced quick coupler with hydraulic hose 842 could be mounted into the male input of loader 830. A controller device 839 may be provided to operate the various parts of lift attachment apparatus 800 utilizing the controls of loader 830. Controller device 839 may include a low voltage actuating device for electric or hydraulic controls, it may include an additional hydraulic pump or motor, it may include a battery or communication devices to communicate between the loader 830 and lift attachment apparatus 800 and it may include solenoids, relays, or other devices. It is also contemplated that controller device 839 may also include cords, hoses, or fluid storage containers.

Referring to FIGS. 8M-8V, exploded views of lift attachment apparatus 800 are shown. It is contemplated that various mechanical devices i.e., an operator side of the frame 803A, 803B and 803C; a lifting side of the frame 804A, 804B, 804C; and attachment device 805, holes 807 for articulating hinge pins 844, mounting ends 808 in positions for mast 865 mounting location 809 for cylinder 868, hub carrier leaf 811 held together with leaf bolts 813 and being rested against bearing 815 through race 814 being bolted down, pillow block bearing with pin 812, lifting frame support post 818, lifting side frame post 819, back plate 821, forward tilt limiting bumper 850, hydraulic cylinder 855, pin attachments 857 and an aftermarket forklift assembly with forks 864 may be employed for operational flexibility.

Referring to FIGS. 8S-8T, the hydraulic cylinders 855 have space to operate within lift attachment apparatus as shown. Referring to FIGS. 8I, 8P, 8Q, and 8V, a variety of arrangements may be employed with the aftermarket forklift assembly with forks 864. The specifications and drawings within this application are not limiting allowing any aftermarket fork assembly with forks 864 to be utilized. It is contemplated that aftermarket fork assembly with forks 864 may be a "Lift-Tek 100 RT-MS". It is contemplated that another fork assembly 864 may be employed if the hydraulic fluid is not compatible with loader 830, or if the hydraulic or electric functions are not compatible, or if the sizing is not compatible. It is further contemplated that adapters or devices that convert power from the loader 830 to fork lift assembly 864 may be utilized.

Referring to FIGS. 8H, 8K-8L, and 8W-8X, FIGS. 8W-8X a lift attachment apparatus 800 with loader 830 shown in a straight position and a turned position are provided. It is contemplated that if lift attachment apparatus 800 was turned as it is in FIG. 8X and the fork lift assembly 864 was tilted forward using the hydraulic cylinders of the loader 830, the wheel 810 on the far right side from the operator's perspective would lower at a faster rate than wheel 810 on the opposite side of lift attachment apparatus 800. This may illustrate the benefit of a dual sided oscillating hub carrier assembly 806 shown in 8K-8M.

Referring to FIGS. 7-13G, it is contemplated that the present disclosure is further directed to a lift attachment apparatus with a power steering system and/or powered drive wheels for construction and farm equipment, including a loader. In an embodiment of the disclosure, lift attachment apparatus may include a frame including an attachment device configured to attach to a tilting plane of a loader having a forward facing loader arm, a pair of wheels connected to the frame by means of a hub carrier assembly, a first wheel of the pair of wheels located on a first side of the frame and a second wheel of the pair of wheels located on a second side of the frame, the first wheel configured to be maintained within 20 degrees of parallel to the second wheel. The lift attachment apparatus may further include a boom connected to the frame, wherein control of the boom is provided by application of force to the attachment device in a downward direction by the forward facing loader arm to create lift and rotation of the tilting plane causing rotation maintained parallel to the loader arms of an end of the boom about the first wheel and the second wheel.

Referring to FIGS. 9A-9D, side views of a lift attachment apparatus 900 in accordance with an embodiment of the present disclosure are shown. Lift attachment apparatus 900 may include a frame, the frame including an attachment device 905. Attachment device 905 may be configured to attach to a tilting plane of an all wheel drive loader 930 with tunable steering, such as a BOBCAT A300 loader. It is contemplated that attachment device 905 may be a quick attachment device in use with various types of attachments to connect with loaders. It is contemplated that a quick attachment device may be a device which allows a user to attach and detach attachments with a connection without difficult assembly and disassembly. Additionally, a quick attachment device may not require specialized tools which may allow for attachment and detachment of attachments in the field. A pair of wheels 910 may be coupled to the frame. It is contemplated that a first wheel of the pair of wheels may be located on a first side of the frame and a second wheel of the pair of wheels may be located on a second side of the frame, the first wheel configured to be maintained in through structured mechanical configuration near parallel to the second wheel. In an embodiment, each wheel may include a tire. Lift attachment apparatus 900 may further include a boom 915 connected to the frame.

Figure 9A:
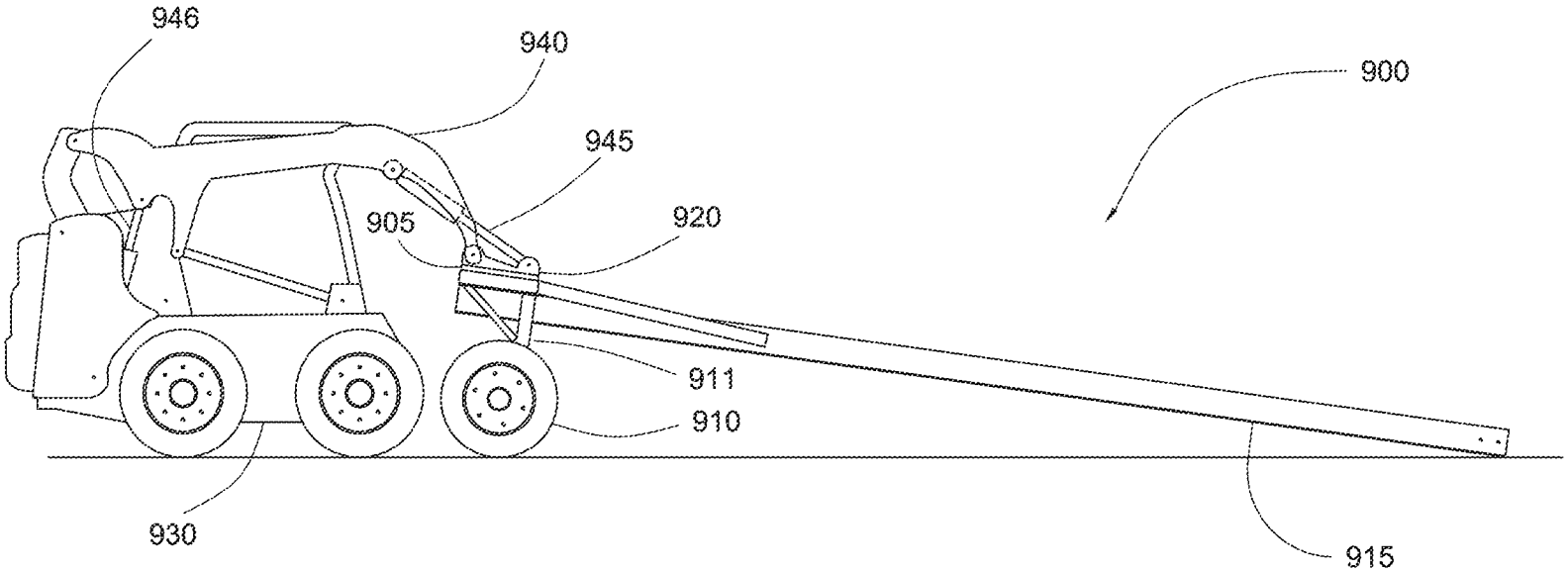
FIGS. 9A-9D depict side views of a lift attachment apparatus with a power steering system in accordance with an embodiment of the present disclosure.
Figure 9B:
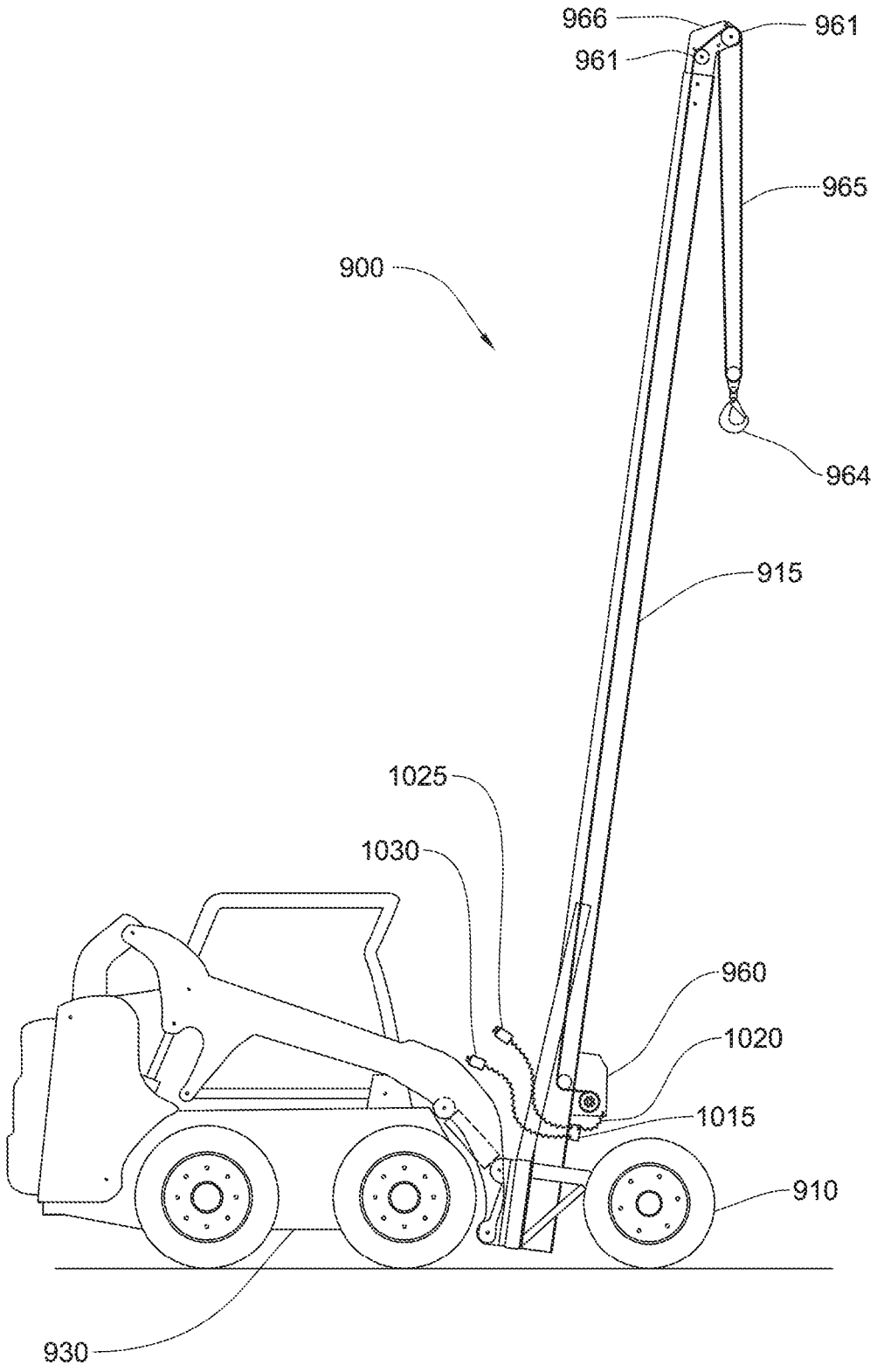

Advantageously, it is contemplated that various items (e.g. a load) may be removably coupled to an end of boom 915 and may be lifted to a desired location. Lift attachment apparatus 900 according to present disclosure may be configured to be safely rotated from a position near horizontal to the ground (0 to 10 degrees) as shown in FIG. 9A to a near vertical position (near 80 to 90 degrees to a surface up against wheel 910) as shown in FIG. 9B without risking the load or tipping an attached loader. Attachment device 905 of the frame may be configured to attach to a tilting plane 920 of a loader 930 having a forward facing loader arm 940. It is contemplated that attachment device 905 may be permanently fixed or incorporated with tilting plane 920 according to an alternative embodiment of the present disclosure. Boom 915 may be generally fixed with the attachment device 905 of the frame. It is contemplated that control of the boom 915 is provided by application of force to the attachment device 905 by the forward facing loader arm 940 in a downward direction to create lift and rotation of the tilting plane 920 causing rotation of an end of the boom about the first wheel and the second wheel of the pair of wheels 910. Tilting plane 920 may be controlled by a hydraulic cylinder 945 of loader. It is contemplated that boom 915 may be configured to be tipped up via application of force to the attachment device 905 in a downward direction and via reverse action of hydraulic cylinder 146 of the forward facing loader arm 940 of the loader 930. Through reverse action, the hydraulic capacity may be reduced, such as by about 44%. This reduction in hydraulic capacity may make it difficult to overload the lift attachment apparatus 900 if the load is being raised. Since the hydraulic capacities of hydraulic cylinders of many loaders are just over their tipping capacity, the reduction in hydraulic capacity may put the apparatus 900 well below the tipping capacity and higher than the safe operating capacity. Advantageously, hydraulic cylinder 945 of the loader may not be working in a reverse action and gains support towards lifting loads on the end of the boom with pressure applied to wheel 910 with the downward action of the loader arms 940 with the retracting action of hydraulic cylinder 946. In a standard attachment arrangement without support external of the loader such as a standard bucket, the hydraulic cylinders 945, 946 work separately to support the load according to how they are designed to operate. In this arrangement, these hydraulic cylinders 945, 946 work together with the support of wheels 910 which are also carrying the weight of the load.

Figure 9C:
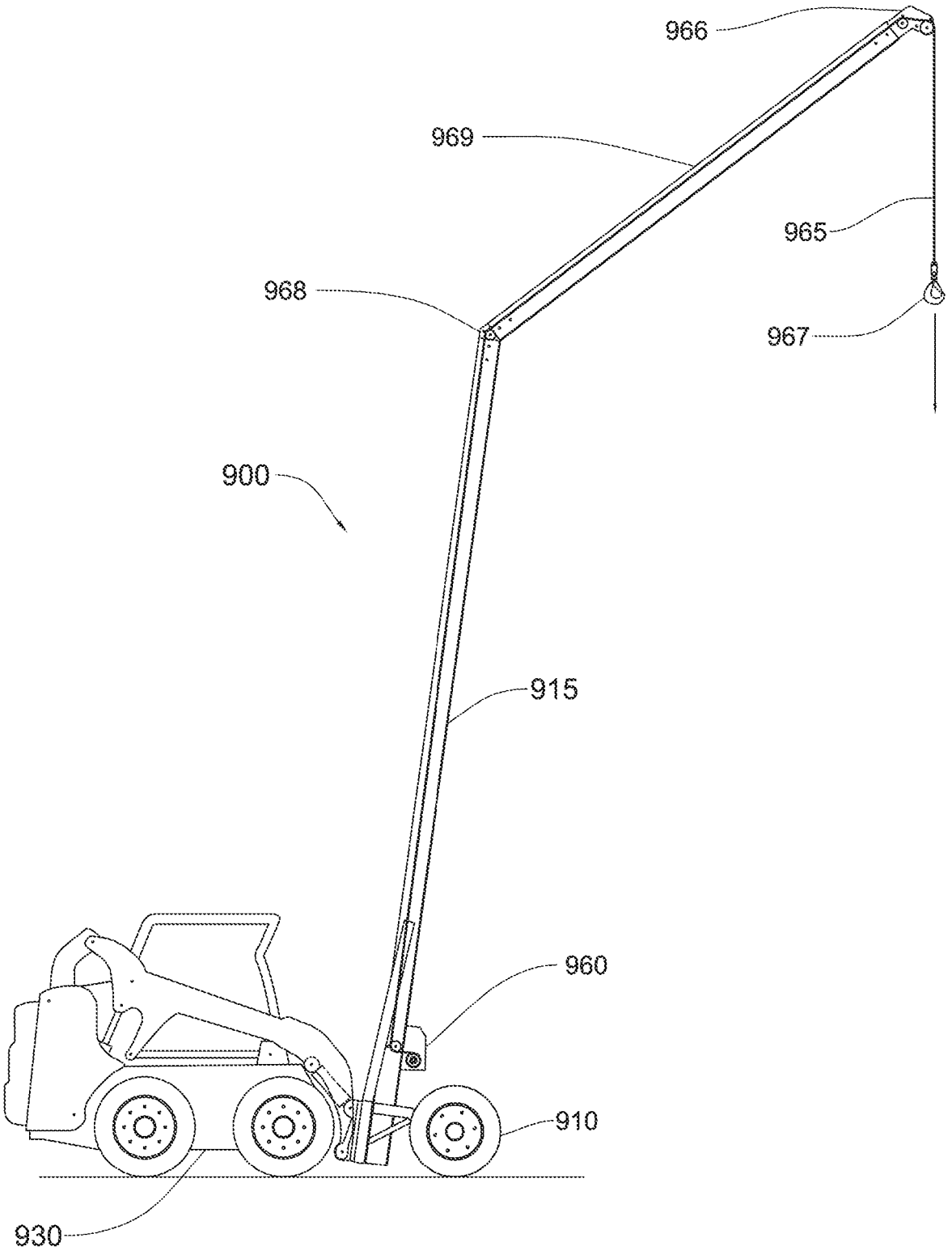
Figure 9D:
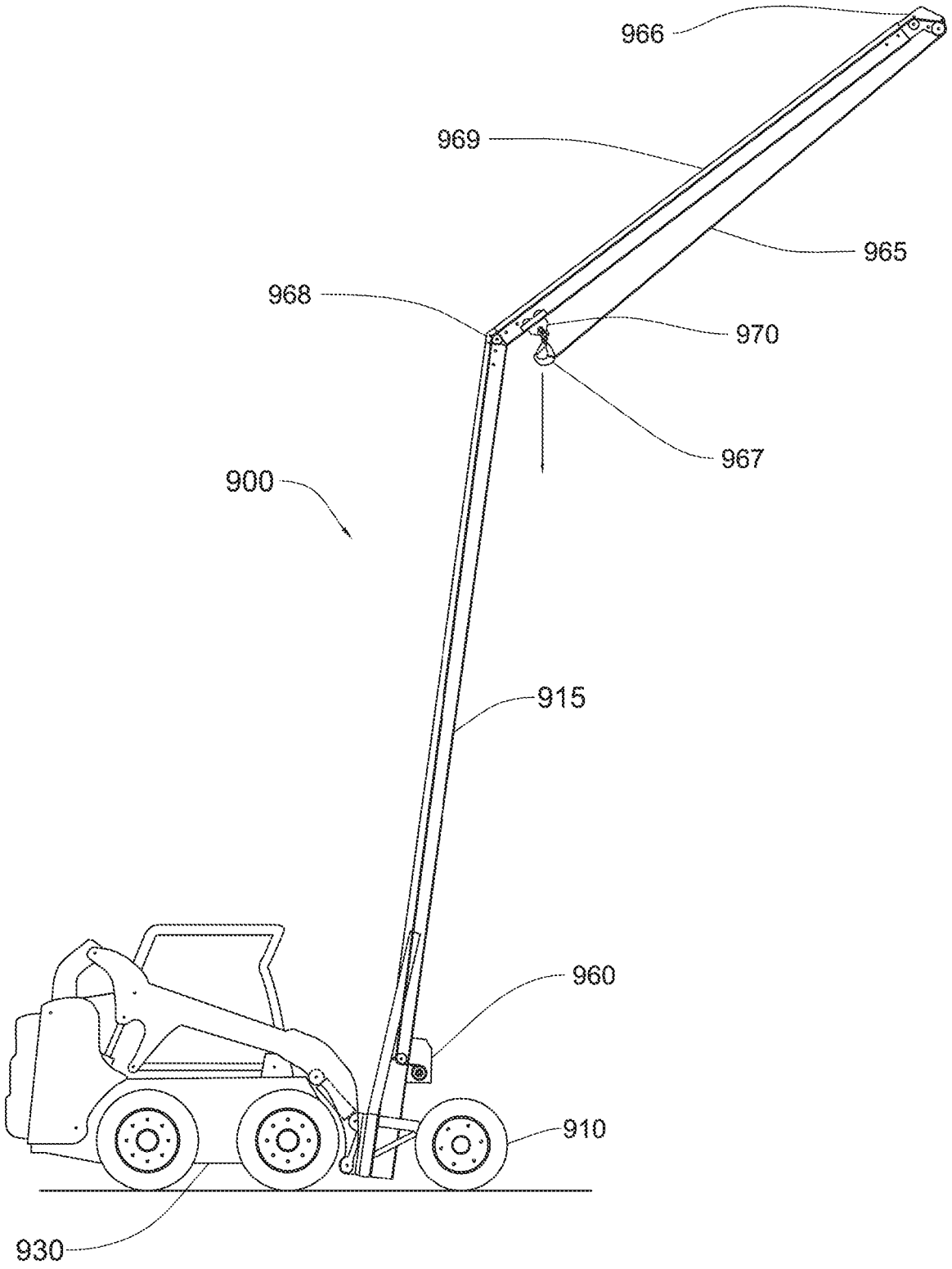

Referring to FIG. 9B-9D, a side view of the loader 930 with the lift attachment apparatus 900 attached in a near vertical position is shown. Advantageously, boom 915 may include a cable hoist assembly, the cable hoist assembly may include various mechanical devices, i.e., a winch 960, cable sheaves 961, block and tackle 964, lifting hook 967, beam trolley 970, stranded wire rope cable 965, lift attachment apparatus extension rod 969 and lift attachment apparatus jib 966 may be connected to the lift attachment apparatus 900 to increase operational flexibility. It is contemplated that other mechanical devices may be employed to power and control these functions, such as a 7 pin plug 1030 or other similar plug to fit the electric output receptacle of loader 930 going to 7 pin electric controller with minimum of a 2 way function 1015 or one configured to work with loader 930 and relay rated for amperage with loom with three 12V control wires 1020 and winch 960, cord 1025 rated for amperage of winch 960 plugged into or wired directly to loader. In FIG. 9B, a winch 960, cable sheaves 961, block and tackle 964, stranded wire rope cable 965, and lift attachment apparatus jib 966 is shown. In this configuration, the winch 960 may pull up at half of the winch pulley output speed, but may generate twice the rated lifting capacity provided that block and tackle 964 and other components are rated for it. It is contemplated the winch 960 may have a controller independent of the loader 930.

FIG. 9C depicts a side view of the loader 930 with the lift attachment apparatus 900 attached in a near vertical position with additional operating devices, i.e., a winch 960, stranded wire rope cable 965, cable sheaves 961, a rod connector having a built in cable sheave 968, lift attachment apparatus extension rod 969, lift attachment apparatus jib 966, and lifting hook 967. In this configuration, it is contemplated the winch 960 may be too powerful to use with a block and tackle 964 with a returned cable. For this reason, the lift attachment apparatus is shown with hook 967, as it would be less probable to cause overwear or failure to effect components; rod connector having a built in cable sheave 968 or extension rod 969. It is contemplated it would be beneficial that without a block and tackle 964, that loads would be able to be lifted at a faster rate and to a further distance from loader 930. In FIG. 9D, a similar arrangement to FIG. 9C is depicted, as FIG. 9D depicts added beam trolley 970 as part of the configuration. As shown in FIG. 9D, it is contemplated the winch 960 would be under a reduced load as the flange on extension rod 969 would hold the load in part, allowing the winch 960 to pull faster and in a smoother controlled fashion as there would be reduced hanging cable, rope, strapping or chain. It is contemplated the load attachment apparatus could pick up larger loads closer to a wall when lift attachment apparatus jib 966 would be beyond the wall but the rod connector 968 was horizontally on the same side of the wall as the loader 930. It is contemplated this would increase safety as boom 915 would be closer to a rigid surface in the event of any accident of the load being dropped, failure caused by the loader operator, or failure of the loader with attachments.

The lift attachment apparatus 900 as described and shown in FIGS. 9A-9D provides a number of advantages. It is common that contractors may have access to a loader due to the reduced cost of a loader as compared to lifts and cranes. Additionally, through use of various attachments, loaders may be more likely to be owned due to their multiple functions, usability, and operability without specialized skill. However, previous implementations of booms with loaders are limited due to their low lift capacity, reach, or mobility.

Lift attachment apparatus 900, by use of the pair of wheels 910, operating between the loader 930 and the load at the end of the boom 915, may operate as a lever. This configuration and capability to operate as a lever may dramatically improve the lift capacity of the boom 915 as compared to previous implementations. For example, the use of the pair of wheels 910 as the fulcrum, may allow an amplification of the input force provided by a loader 930 when applied to the attachment device 905 of the lift attachment apparatus 900 in order to provide a greater output force. It is contemplated that mechanical advantage of the lift attachment apparatus 900 may be greater when the pair of wheels 910 at the point to where the pair of wheels 910 come into contact with a surface is located between the attachment device 905 that is coupled to a tilting plane of a loader 930 and the load which is located at the end of the boom 915, as shown in FIG. 9B. Additionally, it is contemplated that a center point of the pair of wheels 910, (e.g. the point at which the wheels may contact the axle), may also be forward of the attachment device 905 whereby mechanical advantage of the lift attachment apparatus 900 may be greater. Use of the lift attachment apparatus 900 may allow transport of material while the loader is located more than thirty feet away or greater, which may be particularly valuable in muddy conditions or other conditions in which a surface is not solid.

Referring to FIGS. 10A-10I, a lift attachment apparatus 900 with power steering is shown. Lift attachment apparatus 900 may include a frame including an attachment device configured to attach to a tilting plane of a loader having a forward facing loader arm, a pair of wheels connected to the frame by a hub carrier for power steering maintained in a rigid position determined by the loader operator via hand controls attached to a first wheel of the pair of wheels located on a first side of the frame and a second wheel of the pair of wheels located on a second side of the frame, the first wheel configured to be maintained within 20 degrees of parallel to the second wheel horizontally. When the wheels are turned to other positions, the wheels may positively or negatively camber vertically determined by the selected turned position maintained by the operator via hand controls. Advantageously, a first wheel of the pair of wheels located on a first side of the frame and a second wheel of the pair of wheels located on a second side of the frame may be maintained within 6 degrees of parallel to the second wheel horizontally when the wheels are unturned and when turned the inside wheel of the turn (the wheel with a shorter path and sharper radius of travel when being moved along the ground) maintains a sharper turn than the outer wheel (the wheel with the longer path and less sharp radius of travel when being moved along the ground) creating a sharper turning radius for the inside wheel. It is contemplated that positive cambered wheels in the straight position may improve stability and a straight direction may be more easily maintained as is the case with many tractors. It is also contemplated that with a full turn, negative cambered wheels with the inside wheel of the turn (the wheel with a shorter path and sharper radius of travel when being moved along the ground) than the outer wheel (the wheel with the longer path and less sharp radius of travel when being moved along the ground) may turn with less resistance. Advantageously, the wheels are configured to be maintained in a positive camber vertically when in an unturned position, near 0 camber vertically when in a half turned position and in a negative camber vertically when in a fully turned position. These previously described operations within this paragraph are configured to be controlled within the cab of the loader while not allowing the hub carrier assembly to turn because of the rotation of the boom around the wheels or the direction the wheels of loader 930 may be directed. It is contemplated this is necessary to maintain consistent and controllable lift height and lift operation when the loader arms are in all variously selected positions while the attachment wheels are in contact with the ground or another surface.

Figure 10A:
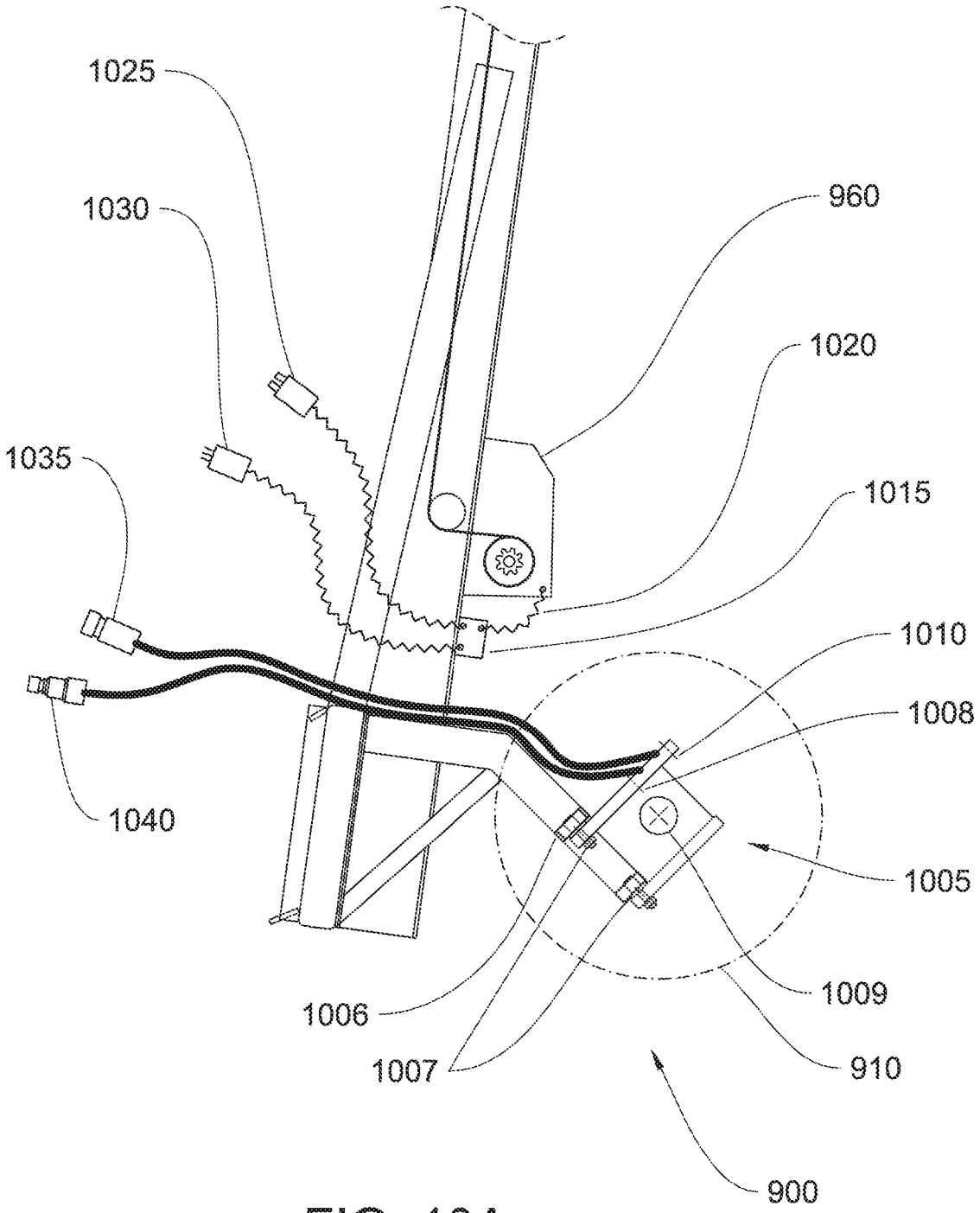
FIGS. 10A-10K depict detailed exploded views of a lift attachment apparatus with power steering system in accordance with an embodiment of the present disclosure.

Referring to FIG. 10A, an exploded detailed side view of a lift attachment apparatus 900 with a power steering system is shown. The power steering system may include a plurality of components, including a wheel 910, hub carrier assembly 1005 with aperture 1009 for an axle to be supported in, frame hub carrier assembly mount 1006, centerline line for holes 1007 for main hub carrier ball joints, centerline for hole 1010 for a ball stud for an end of a tie rod, centerline for hole 1008 for a rod end of steering hydraulic cylinder, a winch 960, 7 pin electric controller 1015 with 2 way function relayed to winch amperage, wire loom with three 12V control wires 1020, 30 amp or higher rated cord 1025 plugged into or wired directly to loader, Bobcat style 7 pin plug with wiring harness in loom 1030, hydraulic flat faced quick coupler receiving negative pressure outflow to turn left 1035, hydraulic flat faced quick coupler receiving positive pressure inflow to turn left 1040.

Figure 10B:
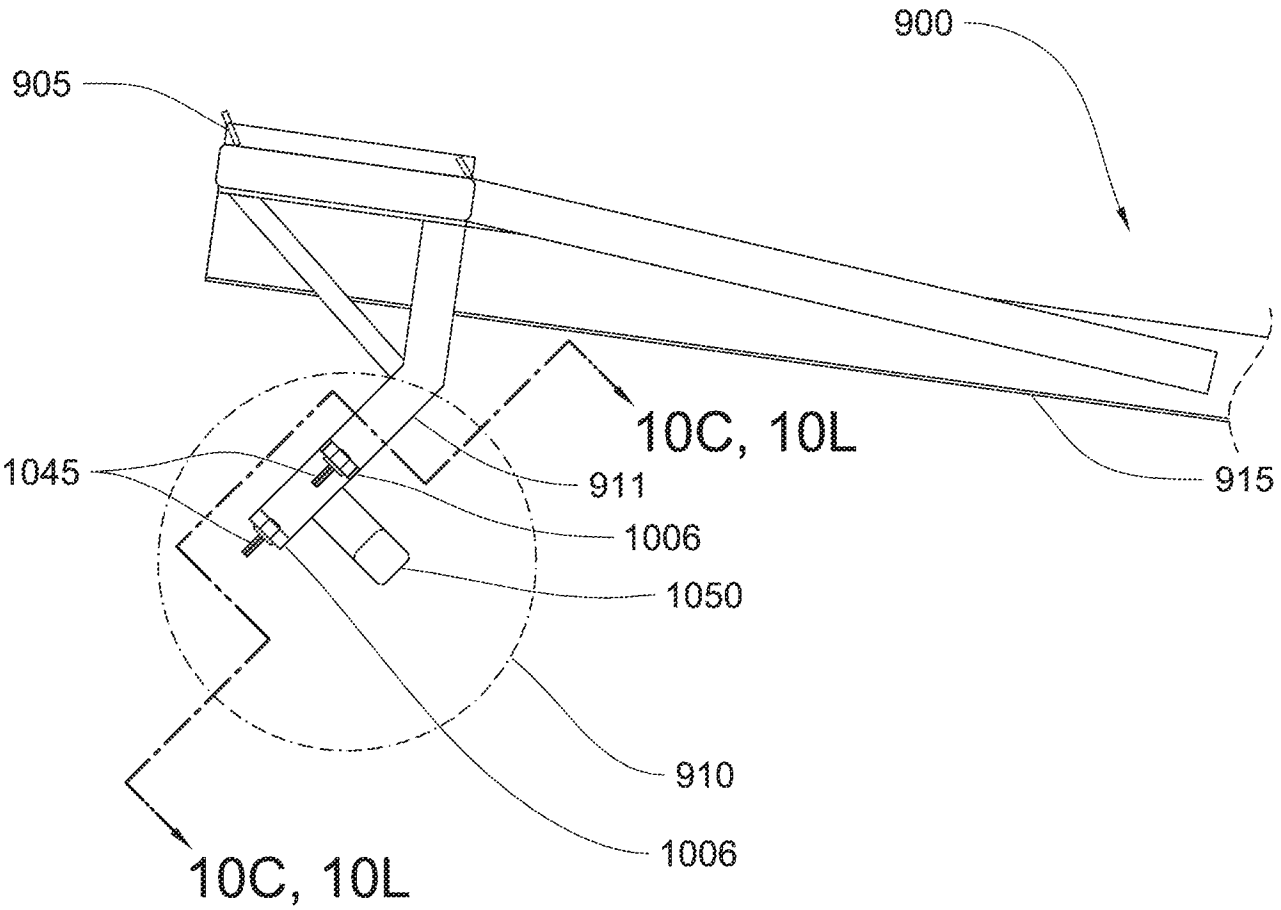

FIG. 10B depicts an exploded detailed side view of the lift attachment apparatus 900 with power steering system without hub carrier assembly 1005 shown in FIG. 10A, attachment device 905, frame hub carrier assembly mounts 1006, ball joints with studs 1045, and steering control bumper 1050.

Figure 10C:
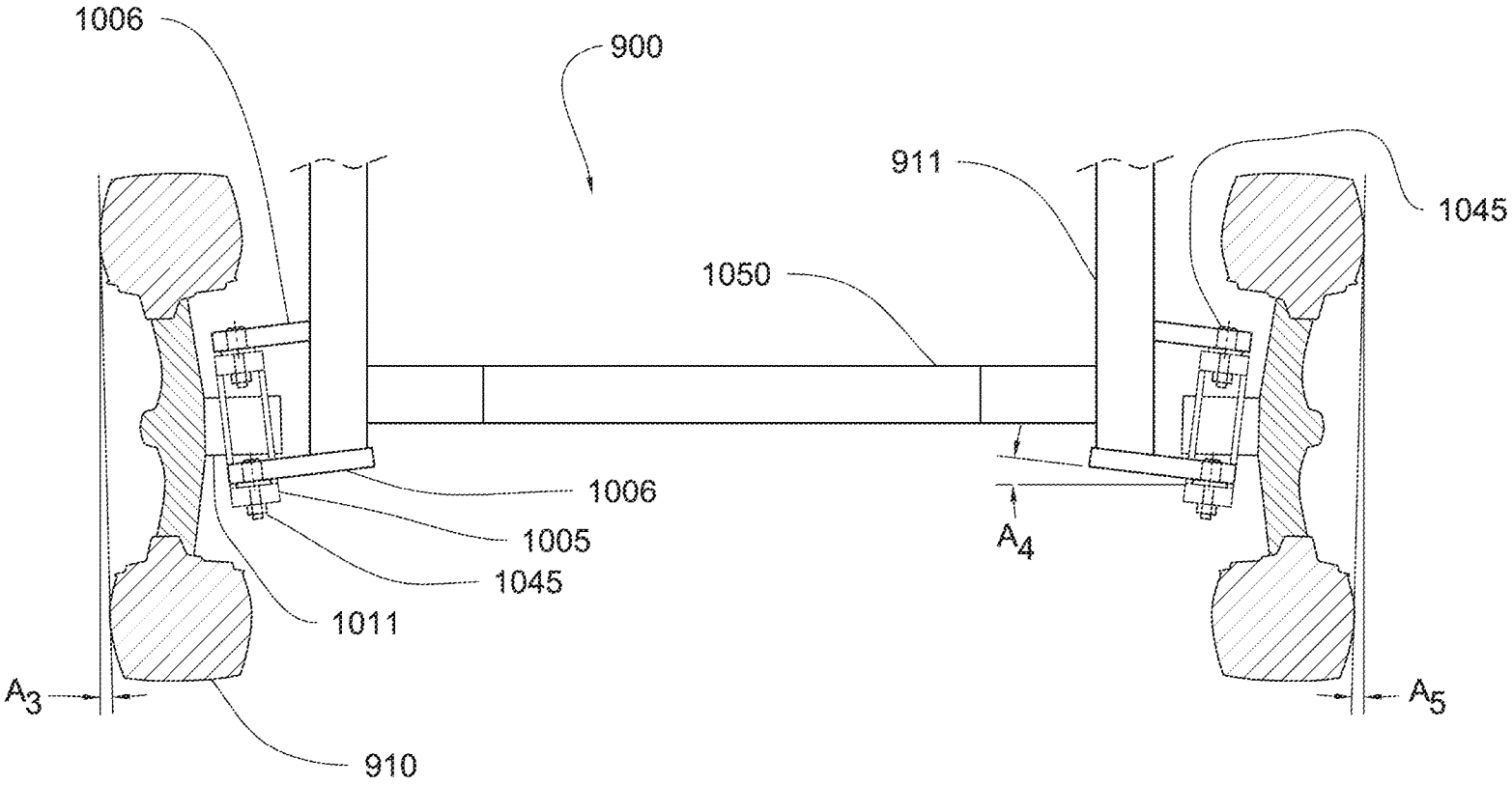

FIG. 10C depicts a rear view of the lift attachment apparatus 900 with a power steering system from the view of the loader driver with the couplers 911 perpendicular to the ground with an upper portion of coupler removed above the shown cutline, steering control bumper 1050, frame hub carrier mount 1006 pitched at value of A4 shown at 6.8 degrees attached with ball joints with studs 1045 for left and right sides of the power steering system to a frame hub carrier assembly mount 1006 pitched a 6.8 degrees respectively. It is contemplated that under some conditions it may be advantageous to have frame hub carrier mount 1006 pitched at value of A4 to have a pitched value of greater values or less values, including values of less than 0 so different cambering can be achieved in a turned position. It is also contemplated axle 1011 may be mounted differently in aperture 1009 shown in FIG. 10A to widen the wheelbase or increase the vertical camber as is desired. It is contemplated that a loader operator purchasing a new attachment that did not want to use the steering controls on a regular basis may want the wheels to be negatively cambered to make it easier to drag the tires into a turn without turning the hub carrier assembly or may desire to have the wheels have no camber so the tires have more consistent wear across the tread in the event the attachment is used on rough surfaces.

Figure 10F:
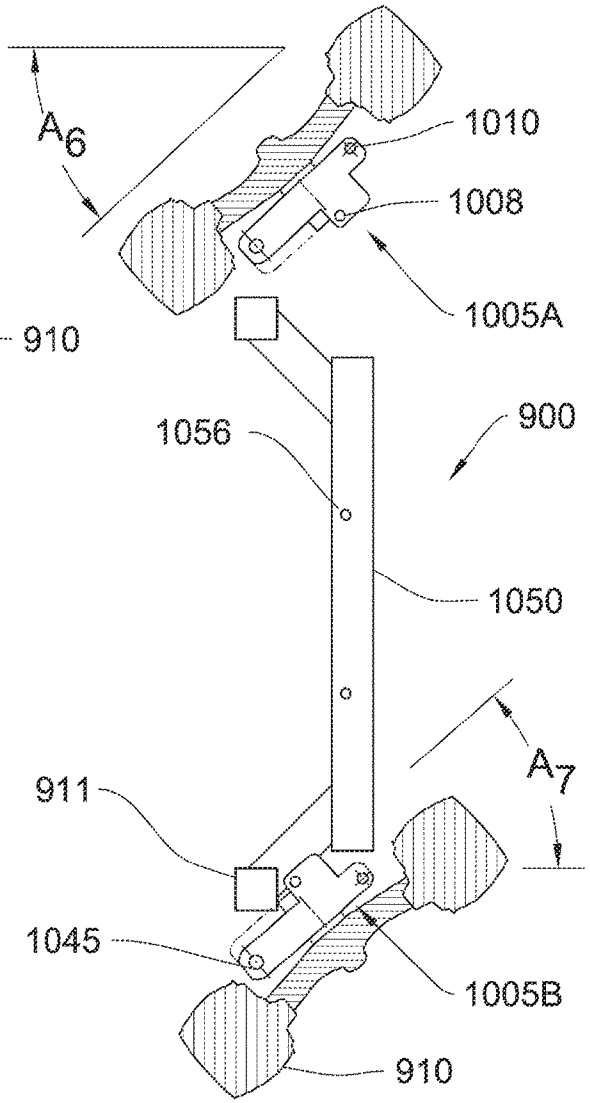
Figure 10E:
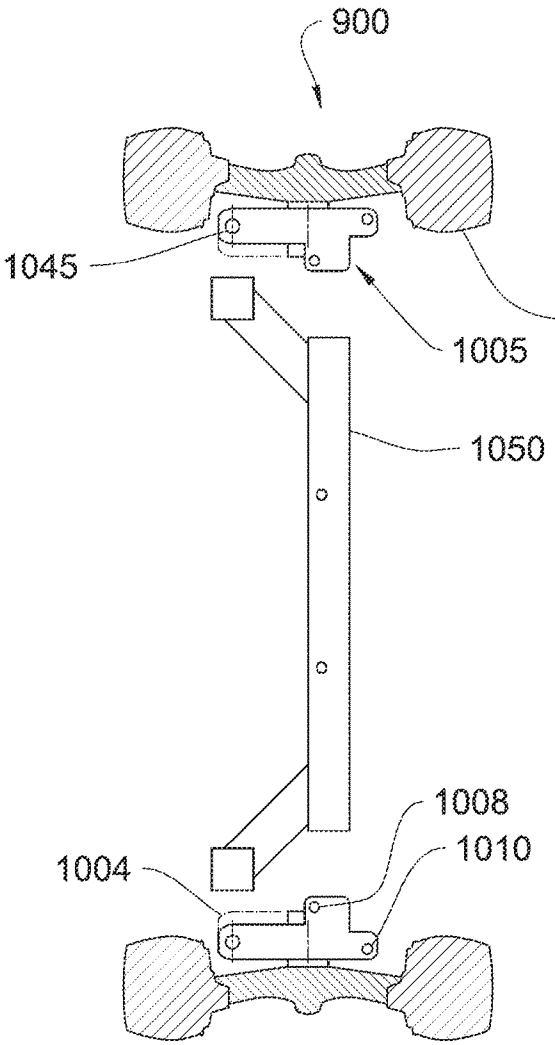
Figure 10D:
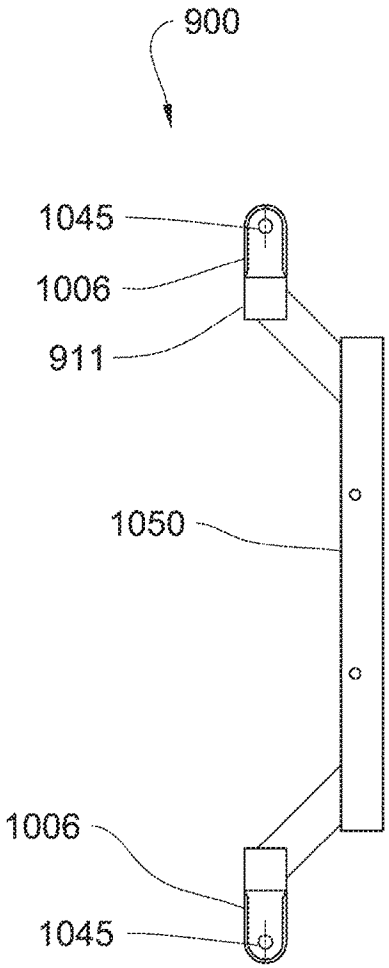

FIG. 10D depicts an exploded top view of lift attachment apparatus 900 with a power steering system including mounting components for the power steering system components, i.e., frame hub carrier mounts 1006, steering control bumper 1050, main hub carrier ball joints with studs 1045 for left and right sides of the power steering system. Frame coupler 911 is cut off at the same point as in FIG. 10C as shown. FIG. 10E depicts an exploded top view of the lift attachment apparatus 900 with a power steering system including power steering system components, i.e., steering control bumper 1050, main hub carrier ball joints with studs 1045, center of hole for tie rod ends 1010, centerline for hole 1008 for the rod end of steering hydraulic cylinder, right and left hub carrier assembly 1005 without the frame hub carrier mounts. Frame coupler 911 is cut off at the same point as in FIG. 10C as shown. FIG. 10F depicts an exploded top view of the lift attachment apparatus 900 with a power steering system including power steering system components, i.e., steering control bumper 1050, left hub carrier assembly 1005A shown with a value of A6 above it being 43 to 46 degrees with right hub carrier assembly 1005B shown with value of A7 to the right of it being 38 to 41 degrees, steering hydraulic cylinder studs 1056, centerline for hole 1008 for the rod end of steering hydraulic cylinder, center of hole for tie rod ends 1010. It is contemplated that when the wheels 910 are turned in the opposite direction that the values of A6 and A7 would switch in value at their respective opposite amount of turning right versus left. FIG. 10F is shown without the frame hub carrier mounts and frame coupler 911 is cut off at the same point as in FIG. 10C as shown.

Figure 10H:
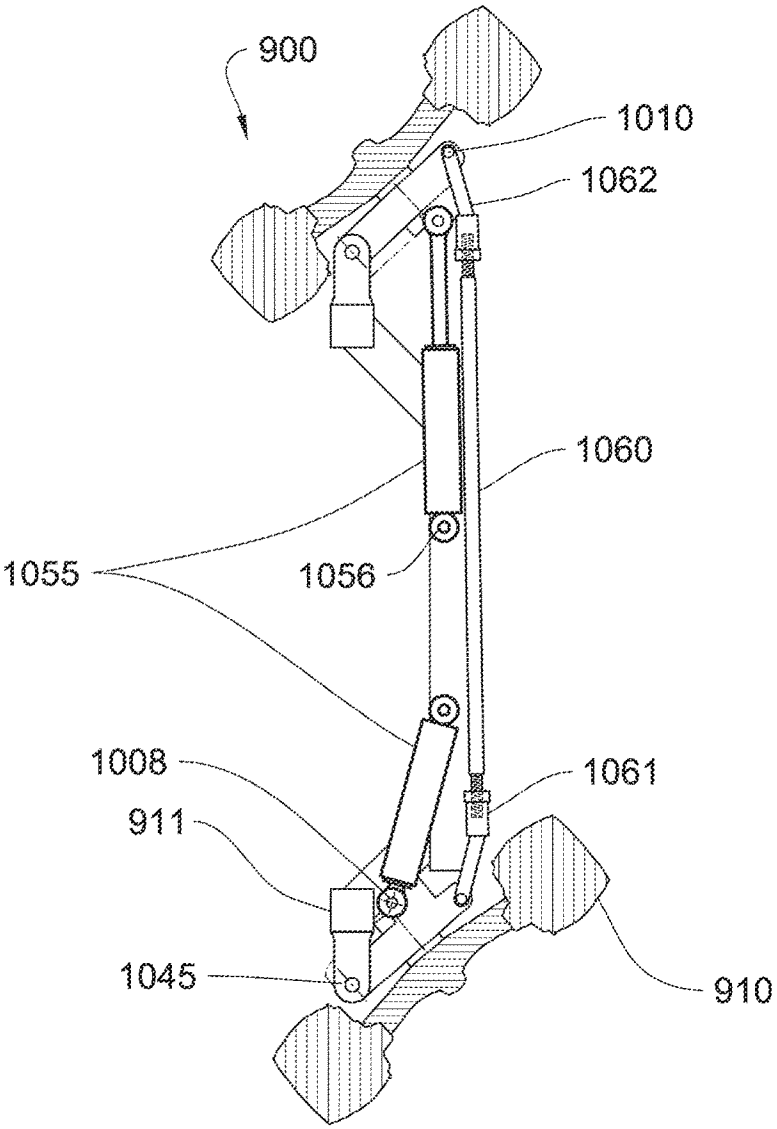
Figure 10G:
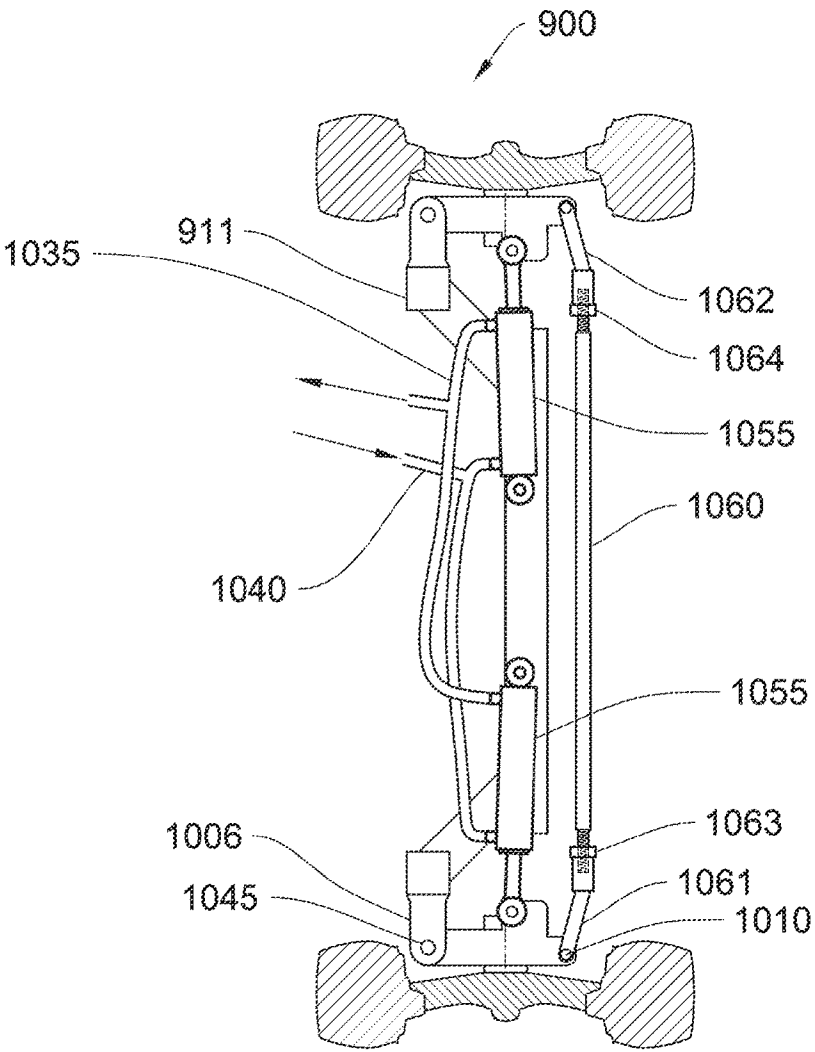

FIG. 10G depicts an exploded top view of the lift attachment apparatus 900 with a power steering system including power steering system components, i.e., the frame hub carrier mounts 1006, the center of hole for tie rod ends 1010, the adjustable tie rod 1060 with left hand male thread on the right end and right hand male thread on the left end, right tie rod end with left hand female thread 1061, left tie rod end with right hand female thread 1062, tie rod end jam nut with left hand thread 1063, tie rod end jam nut with right hand thread 1064, double acting hydraulic cylinders 1055. It is contemplated hydraulic hose with female flat faced quick coupler 1035 will receive negative pressure outflow to turn left and hydraulic hose with male flat faced quick coupler 1040 will receive positive pressure inflow to turn left. Frame coupler 911 is cut off at the same point as in FIG. 10C as shown.

FIG. 10H depicts an exploded top view of the lift attachment apparatus 900 with a power steering system including power steering system components with the wheels 910 turned, i.e., double acting hydraulic cylinders 1055, main hub carrier ball joints with studs 1045 for left and right sides of the power steering system, steering hydraulic cylinder studs 1056, centerline for hole 1008 for the rod end of steering hydraulic cylinder, the adjustable tie rod 1060 with left hand male thread on the right end and right hand male thread on the left end, right tie rod end with left hand female thread 1061, left tie rod end with right hand female thread 1062, and frame coupler 911 which is cut off at the same point as in FIG. 10C as shown.

Referring again to FIGS. 10E-10H, the top view of the main hub carrier ball joints with studs 1045 are what the hub carrier assemblies 1005 rotate around when making the wheels 910 turn to the left and right. In FIG. 10E and FIG. 10G, the center of hole for tie rod ends 1010 may be closer to a line parallel to the outside of the hub carrier than the main hub carrier ball joints with studs 1045 are. This arrangement may make the adjustable tie rod 1060 holes 1010 center further apart than the distance that the center of the main hub carrier ball joints with studs 1045 are from their respective right and left sides. This arrangement may allow the wheels to turn from left or right with the inside wheel of the turn to rotate around the main hub carrier ball joints with studs 1045 at a higher value. It is contemplated that these distances could be changed to form a variety of outcomes where the turning radius of the attachment apparatus 900 with a power steering system could be adjusted to fit a variety of different kinds of loaders of different sizes including the wheel 910 being more than 20 degrees from parallel. Referring to FIG. 10C, it is also contemplated that all cambered values and differences in turning could be made 0 degrees by simply making the frame hub carrier mounts 1006 have an A4 value of 0 and have the distance of the center of the holes for tie rod ends 1010 from the left to the right side of the lift attachment apparatus 900 with a power steering system may be the same distance as the center of the main hub carrier ball joints with studs 1045 are from each other on the left and right side. It is contemplated this would make the wheels 910 be fixed in a parallel position to each other no matter what the direction of the wheels of loader 930 are directionally turned or traveling, no matter what angle the boom is at vertically or no matter if the wheels are off the ground or in uneven terrain.

Figure 10I:
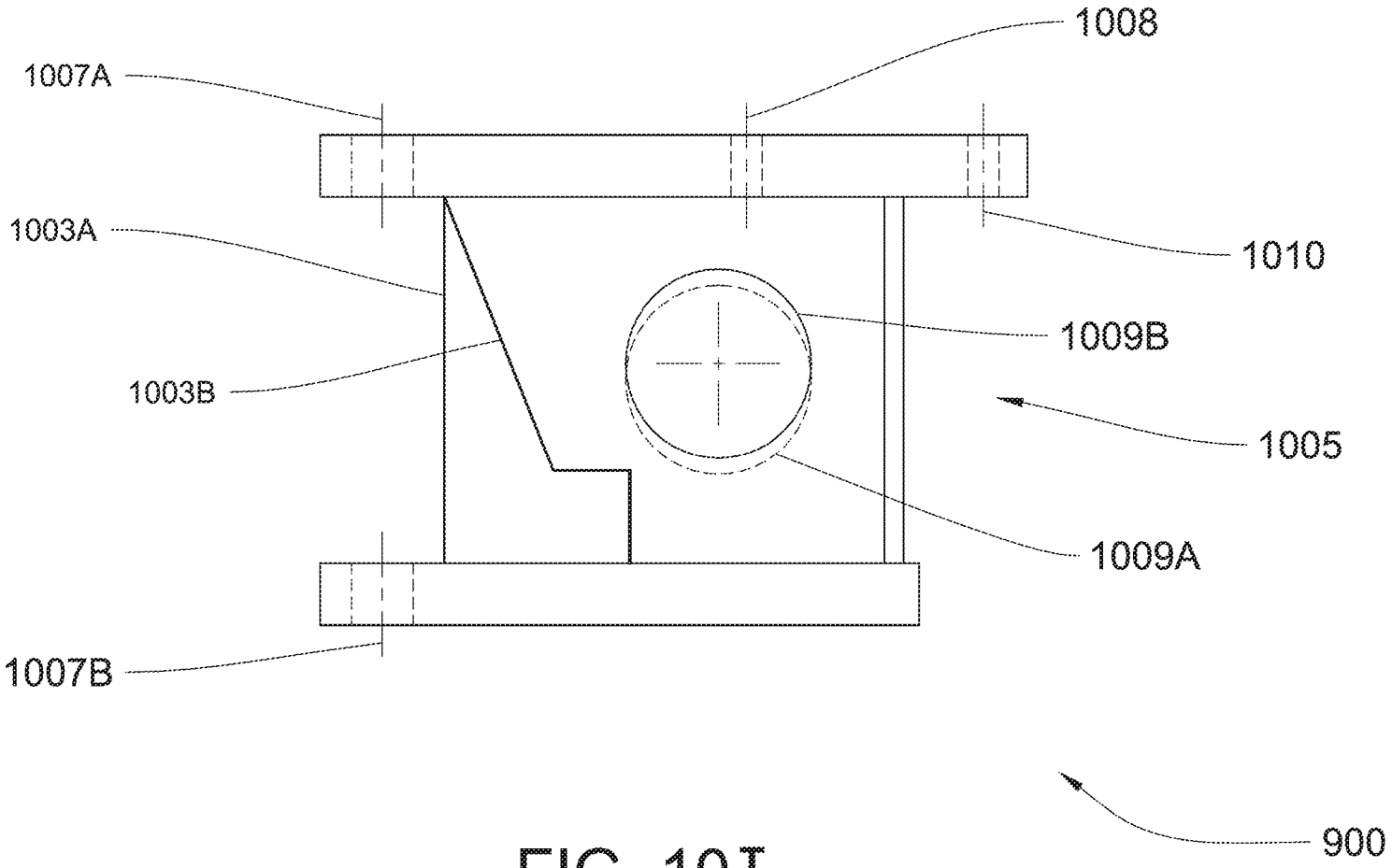

FIG. 10I depicts an exploded detailed side view of attachment apparatus 900 power steering system including hub carrier assembly 1005, with associated components, i.e. aperture 1009A for an axle to be supported in on the outside of the hub carrier assembly within the outside side hub carrier web 1003A with the rearward profile shown on the left side indicated with the 1003A leader line, aperture 1009B for an axle to be supported in on the inside of the hub carrier assembly within the inside side hub carrier web 1003B with the rearward profile shown on the left side indicated with the 10036 leader line, shown centerline line for hole 1007A for main hub carrier ball joint, shown centerline for hole 1007B for main hub carrier ball joint, shown centerline for hole 1010 for a ball stud for the end of a tie rod and the centerline for hole 1008 for the rod end of steering hydraulic cylinder. It is contemplated that the inner side hub carrier web may have a profile that will fit around the frame hub carrier assembly mount 1006 shown in FIGS. 10A-10D and FIGS. 10G-10H. It is further contemplated that aperture 1009A and 1009B may be cut at a higher or lower position to change vertical camber and vertical location of wheels 910 shown in FIG. 10C or be moved left to right to bring the wheels 910 out of a parallel position as shown on FIGS. 10E & 10G without making any other adjustments. Apertures 1009A, 1009B may be generally circular shaped or oval shaped. It is contemplated these adjustments may be advantageous to change the performance of steering and stability and to add or take away traction or drag on the wheel 910 treads as may be desired.

Referring again to FIGS. 9B-9D, boom 915 is configured as a long rod or pole. It is contemplated that boom 915 may include a lifting hook 967, block and tackle 964, beam trolley 970, stranded wire rope cable 965, lift attachment apparatus extension rod 969 and lift attachment apparatus jib 966. Boom 915 may also include one or more apertures, hooks, connectors, and the like to allow coupling to material for transport. It is contemplated that boom 915 may be modified by use of a lift attachment apparatus extension rod 969 and/or a lift attachment apparatus jib 966.

Figures 10J, 10K:
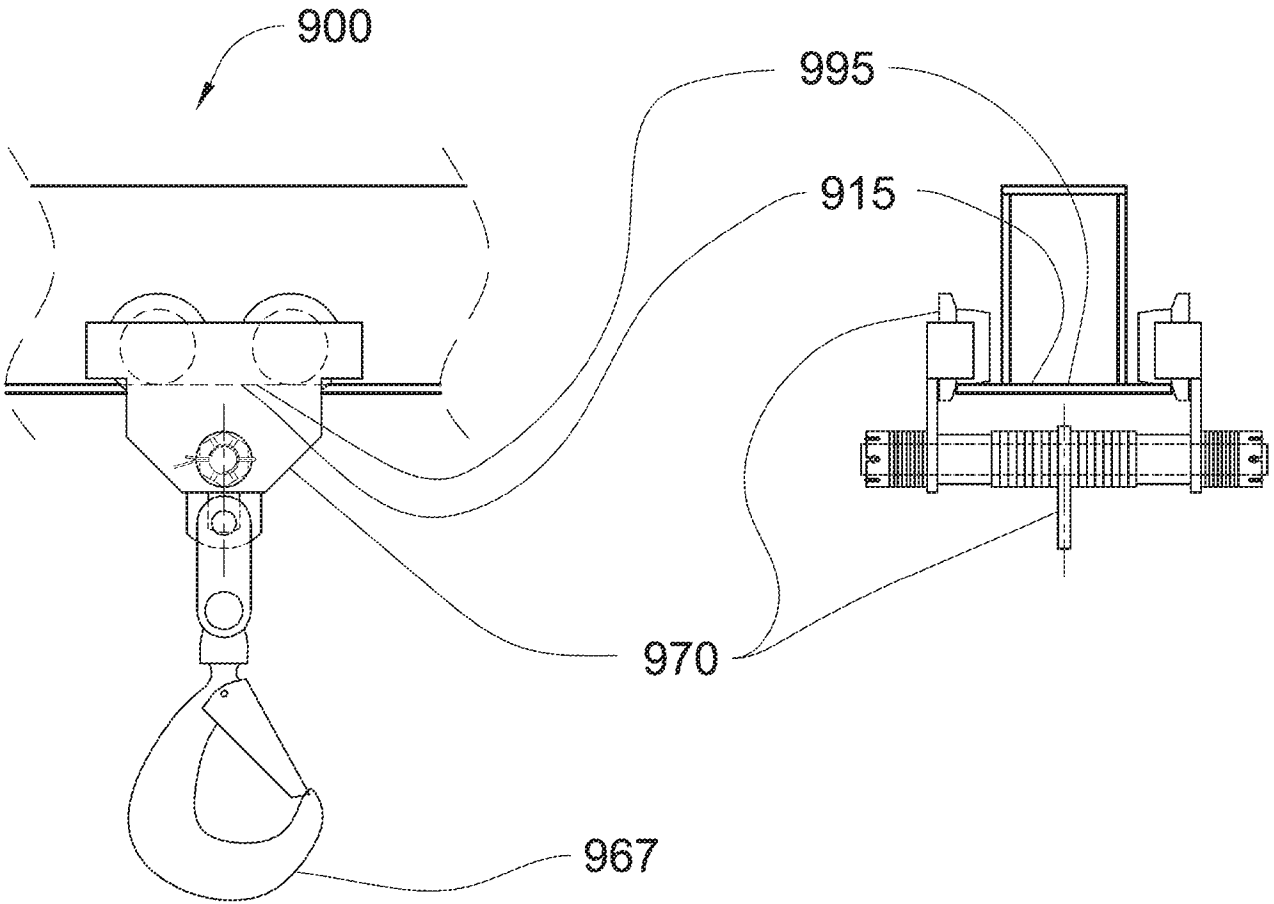

It is contemplated that boom 915 may be constructed of steel, and may be tubular in nature. However, boom 915 may be formed of various cross section shapes such as rectangular, round, triangle, roman arch, or gothic arch. Boom 915 may be constructed as a skeletal body. Boom 915 may be constructed of other materials instead of or in addition to steel, including aluminum, wood, plastic, carbon fiber, composites thereof and the like. Referring to FIGS. 10J-K the side and cross section of boom 915 and lift attachment apparatus extension rod 969 may be constructed with a flange to carry a beam trolley as shown riding on plane 995. It is contemplated that various devices could be rolled on different shapes if incorporated into the shape of boom 915 and lift attachment apparatus extension rod 969 as shown on FIG. 9D and that additional devices may be added, such as powered wheels on a trolley or other rolling configuration, stopping devices on boom 915 and lift attachment apparatus extension rod 969 and other fail-safe devices to move, maintain, or limit the movement of cables, hooks or rollers of the cable hoist assembly.

Referring to FIGS. 11A-11E, a power driven lift attachment apparatus 1100 according to an additional alternative embodiment of the present disclosure is shown. Lift attachment apparatus 1100 may include a frame, the frame including an attachment device 1105. Attachment device 1115 may be configured to attach to a tilting plane of loader 1130. It is contemplated that attachment device 1105 may be a quick attachment device in use with various types of attachments to connect with loaders. It is contemplated that a quick attachment device may be a device which allows a user to attach and detach attachments with a connection without difficult assembly and disassembly. Additionally, a quick attachment device may not require specialized tools which may allow for attachment and detachment of attachments in the field. A pair of wheels 1110 may be coupled to the frame. It is contemplated that a first wheel of the pair of wheels may be located on a first side of the frame and a second wheel of the pair of wheels may be located on a second side of the frame, the first wheel configured to be maintained through structured mechanical configuration near parallel to the second wheel. In an embodiment, each wheel may include a tire. Apparatus 1100 may further include a boom 1115 connected to the frame.

Figure 11A:
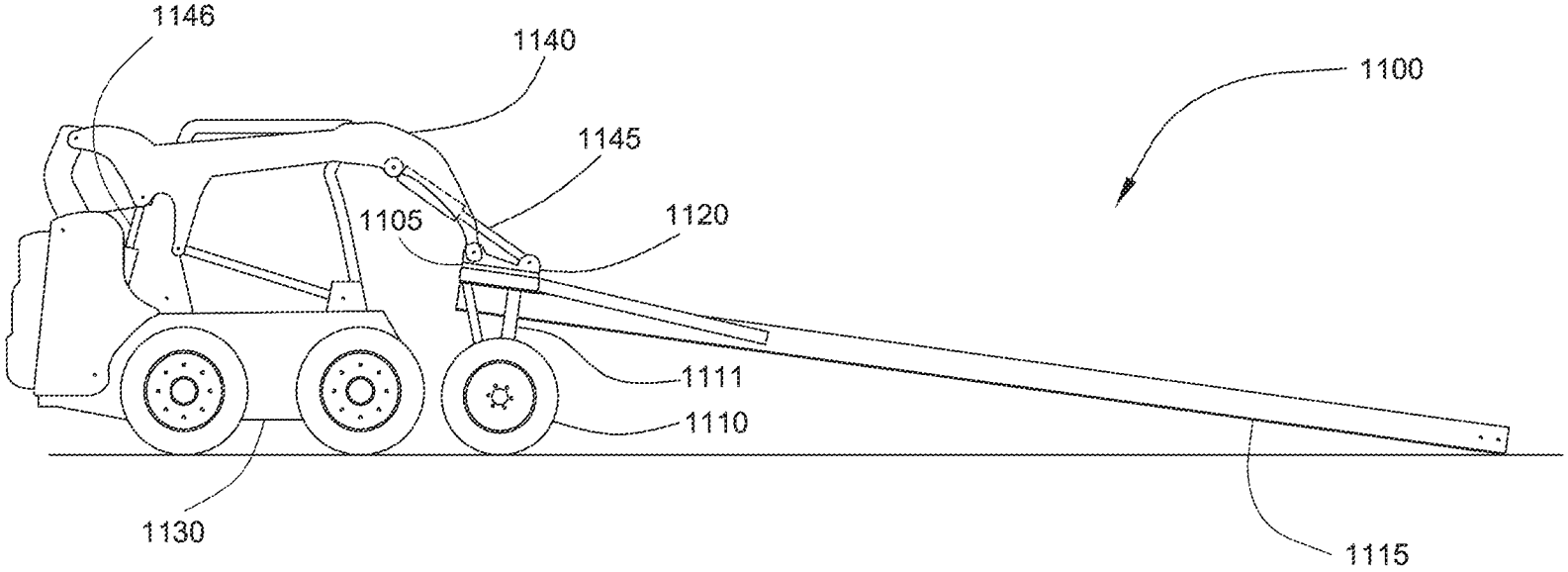
FIGS. 11A-11E depict a lift attachment apparatus with power wheels and a loader with added hydraulic controls in accordance with an embodiment of the present disclosure.
Figure 11B:
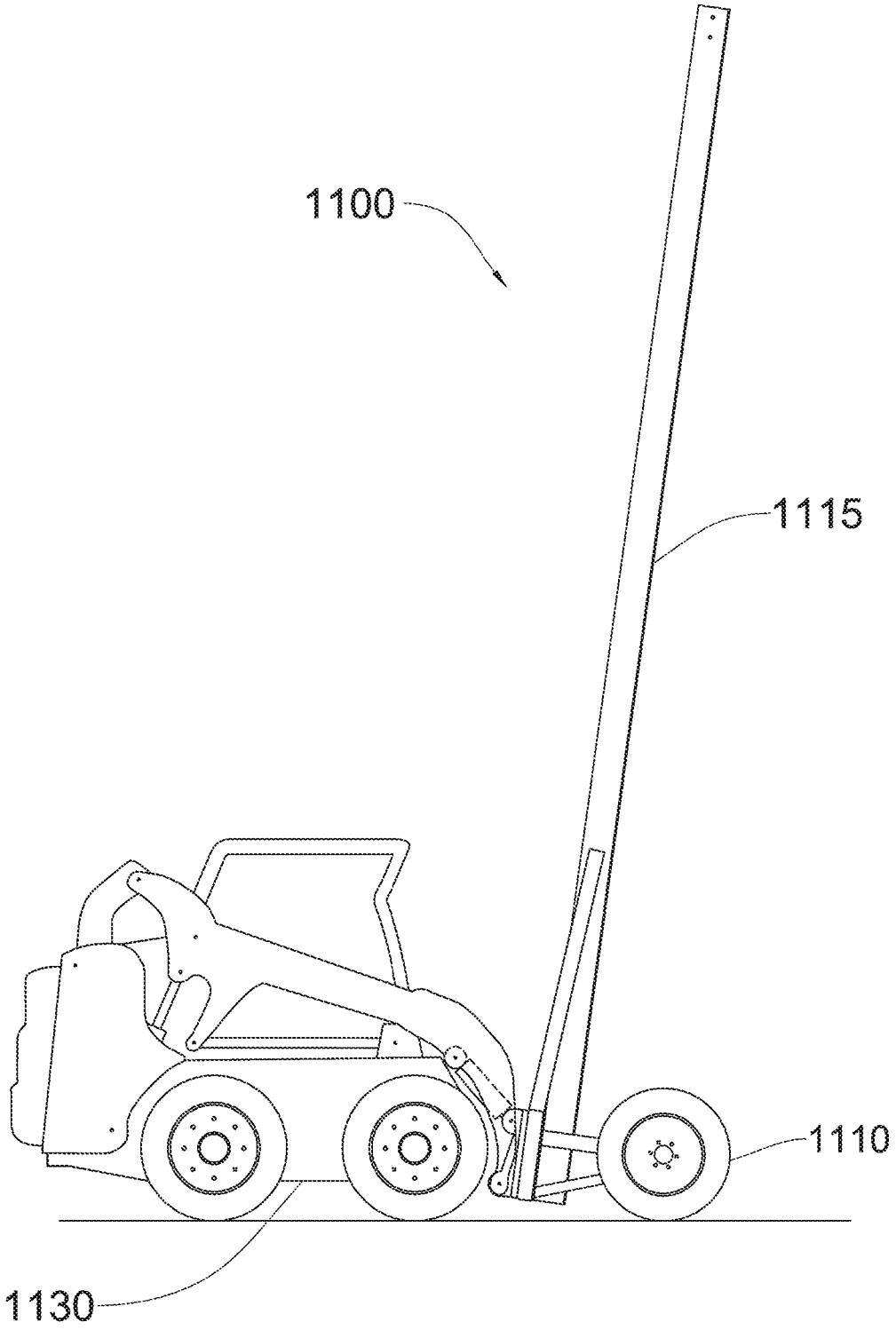

Advantageously, it is contemplated that various items (e.g. a load) may be removably coupled to an end of boom 1115 and may be lifted to a desired location. Lift attachment apparatus 1100 according to present disclosure may be configured to be safely rotated from a position near horizontal to the ground (0 to 10 degrees) as shown in FIG. 11A to a near vertical position (near 80 to 90 degrees to a surface up against wheel 910) as shown in FIG. 11B without risking the load or tipping an attached loader. Attachment device 1105 of frame may be configured to attach to a tilting plane 1120 of a loader 1130 having a forward facing loader arm 1140. It is contemplated that attachment device 1105 may be permanently fixed or incorporated with tilting plane 1120 according to an alternative embodiment of the present disclosure. Boom 1115 may be generally fixed with the attachment device 1105 of the frame. It is contemplated that control of the boom 1115 is provided by application of force to the attachment device 1105 by the forward facing loader arm 1140 in a downward direction to create lift and rotation of the tilting plane 1120 causing rotation of an end of the boom about the first wheel and the second wheel of the pair of wheels 1110. Tilting plane 1120 may be controlled by a hydraulic cylinder 1145 of loader. It is contemplated that boom 1115 may be configured to be tipped up via application of force to the attachment device 1105 in a downward direction and via reverse action of hydraulic cylinder 1146 of the forward facing loader arm 1140 of the loader 1130. Through reverse action, the hydraulic capacity may be reduced, such as by about 44%. This reduction in hydraulic capacity may make it difficult to overload the apparatus 900 attachment if the load is being raised. Since the hydraulic capacities of hydraulic cylinders of many loaders are just over their tipping capacity, the reduction in hydraulic capacity may put the apparatus well below the tipping capacity and higher than the safe operating capacity. Advantageously, hydraulic cylinder 1145 of the loader is not working in a reverse action and gains support towards lifting loads on the end of the boom with pressure applied to wheel 1110 with the downward action of the loader arms 1140 with the retracting action of hydraulic cylinder 1146. In a standard attachment arrangement without support external of the loader such as a standard bucket, the hydraulic cylinders 1145, 1146 may work separately to support the load according to how they are designed to operate. In this arrangement, hydraulic cylinders 1145, 1146 may work together with the support of wheel 1110 which is also carrying the weight of the load.

Power driven lift attachment apparatus 1100, by use of the pair of wheels 1110, operating between the loader 1130 and the load at the end of the boom 1115, may operate as a lever. This configuration and capability to operate as a lever may dramatically improve the lift capacity of the boom 1115 as compared to previous implementations. For example, the use of the pair of wheels 1110 as the fulcrum, may allow an amplification of the input force provided by a loader 1130 when applied to the attachment device 1105 of the lift attachment apparatus 1100 in order to provide a greater output force. It is contemplated that mechanical advantage of the lift attachment apparatus 1100 may be greater when the pair of wheels 910 at the point to where the pair of wheels 1110 come into contact with a surface is located between the attachment device 1105 that is coupled to a tilting plane of a loader 1130 and the load which is located at the end of the boom 1115, as shown in FIG. 11B. Additionally, it is contemplated that a center point of the pair of wheels 1110, (e.g. the point at which the wheels may contact the axle), may also be forward of the attachment device 1105 whereby mechanical advantage of the lift attachment apparatus 1100 may be greater. Use of the lift attachment apparatus 1100 may allow transport of material while the loader is located thirty feet away or greater, which may be particularly valuable in muddy conditions or other conditions in which a surface is not solid.

Referring again to FIGS. 11A-11E, boom 1115 is configured as a long rod or pole. While not shown in FIGS. 11A-11E but shown in FIGS. 9D & 10J-10K, it is contemplated that boom 915 may include a trolley beam. Boom 1115 may also include one or more apertures, hooks, connectors, and the like to allow coupling to material for transport. It is contemplated that boom 1115 may be constructed of steel, and may be tubular in nature. However, boom 1115 may be formed of various cross section shapes such as rectangular, round, triangle, roman arch, or gothic arch. Boom 1115 may be constructed as a skeletal body. Boom 1115 may be constructed of other materials instead of or in addition to steel, including aluminum, wood, plastic, carbon fiber, composites thereof and the like.

Loader 1130 may include any type and size of loader. Loader 1130 may be track skid loader, skid steer loader, all wheel steer loader, wheel loader, crawler loader or a front end loader. While loader 1130 is described with a single forward facing loader arm 1140, it is contemplated that two or more forward facing loader arms may be employed by a loader 1130 without departing from the scope and intent of the present disclosure. It is also contemplated that loader 1130 may employ added hydraulic controls.

Figure 11C:
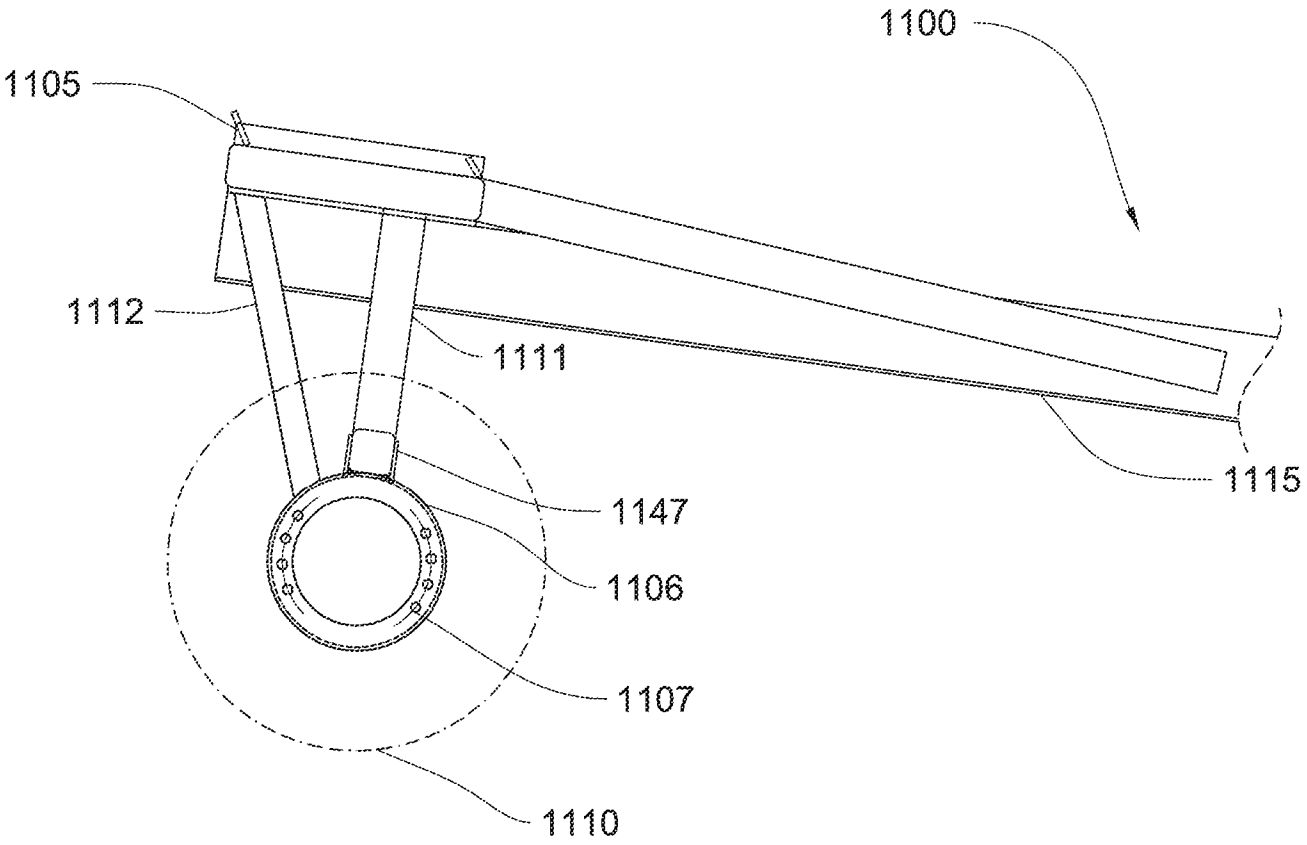

FIG. 11C depicts an exploded detailed side view of the power driven lift attachment apparatus 1100 with associated components, i.e. with the lift attachment apparatus boom 1115, drive rated wheel 1110, attachment device 1105, a perpendicular frame coupler 1111, an angled frame coupler 1112, hub carrier 1106, a hub carrier mounting plate 1147, hub mounting holes 1107 drilled in the hub carrier to match a hydraulic drive motor. It is contemplated the hub carrier mount could be made of 12" O.D. round steel with a ring welded to the face large enough for a hydraulic motor to be mounted to through the hub mounting holes 1107. It is also contemplated that angled frame coupler 1112 could have a different length that would allow the pitch of the hub carrier 1006 to be changed or for hub carrier mount 1006 to be moved to accommodate different hydraulic motors and configurations.

Figure 11D:
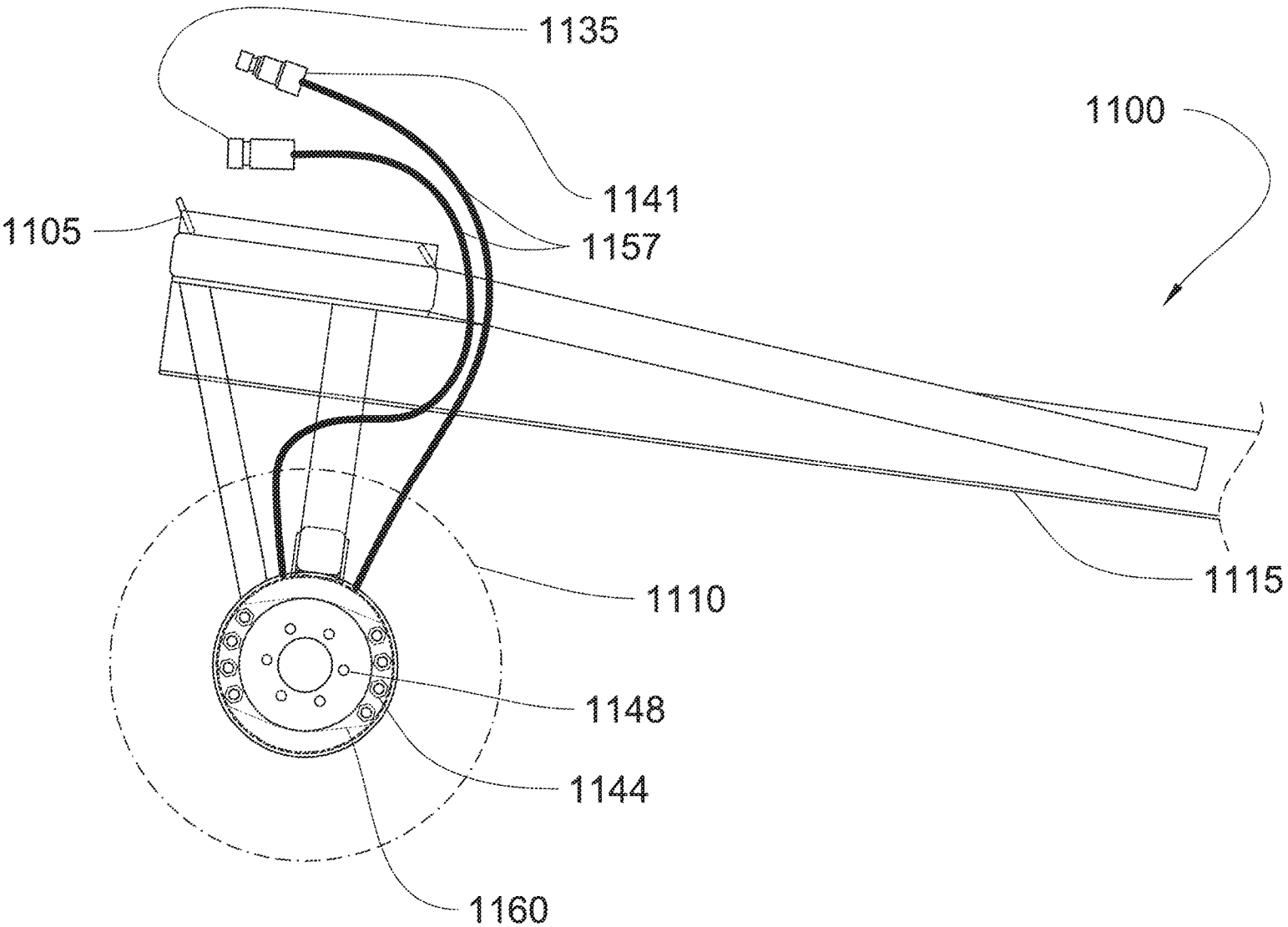

FIG. 11D depicts an exploded detailed side view of the power driven lift attachment apparatus 1100 with associated components, i.e. with the lift attachment apparatus boom 1115, hydraulic drive motor 1160, hydraulic drive motor mounting bolts 1144, drive wheel studs 1148, hydraulic hoses 1157, hydraulic male flat faced quick coupler 1141 receivable of positive hydraulic pressure inflow to drive forward, hydraulic female male flat faced quick coupler 1135 receivable of negative hydraulic pressure outflow to drive forward.

Figure 11E:
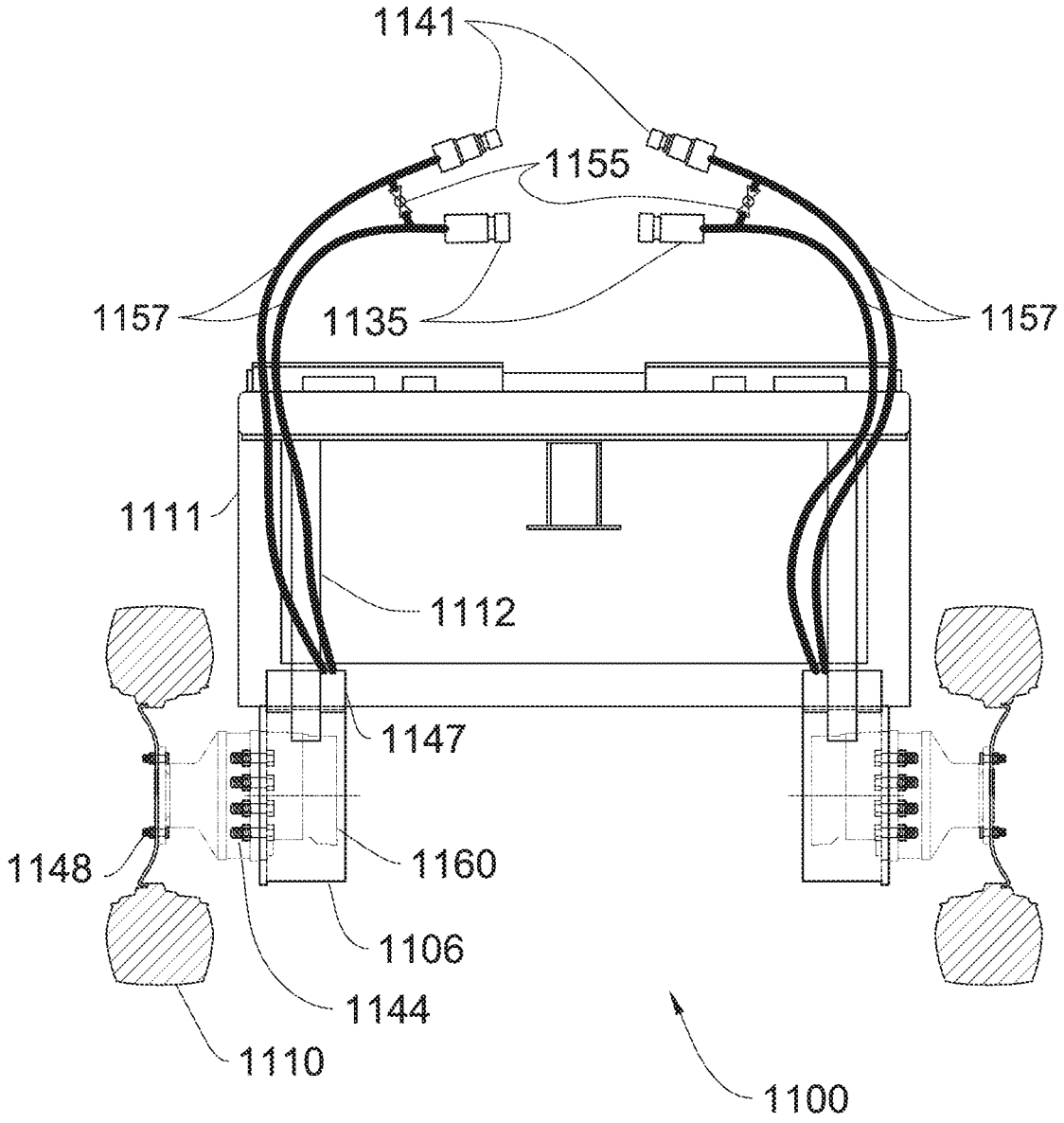

FIG. 11E depicts an exploded detailed rear view, being the view of the operator of lift attachment apparatus 1100 with associated additional components 1155 bypass valves. It is contemplated these valves may be used to loop the hoses to move the attachment when hydraulic power is not available for shortly timed use. It is also contemplated hoses with adapters that "T" out to these fittings or are connected to each fitting can be made to fit a variety of machines, but it may be more advantageous to have the hoses 1157 with the hydraulic male flat faced quick couplers 1141 run together before the male flat faced quick couplers 1141 and hoses 1157 with hydraulic female male flat faced quick couplers 1135 run together before the female male flat faced quick couplers 1135 making 2 quick couplers in total rather than 4.

Referring to FIGS. 11C-11E, it is contemplated that hydraulic drive motor 1160 may be a Poclain MS05-6-2e drive motor. However, a different hydraulic motor may be employed that may have additional features including but not limited to variable brakes, fail-safe brakes, an internal disengaging feature, or an integrated transmission run by gears, chains, belts or pulleys. It is further contemplated that the hydraulic drive motor 1160 may not be within the hub carrier 1106 but run into an independent hub, transmission, gearbox, brake or engagement device within or between the hydraulic drive motor 1160 and the hub carrier 1106. It is also contemplated that the motor could be powered by other means such as electricity or fuel. It is contemplated these motors will normally be able to be run with the loader with no additional controls on the attachment but a control device may be employed that may be operable with the loader 1130 controls or independent of the loader 1130.

Referring to FIG. 11E, It is contemplated hoses with adapters that "T" out to these fittings or are connected to each fitting can be made to fit a variety of machines, one of those machines being a machine that has quick couplers that are hydraulically charged with valves linked to the control arms of the loader synchronized with the loader wheels that determine flow of positive and negative pressures. It is contemplated that this option may be closed off via a switch accessible to the driver that cuts off all four lines at which time those lines are connected open on their corresponding sides of the loader together to allow the attachment to be in a neutral position and allowing attachment functions to move as freely as possible rather than creating hydraulic lock up or to allow the functions of the attachment to work with the hand controls of the loader rather than be synchronized with the loader wheels.

The lift attachment apparatus 1100 as described and shown in FIGS. 11A-11E provides a number of advantages. It is common that contractors may have access to a loader due to the reduced cost of a loader as compared to lifts and cranes. Additionally, through use of various attachments, loaders may be more likely to be owned due to their multiple functions, usability, and operability without specialized skill. However, previous implementations of booms with loaders are limited due to their low lift capacity, reach, or mobility. It is further contemplated that powered wheels being used with an attachment will allow loader 1130 to move in a more safe and efficient manner.

Figure 12A:
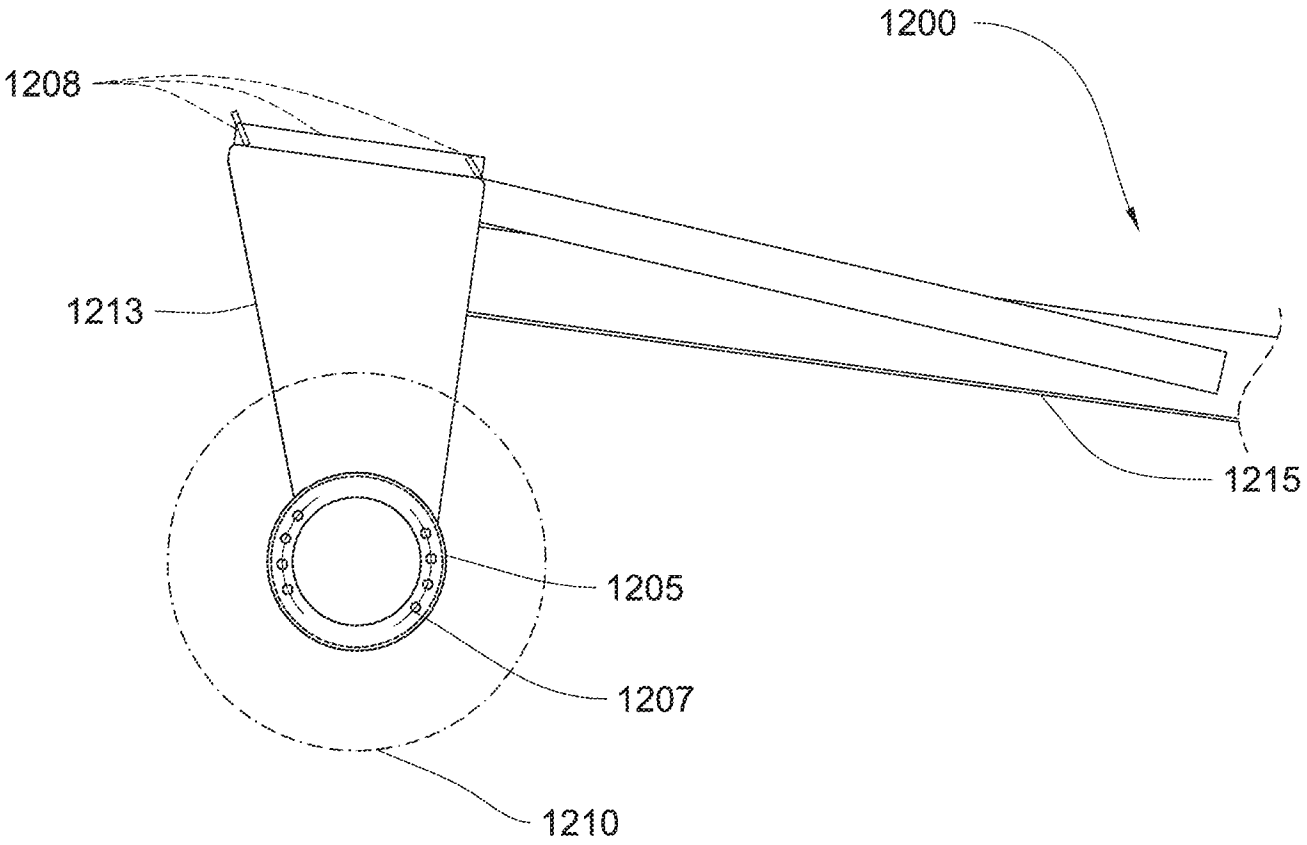
FIG. 12A depicts an exploded side view of a lift attachment apparatus in accordance with an alternative embodiment of the present disclosure.
Figure 12B:
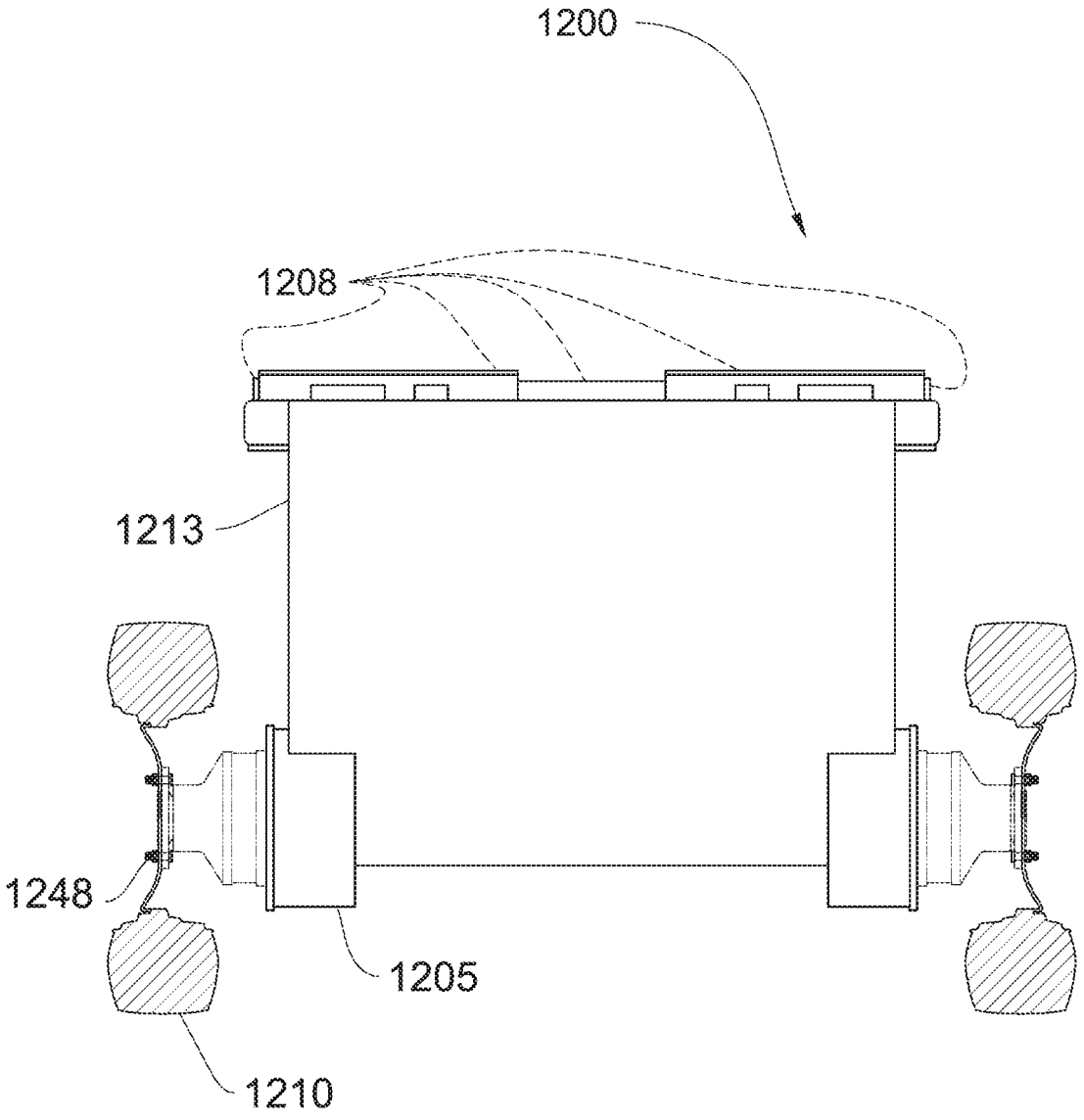
FIG. 12B depicts an exploded rear view of a lift attachment apparatus in accordance with an alternative embodiment of the present disclosure.

Referring to FIGS. 12A-12B, a lift attachment apparatus according to an alternative embodiment is shown. Lift attachment apparatus 1200 may provide an enclosed space for devices including but not limited to a hydraulic pump, a motor, gears, a transmission, a battery, a communication system to communicate between lift attachment apparatus 1200 and a loader, solenoids, relays, or other devices related to use of the boom 1215. It is also contemplated that controller device may also include cords, hoses, or fluid storage containers to provide for more efficient operation of lift attachment apparatus 1200. It is contemplated that the frame may be formed of a generally rectangular box, formed of steel plate 1213 and may include 0.25" or thicker steel welded together, including six pieces. It is contemplated that with this configuration, the frame may not include any tubular, square, or cast steel members to reinforce the frame 1213. This configuration may be advantageous in that it would have a completely open space for storage and devices. Although not shown, it is contemplated that frame 1213 may have one or more doors for access, dividers, or mounting brackets. As shown, attachment apparatus fins 1208 may be used to attach a loader attachment plate to lift attachment apparatus 1200 where the top of frame 1213 would include an attachment plate. It is contemplated that non-powered wheels 1210 or powered wheels 1210 may be used if attached to a hub with lug studs 1248 or to hub carrier assembly 1205 as desired.

Referring to FIGS. 13A-13G, a lift attachment apparatus 1300 in accordance with another alternative embodiment is shown. Lift attachment apparatus 1300 may include a bucket 1367 and may allow lifting of material at a longer and higher distance away from loader 1330 than with a standard bucket attached to a loader 1330. Bucket 1367 is shown as a smooth dirt bucket but it is also contemplated it could also be a snow bucket, a snow blade, push blade, bulldozer type blade, angling scraper blade, dredger bucket, forks, a boom, hook, setting pole or other basic lifting configuration. It is contemplated that additional hydraulic or electric capabilities to run an attached device including but not limited to a grapple, circular saw, chainsaw, block setter, material platform or work platform may be provided. It is contemplated the bucket 1367 may attach to boom attachment apparatus 1321 through a corresponding bucket attachment device 1306.

Figure 13A:
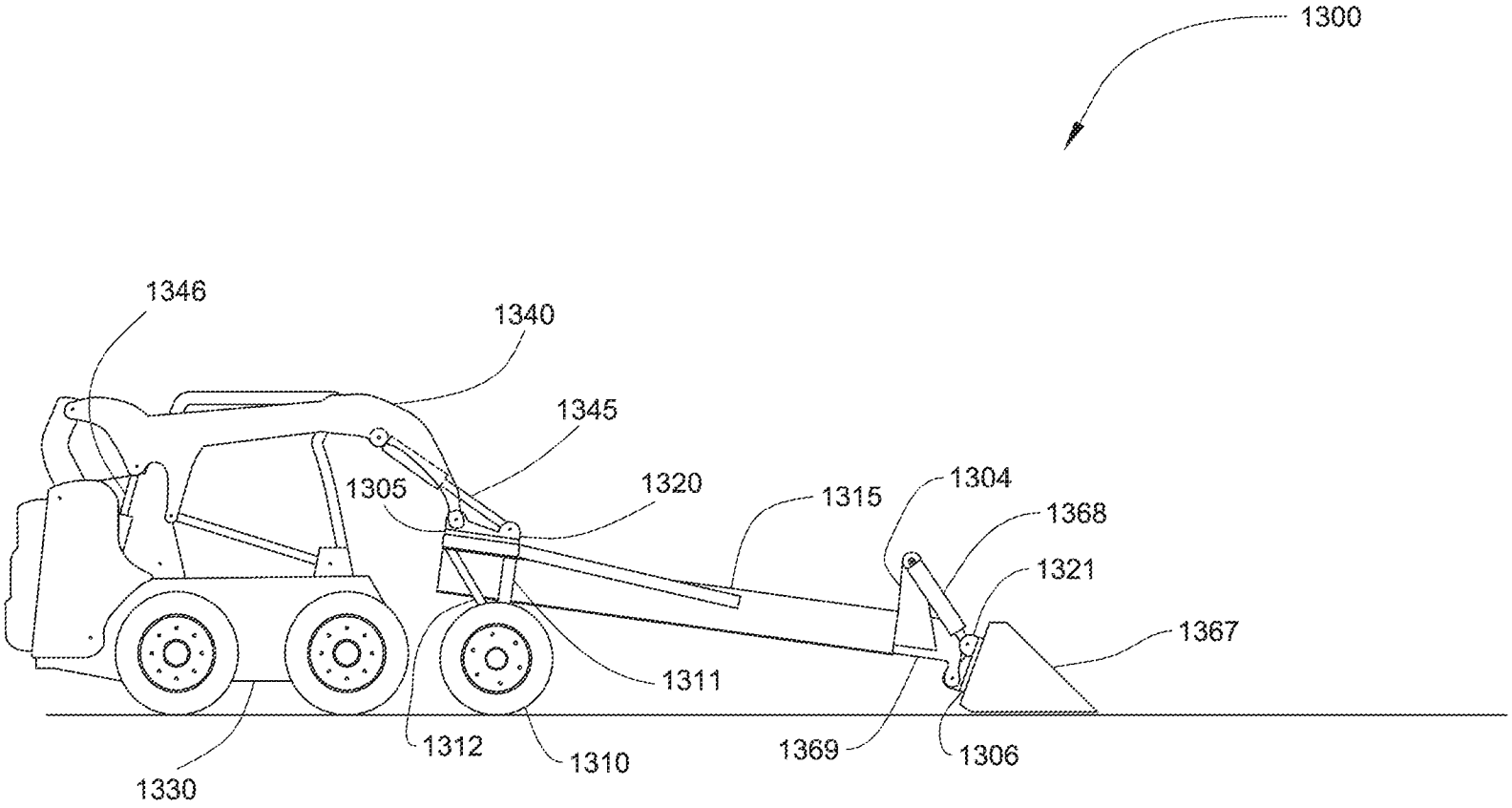
FIGS. 13A-13C depict side views of a lift attachment apparatus in accordance with an embodiment of the present disclosure.
Figure 13B:
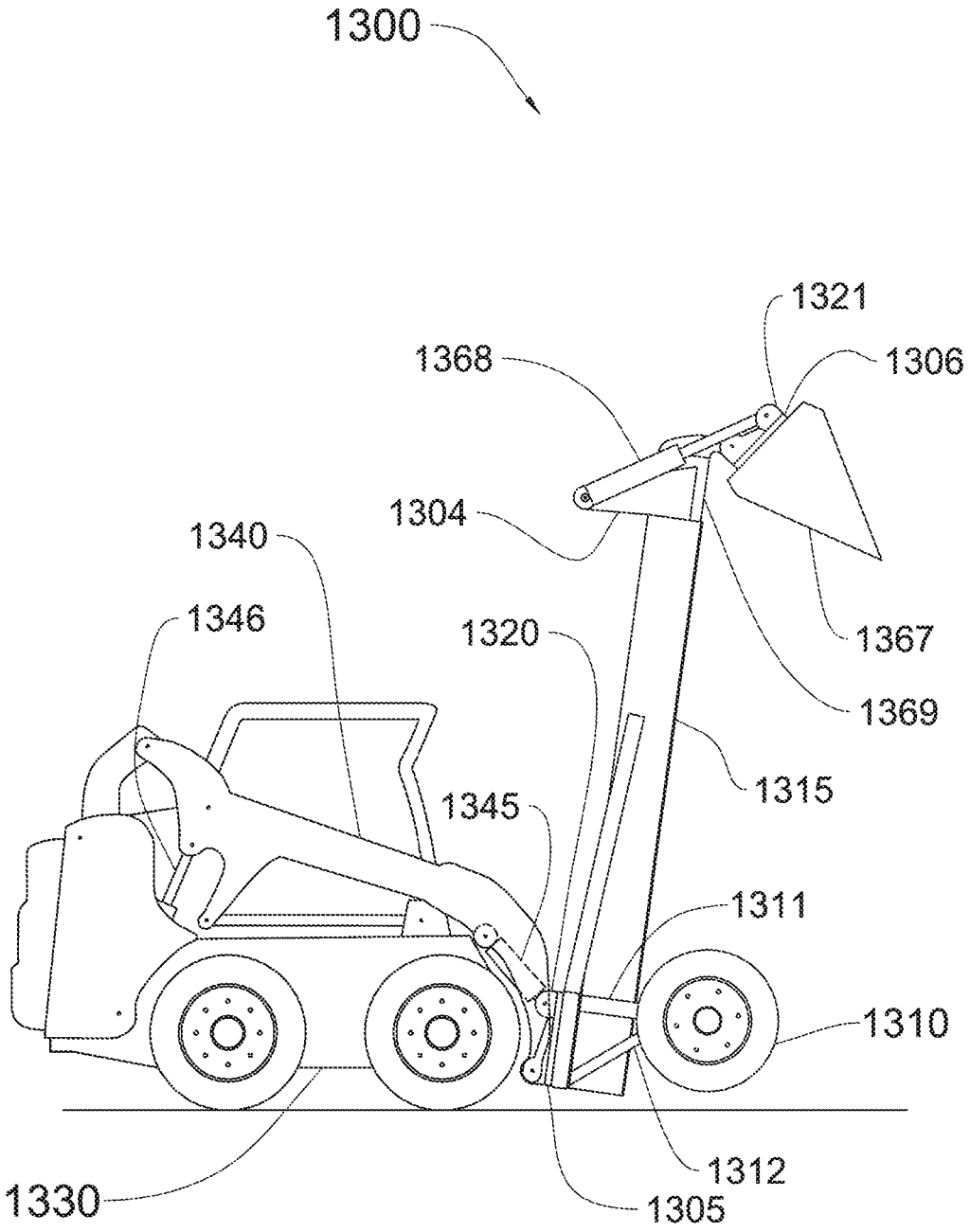
Figure 13C:
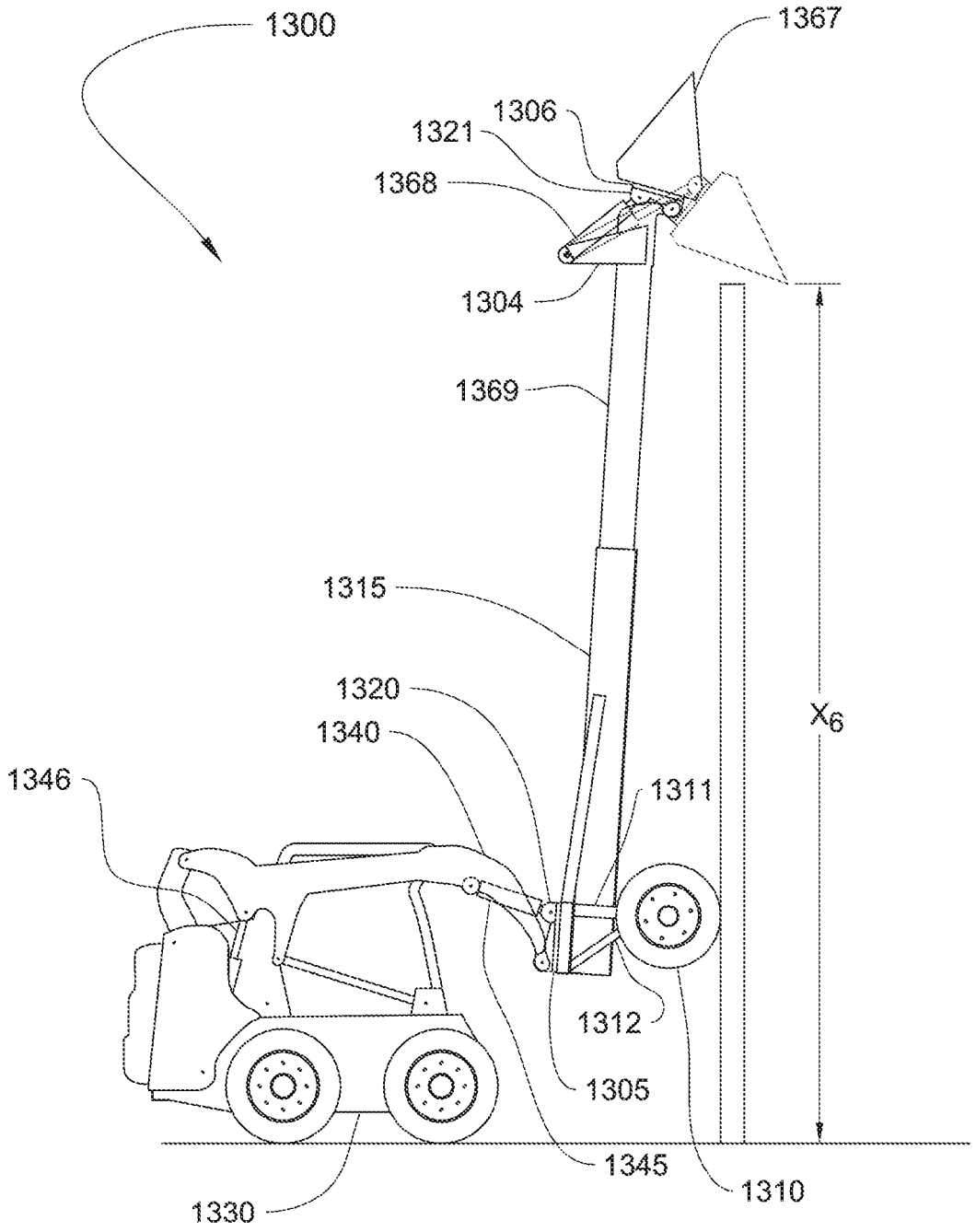

Referring again to FIGS. 13A-13G, it is contemplated that various configurations (e.g. a load) may be removably coupled to an end of boom 1315 and may be lifted to a desired location. Lift attachment apparatus 1300 according to present disclosure may be configured to be safely rotated from a horizontal position as shown in FIG. 13A to a near vertical position (near 80 to 90 degrees to a surface) as shown in FIGS. 13B-13C without risking the load or tipping an attached loader 1330. Attachment device 1305 of frame may be configured to attach to a tilting plane 1320 of a loader 1330 having a forward facing loader arm 1340. It is contemplated that attachment device 1305 may be permanently fixed or incorporated with tilting plane 1320 according to an alternative embodiment of the present disclosure. Boom 1315 may be generally fixed with the attachment device 1305 of the frame. It is contemplated that control of the boom 1315 is provided by application of force to the attachment device 1305 by the forward facing loader arm 1340 in a downward direction to create lift and rotation of the tilting plane 1320 causing rotation of an end of the boom about the first wheel and the second wheel of the pair of wheels 1310. Tilting plane 1320 may be controlled by a hydraulic cylinder 1345 of loader 1330. It is contemplated that boom 1315 may be configured to be tipped up via application of force to the attachment device 1305 in a downward direction and via reverse action of hydraulic cylinder 1346 of the forward facing loader arm 1340 of the loader 1330. Through reverse action, the hydraulic capacity may be reduced, such as by about 44%. This reduction in hydraulic capacity may make it difficult to overload the lift attachment apparatus 1300 if the load is being raised. Since the hydraulic capacities of hydraulic cylinders of many loaders are just over their tipping capacity, the reduction in hydraulic capacity may put the apparatus well below the tipping capacity and higher than the safe operating capacity. Advantageously, hydraulic cylinder 1345 of the loader is not working in a reverse action and gains support towards lifting loads on the end of the boom with pressure applied to wheel 1310 with the downward action of the loader arms 1340 with the retracting action of hydraulic cylinder 1346. In a standard attachment arrangement without support external of the loader such as a standard bucket the hydraulic cylinders 1345, 1346 work separately to support the load according to how they are designed to operate. In this arrangement, these hydraulic cylinders 1345, 1346 work together with wheel 1310 which is also carrying the weight of the load.

Figure 13D:
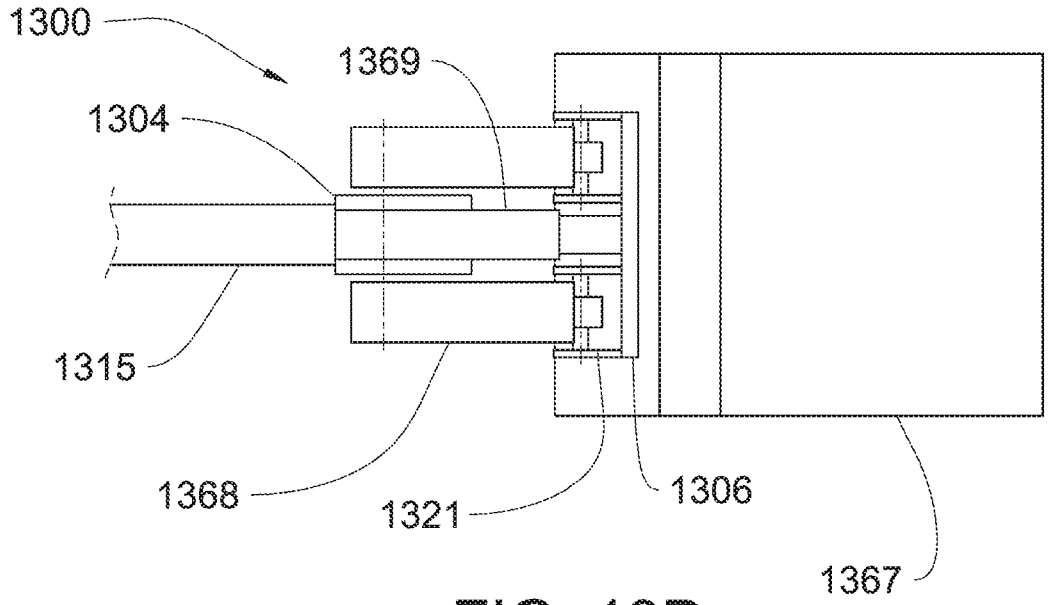
FIG. 13D depicts an exploded top view of a lift attachment apparatus in accordance with another alternative embodiment of the present disclosure.
Figure 13E:
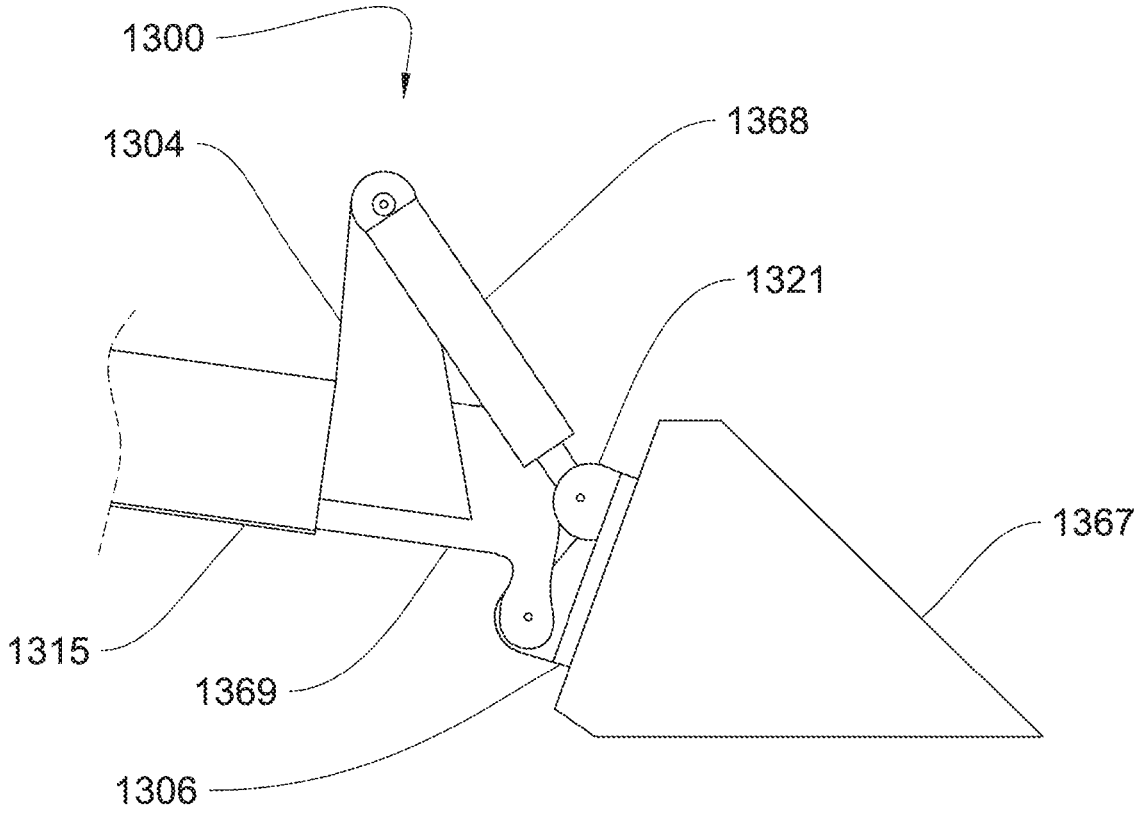
FIG. 13E depicts an exploded side view of a lift attachment apparatus in accordance with another alternative embodiment of the present disclosure.

Referring to FIG. 13C, a lift attachment apparatus 1300 which further includes an additional extension rod with carrier hinge 1369 in accordance with an embodiment of the present disclosure is shown. It is contemplated that boom 1315 may further include a hollow interior sized to accommodate extension rod with carrier hinge 1369 as shown in FIGS. 13D-13E to be extended as shown in FIG. 13C to be extended manually and set with pins like a truck hitch or by electric or hydraulic force. Extension rod with carrier hinge 1369 may extend out of boom 1315 and connect to boom attachment apparatus 1321 with a hinge pin to attach to bucket attachment device 1306 on bucket 1367 to increase the height capacity and range of the lift apparatus 1300 to exemplary heights such as $X_6$ shown at 18' high in FIG. 13C but may be able to reach heights of 22' or more in this configuration.

It is contemplated that extension rod with carrier hinge 1369, boom attachment apparatus 1321, bucket attachment device 1306, and bucket 1367 may be of different configurations to accommodate a different bucket such as a snow bucket, snow blade, a push blade, bulldozer type blade, angling scraper blade, dredger bucket, forks, a boom, hook, setting pole or other basic lifting configuration or may employ additional hydraulic capabilities or electric capabilities to run an attached device including but not limited to a grapple, circular saw, chainsaw, block setter, material platform or work platform. Additionally, extension rod with carrier hinge 1369 may have adjustable angles at the end and also may range from 0 to a 180 degree return. As shown in FIG. 13C, lift attachment apparatus 1300 may be supported against a vertical wall in order to increase vertical range of the lift attachment apparatus 1300. It is further contemplated that lift attachment apparatus 1300 may be supported against a generally horizontal surface on a different horizontal elevation than the loader 1330 to increase vertical range and horizontal range. Surfaces to be rested against may include but are not limited to a material dump box of a truck or trailer, a vertical cliff, an upward or downward slope, or a tight strap may be attached on frame coupler 1311 between frame coupler 1312 and axle 1313 shown on FIGS. 13F-13G to rest against a pole or a tree.

Referring again to FIGS. 13A-13G, it is contemplated that bucket 1367 may be tipped with hydraulic cylinders 1368 connected to mast 1304 with pin which is attached to the side of extension rod with carrier hinge 1369 as shown in FIGS. 13C-13E.

Figure 13F:
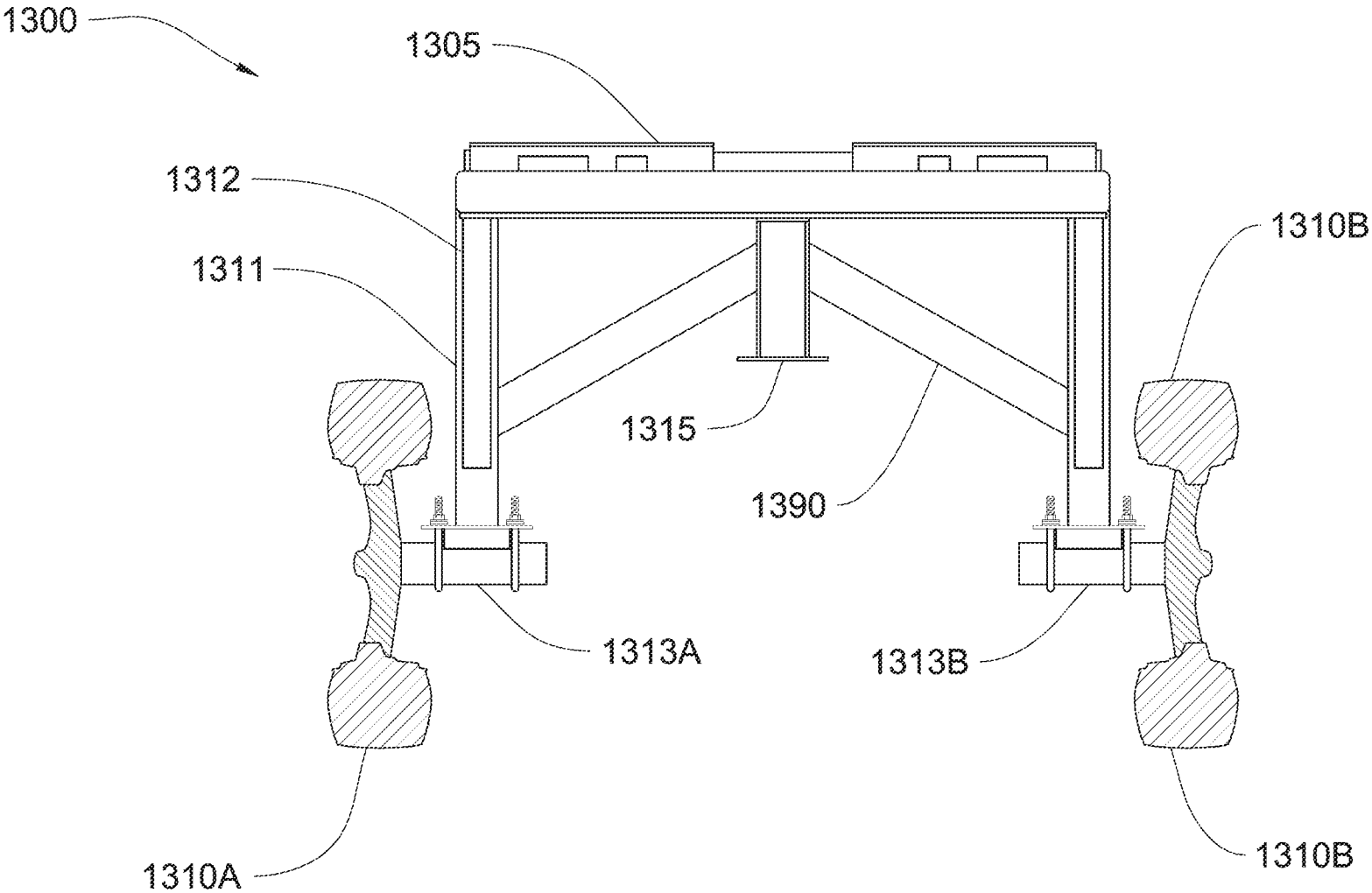
FIGS. 13F-13G depict exploded rear view of a lift attachment apparatus in accordance with another alternative embodiment of the present disclosure.
Figure 13G:
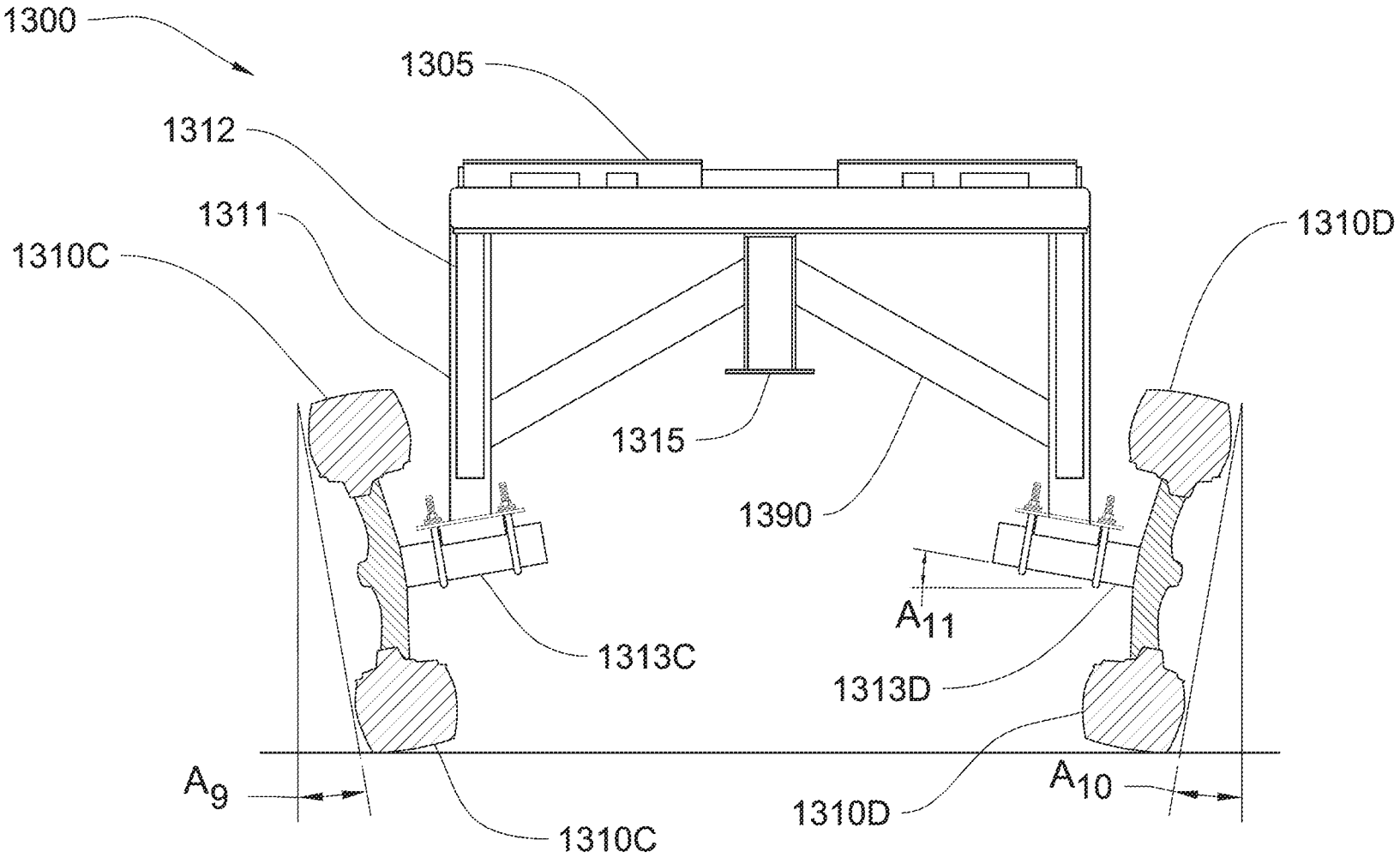

Referring to FIGS. 13F-13G, several different wheel aligning configurations may be employed for different applications. Referring to FIG. 13F, the first wheel may be generally parallel with the second wheel. This configuration may be advantageous for flat driving surfaces where turning and stability is less of an issue than other surfaces and an individual wants the tires or wheel 1310 to last as long as possible. Referring to FIG. 13G, a first wheel may be coupled to a first axle and a second wheel may be coupled to a second axle, whereby the first axle is connected to a first side of the frame and the second axle is connected to a second side of the frame. It may be advantageous to have the wheels be in a positive camber arrangement at angles A9, A10, or A11 as shown. This wheel, 1310A-1310D may have a positive camber of 10 degrees as shown or have different angles together all being the same or different. It is common for tractors and other agricultural equipment to have positive camber and this may stiffen the wheel bearings in one direction and facilitate a higher level of slip angle on the tires of wheel 1310 allowing the wheels to be more stable but also allowing the wheels to turn at further ease than with a cambered wheel 1310A-1310B with 0 camber. It is further contemplated that if the wheels 1310 were placed in a negative camber where the wheels were turned out at the bottom that the wheel bearings would stiffen up in one direction but the slip angle of the tire of wheel 1310 may be reduced and make lift attachment apparatus 1300 be driven in a straight line with greater ease.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

What is claimed is:

1. A lift attachment apparatus, comprising:

a frame, the frame including an attachment device, a first side coupled to the attachment device, and a second side coupled to the attachment device, the attachment device configured to attach to a tilting plane of a loader, the loader having a forward facing loader arm;

a first wheel connected to a first axle, the first axle coupled to the first side of the frame;

a second wheel connected to a second axle, the second axle coupled to the second side of the frame, wherein the first wheel is configured to rotate about the first axle and the first axle remains in a fixed position, the second wheel is configured to rotate about the second axle and the second axle remains in a fixed position; and a boom connected to the frame, the boom being generally fixed in a similar plane as the attachment device of the frame, wherein the boom is configured to be controlled by application of force to the attachment device by the forward facing loader arm in a downward direction to create lift and rotation of the tilting plane causing rotation of an end of the boom about the first wheel and the second wheel, wherein the first wheel and the second wheel are maintained to be always generally parallel or the first wheel and the second wheel are maintained to be always cambered at an angle up to 10 degrees.

2. The lift attachment apparatus as claimed in claim 1, wherein the first side of the frame is generally perpendicular to the attachment device of the frame.

3. The lift attachment apparatus as claimed in claim 2, wherein the second side of the frame is generally perpendicular to the attachment device of the frame.

4. The lift attachment apparatus as claimed in claim 1, wherein said boom is configured to be tipped up via reverse action of a hydraulic cylinder of the forward facing loader arm of the loader.

5. The lift attachment apparatus as claimed in claim 1, wherein said frame is formed of a generally rectangular box.

6. The lift attachment apparatus as claimed in claim 1, wherein said boom includes a cable hoist assembly.

7. The lift attachment apparatus as claimed in claim 6, wherein the cable hoist assembly includes a winch and a cable.

8. The lift attachment apparatus as claimed in claim 7, wherein the winch includes at least two conductors, the at least two conductors configured to be coupled with the loader.

9. The lift attachment apparatus as claimed in claim 1, further comprising a first hydraulic motor coupled to the first wheel.

10. The lift attachment apparatus as claimed in claim 9, wherein the first hydraulic motor includes at least two hoses, the at least two hoses configured to be coupled with the loader.

* * * * *